US011798762B2

(12) United States Patent
Iijima et al.

(10) Patent No.: US 11,798,762 B2
(45) Date of Patent: Oct. 24, 2023

(54) GAS CIRCUIT BREAKER

(71) Applicants: Kabushiki Kaisha Toshiba, Tokyo (JP); Toshiba Energy Systems & Solutions Corporation, Kawasaki (JP)

(72) Inventors: Takanori Iijima, Yokohama Kanagawa (JP); Amane Majima, Kawasaki Kanagawa (JP); Toshiyuki Uchii, Yokohama Kanagawa (JP); Akira Shimamura, Yokohama Kanagawa (JP); Norimitsu Kato, Yokohama Kanagawa (JP)

(73) Assignees: Kabushiki Kaisha Toshiba, Tokyo (JP); Toshiba Energy Systems & Solutions Corporation, Kawasaki (JP)

( * ) Notice: Subject to any disclaimer, the term of this patent is extended or adjusted under 35 U.S.C. 154(b) by 115 days.

(21) Appl. No.: 17/310,214

(22) PCT Filed: Apr. 2, 2019

(86) PCT No.: PCT/JP2019/014706
§ 371 (c)(1),
(2) Date: Jul. 26, 2021

(87) PCT Pub. No.: WO2020/202479
PCT Pub. Date: Oct. 8, 2020

(65) Prior Publication Data

US 2022/0319785 A1 Oct. 6, 2022

(51) Int. Cl.
*H01H 33/56* (2006.01)
*H01H 33/57* (2006.01)

(52) U.S. Cl.
CPC ..... *H01H 33/56* (2013.01); *H01H 33/57* (2013.01)

(58) Field of Classification Search
CPC ..... H01H 33/56; H01H 33/57; H01H 33/55; H01H 33/91; H01H 33/565;
(Continued)

(56) References Cited

U.S. PATENT DOCUMENTS 3,725,623 A 4/1973 Fischer et al.
4,219,712 A * 8/1980 Emmerich ..... H01H 33/905 218/60
(Continued)

FOREIGN PATENT DOCUMENTS

EP 2 779 195 A1 9/2014
JP S50-22707 B1 8/1975
(Continued)

OTHER PUBLICATIONS

International Search Report for International Application No. PCT/JP2019/014706 dated May 14, 2019, 2 pages.

*Primary Examiner* — William A Bolton
(74) *Attorney, Agent, or Firm* — Finnegan, Henderson, Farabow, Garrett & Dunner, LLP

(57) ABSTRACT

A gas circuit breaker includes a sealed container in which the arc-extinguishing gas is enclosed, a first fixed contactor portion and a second fixed contactor portion fixed to the sealed container, and a movable contactor portion which moves between the first fixed contactor portion and the second fixed contactor portion, to conduct and break current between them, in which an arc generated at a time of current breaking action is extinguished by spraying the arc-extinguishing gas, the gas circuit breaker includes a gas chamber configured to accumulate the unnecessary gas, the sealed container is formed by joining ends of the two hollow truncated cone portions, each having a large opening diam-
(Continued)

eter, with the cylindrical portion therebetween, and the gas chamber is formed inside the cylindrical portion forming the sealed container.

20 Claims, 25 Drawing Sheets

(58) Field of Classification Search
CPC ..... H01H 33/7053; H01H 33/7092; H01H 33/72; H01H 33/95; H01H 33/901; H01H 2033/888; H01H 2033/902; H01H 2033/566; H01H 2033/567; H01H 2033/908; H01H 2033/912
USPC ..... 218/1, 13, 45, 46, 47, 51, 53, 56, 57, 218/59–61, 68, 116, 79–80
See application file for complete search history.

(56) References Cited

U.S. PATENT DOCUMENTS 4,336,414 A * 6/1982 Suzuki ..... H01H 33/56 95/149
4,414,445 A * 11/1983 Garzon ..... H01H 33/94 218/60
4,458,119 A * 7/1984 Hashimoto ..... H01H 33/143 218/3
4,780,581 A * 10/1988 Holmgren ..... H01H 33/901 218/59
8,389,886 B2 * 3/2013 Dahlquist ..... H01H 33/74 218/59
9,570,256 B2 * 2/2017 Yanagi ..... H01H 33/64
2006/0151438 A1 7/2006 Urai et al.
2007/0221626 A1 9/2007 Uchii
2014/0069891 A1 * 3/2014 Otani ..... H01H 33/7046 218/46
2014/0263187 A1 9/2014 Yamada et al.
2015/0194280 A1 7/2015 Uchii et al.
2021/0175030 A1 6/2021 Iijima et al.

FOREIGN PATENT DOCUMENTS

JP S58-85740 U 6/1983
JP H9-56024 A 2/1997
JP 2007-258137 A 10/2007
JP 2009-189182 A 8/2009
JP 2014-72032 A 4/2014
JP 2015-35342 A 2/2015
JP 2016-63579 A 4/2016
JP 2016-152648 A 8/2016
KR 10-2006-0063720 A 6/2006
WO WO 2019/106840 A1 6/2019

* cited by examiner

GAS CIRCUIT BREAKER

CROSS-REFERENCE TO RELATED APPLICATIONS

This application is the U.S. National Stage Entry of International Application No. PCT/JP2019/014706, filed Apr. 2, 2019, which is incorporated herein by reference in its entirety.

FIELD

The present embodiment relates to a gas circuit breaker that breaks a current in a power system.

BACKGROUND

A gas circuit breaker is used to break current flowing through power supply lines in a power system. The gas circuit breaker is arranged in the power supply lines to break current that flows when a system is separated in which accident has occurred at the time of system accident.

The gas circuit breaker has a pair of electrodes arranged oppositely in a sealed container filled with arc-extinguishing gas. The pair of electrodes is driven by a driving device arranged outside the gas circuit breaker to open and close.

When the gas circuit breaker is opened, the pair of electrodes is driven by the driving device arranged outside the gas circuit breaker, and is mechanically separated. However, in the gas circuit breaker installed in an AC power system, arc current continues flowing until a current zero-point of next AC current even after the pair of electrodes is mechanically separated. A puffer-type gas circuit breaker circulates the arc-extinguishing gas in the sealed container, and sprays the arc-extinguishing gas to an arc to extinguish the arc and break this arc current.

PRIOR ART DOCUMENT

Patent Document

Patent Document 1: Japanese Patent Laid-Open Application No. 2014-72032

Patent Document 2: Japanese Patent Laid-Open Application No. 2009-189132

Patent Document 3: Japanese Patent Laid-Open Application No. 2016-152648

SUMMARY

The gas circuit breaker as described above breaks arc current by spraying arc-extinguishing gas to the arc to extinguish the arc. As the arc-extinguishing gas, sulfur hexafluoride gas ($SF_6$ gas) having excellent arc extinguishing performance has been conventionally mainly used. However, sulfur hexafluoride gas ($SF_6$ gas) is global warming gas, and in recent years, is demanded to reduce the usage amount thereof.

In recent years, instead of sulfur hexafluoride gas ($SF_6$ gas), arc-extinguishing gas mainly containing carbon dioxide, which has little global warming potential, is used. Gas mixed to carbon dioxide is oxygen, fluorinated ether, fluorinated ketone, etc. However, when the arc-extinguishing gas mainly containing carbon dioxide is sprayed to the arc and becomes high temperature, it might produce unnecessary gas (hereinafter, referred to as unnecessary gas), such as ozone and carbon monoxide. There is a problem in that, this unnecessary gas may causes deterioration in insulation performance and current breaking performance of the gas circuit breaker.

An objective of the present; embodiment is to provide a gas circuit breaker that cars reduce deterioration in insulation performance and current breaking performance due to unnecessary gas generated from arc-extinguishing gas sprayed to an arc.

Means to Solve the Problem

A gas circuit breaker of the present embodiment includes the following structure.

(1) A sealed container in which arc-extinguishing gas is enclosed.

(2) A first fixed contactor portion fixed to the sealed container.

(3) A second fixed contactor portion fixed to the sealed container.

(4) A movable contactor portion which moves between the first fixed contactor portion and the second fixed contactor portion, and which conducts and breaks current between the first fixed contactor portion and the second fixed contactor portion.

(5) An arc generated between a fixed arc contactor provided to the first fixed contactor portion and a movable arc contactor provided to the movable contactor portion at a time of current breaking action is extinguished by spraying the arc-extinguishing gas.

(6) A gas chamber configured to accumulate unnecessary gas generated from the arc-extinguishing gas sprayed to the arc.

(7) The sealed container is formed by joining ends of two hollow truncated cone portions both having a large opening diameter via a cylindrical portion therebetween, and the gas chamber is formed inside the cylindrical portion forming the sealed container.

DETAILED DESCRIPTION

First Embodiment

1-1. Overall Configuration

Figure 1:
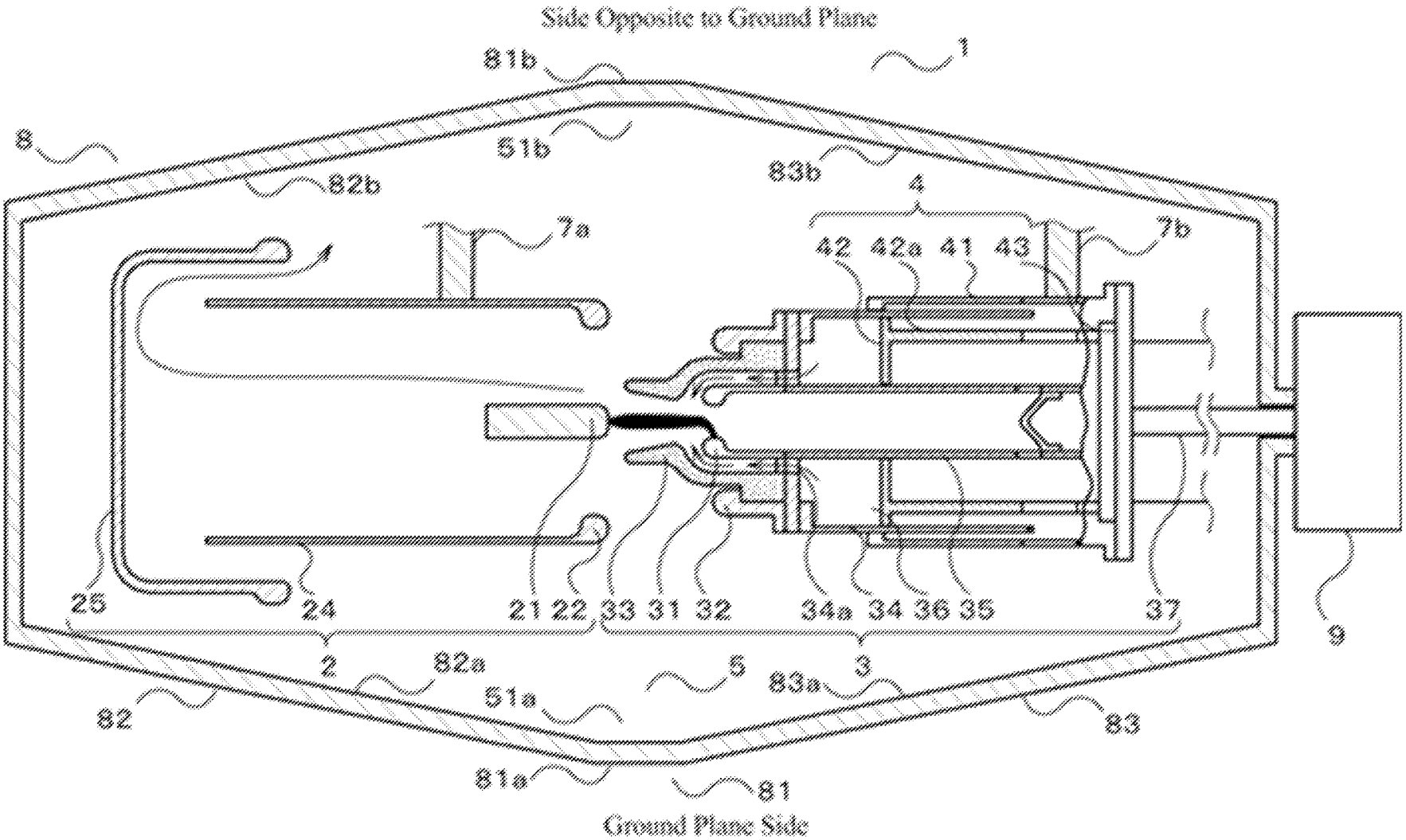
FIG. 1 is a diagram illustrating a configuration of a gas circuit breaker according to a first embodiment.
Figure 2:
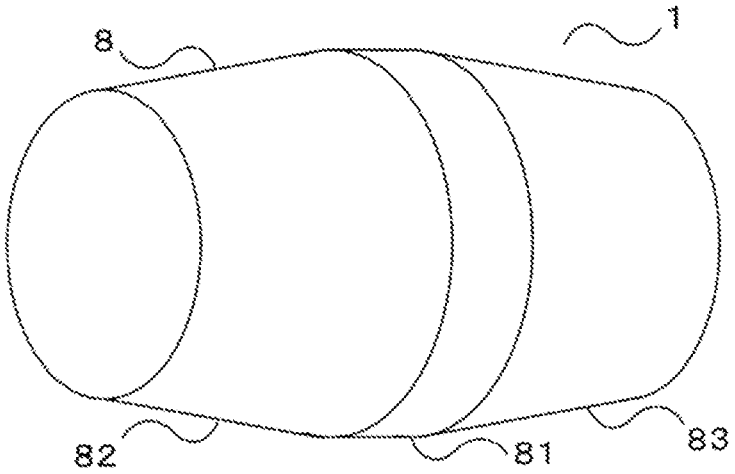
FIG. 2 is a perspective view illustrating an appearance of the gas circuit breaker according to the first embodiment.

Hereinafter, an entire configuration of a gas circuit breaker of the present embodiment will be described with reference to FIGS. 1 to 2. FIG. 1 illustrates a cross-sectional view of the entire configuration of the gas circuit breaker of the present embodiment. FIG. 1 illustrates an internal structure of a gas circuit breaker 1 in an opened state.

The gas circuit breaker 1 includes a first fixed contactor portion 2 (hereinafter, referred to as a fixed contactor portion 2), a movable contactor portion 3, a second fixed contactor portion 4 (hereinafter, referred to as a fixed contactor portion 4), and a sealed container 8. A power supply line 7*a* is connected to the fixed contactor, portion 2 via the sealed container 8 and a power supply line 7*b* is connected to the fixed contactor portion 4 via the sealed container 8. The power supply lines 7*a* and 7*b* are connected to a power system. The gas circuit breaker 1 is installed in a power supply facility such as a substation.

The fixed contactor portion 2 and the fixed contactor portion 4 each are a cylindrical member made of conductive metal. The movable contactor portion 3 is a cylindrical member made of conductive metal, and is arranged to be in close contact with inner diameters of the fixed contactor portion 2 and the fixed contactor portion 4 and to be slidable. The fixed contactor portion 2 and the fixed contactor portion 4 are arranged to be separated from each other in the sealed container 8.

The movable contactor portion 3 is driven by a driving device 9 arranged outside the gas circuit breaker 1, and moves between the fixed contactor portion 2 and the fixed contactor portion 4 to electrically connect or disconnect the fixed contactor portion 2 and the fixed contactor portion 4. Accordingly, the power supply lines 7*a* and 7*b* are electrically connected or disconnected.

When the gas circuit breaker 1 becomes the opened state, an arc is generated between the fixed contactor portion 2 and the movable contactor portion 3. This arc is extinguished by circulating arc-extinguishing gas filled in the sealed container 8.

The sealed container 8 is a cylindrical sealed container made of metal, glass, etc., and configured to be filled with the arc-extinguishing gas. As the arc-extinguishing gas, gas mainly containing carbon dioxide ($CO_2$ gas), which has excellent arc extinguishing performance and insulation performance, is used. The sealed container 8 is connected to a ground potential.

The fixed contactor portion 2 is a cylindrical member concentric with the sealed container 8. The fixed contactor portion 2 includes a fixed arc contactor 21, a fixed conductive contactor 22, and an exhaust pipe 25. Details of these members will be described later. The power supply line 7*a* is connected to the fixed contactor portion 2 via the sealed container 8.

The fixed contactor portion 2 is fixed and arranged to the sealed container 8. When the gas circuit breaker 1 is in the closed state, the fixed contactor portion 2 is electrically connected to the fixed contactor portion 4 via the movable contactor portion 3, and the current, flows between the power supply lines 7*a* and 7*b*. On the other hand, when the gas circuit breaker 1 is in the opened state, the fixed contactor portion 2 is electrically disconnected from the movable contactor portion 3, and the current between the power supply lines 7*a* and 7*b* is broken.

The fixed contactor portion 4 is a cylindrical member concentric with the sealed container 8. The fixed contactor portion 4 includes a conductive contactor 41, and a piston 42. Details of these members will be described later. The power supply line 7*b* is connected to the fixed contactor portion 4 via the sealed container 8. The fixed contactor portion 4 is fixed and arranged to the sealed container 8.

When the gas circuit breaker 1 is in the closed state, the fixed contactor portion 4 is electrically connected to the fixed contactor portion 2 via the movable contactor portion 3, and the current flows between the power supply lines 7*a* and 7*b*. On the other hand, when the gas circuit breaker 1 is in the opened state/the fixed contactor portion 4 is electrically disconnected from the fixed contactor portion 2 and the movable contactor portion 3, and the current between the power supply lines 7*a* and 7*b* is broken.

The movable contactor portion 3 is a cylindrical member concentric with the sealed container 8. The movable contactor portion 3 includes a movable arc contactor 31, a movable conductive contactor 32, an insulation nozzle 33, and a cylinder 34. Details of these members will be described later. One end of the movable contactor portion 3 is formed into a cylindrical shape having an outer diameter in contact with an inner diameter of the fixed contactor portion 2. The other end of the movable contactor portion 3 is formed into a cylindrical shape having an outer diameter in contact with an inner diameter of the fixed contactor portion 4. The movable contactor portion 3 is arranged to be reciprocally movable between the fixed contactor portion 2 and the fixed contactor portion 4.

The movable contactor portion 3 is mechanically connected to the driving device 9 arranged outside the gas circuit breaker 1. The movable contactor portion 3 is driven by the driving device 9 to open and close the gas circuit breaker 1, breaking and conducting the current flowing through the power supply lines 7*a* and 7*b*. When the gas circuit breaker 1 is in the closed state, the movable contactor portion 3 is electrically connected with the fixed contactor portion 2 and the fixed contactor portion 4, and the current flows between the power supply lines 7*a* and 7*b*. On the other hand, when the gas circuit breaker 1 is in the opened state, the movable contactor portion 3 is electrically disconnected from the fixed contactor portion 2, and the current between the power supply lines 7*a* and 7*b* is broken.

Furthermore, when the gas circuit breaker 1 is in the opened state, the movable contactor portion 3 pressurizes the arc-extinguishing gas in a pressure accumulating chamber 36 formed by the piston 42 and the cylinder 34 that works together with the movable contactor portion 3. When the gas circuit breaker 1 is in the opened state, the movable contactor portion 3 causes the arc-extinguishing gas accumulated in the pressure accumulating chamber 36 to be sprayed from the insulation nozzle 33, and the arc generated between the fixed contactor portion 2 and the movable contactor portion 3 is extinguished to break the arc current.

The fixed contactor portion 2, the movable contactor portion 3, the fixed contactor portion 4, and the sealed container 8 are concentric cylindrical members having a common center axis, and are arranged on the same axis. In below, to describe positional relation and direction of each member, a direction toward the fixed contactor portion 2 side is called an open-end direction, and a direction toward the fixed contactor portion 4 side opposite thereto is called a driving-device direction.

The sealed container 8 is a cylindrical sealed container made of metal, glass, etc., and to be filled with the arc-extinguishing gas. The sealed container 8 is formed by joining ends of two hollow truncated cone portions 82 and 83, each having the large opening diameter, with a cylindrical portion 81 therebetween. The sealed container 8 includes gas chambers 52*a* and 51*b* inside the cylindrical portion 81 to which two truncated cone portions 82 and 83 are joined. The gas chambers 51*a* and 51*b* accumulate the unnecessary gas generated from the arc-extinguishing gas sprayed to the arc.

1-2. Detailed Configuration

Fixed Contactor Portion 2

The fixed contactor portion 2 includes the fixed arc contactor 21 and the fixed conductive contactor 22.

Fixed Conductive Contactor 22

The fixed conductive contactor 22 is a ring-shape electrode arranged on an end surface of the fixed contactor portion 2 on an outer circumference portion in the driving-device direction. The fixed conductive contactor 22 is formed of a metal conductor formed into a ring shape bulging toward the inner diameter side by shaving, etc.

The fixed conductive contactor 22 has an inner diameter which is slidable and which has a constant, clearance, relative to an outer diameter of the movable conductive contactor 32 of the movable contactor portion 3. The fixed conductive contactor 22 is arranged at an end of a ventilation cylinder 24, which is formed of cylindrical conductive metal, in the driving-device direction. The ventilation cylinder 24 is connected to the power supply line 7*a* via the sealed container 8. The ventilation cylinder 24 is fixed to the sealed container 8 by an insulation member.

When the gas circuit breaker 1 is in the closed state, the movable conductive contactor 32 of the movable contactor portion 3 is inserted into the fixed conductive contactor 22. Accordingly, the fixed conductive contactor 22 contacts the movable conductive contactor 32, and the fixed contactor portion 2 and the movable contactor portion 3 are electrically connected to each other.

On the other hand, when the gas circuit breaker 1 is in the opened state, the fixed conductive contactor 22 is separated from the movable conductive contactor 32 of the movable contactor portion 3, and the fixed contactor portion 2 and the movable contactor portion 3 are electrically disconnected from each other.

Fixed Arc Contactor 21

The fixed arc contactor 21 is a bar-shape electrode arranged at an end of the fixed contactor portion 2 in the driving-device direction along a center axis of the cylinder of the fixed contactor portion 2. The fixed arc contactor 21 is formed of a solid cylindrical conductive metal having a hemisphere end at the driving-device direction side formed by shaving, etc.

The fixed arc contactor 21 has an outer diameter which is slidable and which has a constant clearance, relative to the inner diameter of the movable arc contactor 31 of the movable contactor portion 3. The fixed arc contactor 21 is fixed to the ventilation cylinder 24 by a fixation support provided in an inner wall surface of the ventilation cylinder 24 forming the outer circumference of the fixed contactor portion 2.

When the gas circuit breaker 1 is in the closed state, the fixed arc contactor 21 is inserted into the movable arc contactor 31 of the movable contactor portion 3. Accordingly, the fixed arc contactor 21 contacts the movable arc contactor 31 of the movable contactor portion 3, and the fixed contactor portion 2 and the movable contactor portion 3 are electrically connected to each other.

On the other hand, when the gas circuit breaker 1 is in the opened state, the fixed arc contactor 21 is separated from the movable arc contactor 31 of the movable contactor portion 3, and bears an arc generated between the fixed contactor portion 2 and the movable contactor portion 3. The arc is not generated between the fixed conductive contactor 22 and the movable conductive contactor 32 of the movable contactor portion 3.

The fixed arc contactor 21 and the movable arc contactor 31 are provided to avoid the generation of arc between the fixed conductive contactor 22 and the movable conductive contactor 32, and to concentrate the arc between the fixed arc contactor 21 and the movable arc contactor 31. Accordingly, the deterioration of the fixed conductive contactor 22 and the movable conductive contactor 32 by the arc can be suppressed.

Note that the arc between the fixed arc contactor 21 and the movable arc contactor 31 is extinguished by spraying the arc-extinguishing gas accumulated in the pressure accumulating chamber 36 formed by the piston 42 and the cylinder 34 of the movable contactor portion 3 via the insulation nozzle 33.

Ventilation Cylinder 24

The ventilation cylinder 24 is a cylindrical member made of conductive metal formed by shaving. The ventilation cylinder 24 has a cylindrical axis thereof aligned with the axis of toe fixed conductive contactor 22, and is arranged on the end of the fixed conductive contactor 22 in the open-end direction. The ventilation cylinder 24 may be formed integrally with the fixed conductive contactor 22.

The diameter of the ventilation cylinder 24 is substantially equal to the outer diameter of the fixed conductive contactor 22. The ventilation cylinder 24 is connected to the power supply line 7*a* via the sealed container 8.

The ventilation cylinder 24 supports the fixed arc contactor 21, the fixed conductive contactor 22, and the exhaust pipe 25. An interior of the ventilation cylinder 24 is a flow path for the arc-extinguishing gas, and guides the arc-extinguishing gas that has been sprayed to the arc and become high temperature from an arc space between the fixed arc contactor 21 and the movable arc contactor 31 to the exhaust pipe 25. A space between the fixed arc contactor 21 and the movable arc contactor 31 where the arc is generated is called the arc space.

Exhaust Pipe 25

The exhaust pipe 25 is a cylindrical member which is made of metal, etc. and which has a bottom at one end and an opening at the other end. The diameter of the opening of the exhaust pipe 25 is larger than the diameter of the end of the ventilation cylinder 24 on the open-end direction side. The exhaust pipe 25 is fixed to the fixed contactor portion 2 by a support (not illustrated), etc. such that the bottom thereof faces the open-end direction and the opening thereof faces the driving-device direction. The exhaust pipe 25 is arranged such that the opening of the exhaust pipe 25 covers the end of the ventilation cylinder 24 on the open-end direction side.

A flow path for exhausting the arc-extinguishing gas is formed between the opening of the exhaust pipe 25 and the end of the ventilation cylinder 24 on the open-end direction side. A flow of the arc-extinguishing gas to be exhausted is changed to the driving-device direction by the exhaust pipe 25, and is exhausted into the sealed container 8 along the ventilation cylinder 24.

Fixed Contactor Portion 4

The fixed contactor portion 4 includes the conductive contactor 41 and the piston 42.

Conductive Contactor 41

The conductive contactor 41 is a ring-shape electrode arranged on an end surface of the fixed contactor portion 4 on an outer circumference portion in the open-end direction. The conductive contactor 41 is formed of a metal conductor formed into a ring-shape bulging toward the inner diameter side by shaving, etc.

The fixed conductive contactor 41 has an inner diameter which is slidable and which has a constant clearance, relative to an outer diameter of the cylinder 34 of the movable contactor portion 3. The fixed conductive contactor 41 is arranged to an end of a support 43, which is formed of cylindrical conductive metal, in the open-end direction. The support 43 is connected to the power supply line 7*b* via the sealed container 8. The support 43 is fixed to the sealed container 8 by an insulation member.

When the gas circuit breaker 1 is in the closed state and in the opened state, the cylinder 34 of the movable contactor portion 3 is inserted into the conductive contactor 41. Accordingly, the conductive contactor 41 contacts the cylinder 34, and the fixed contactor portion 4 and the movable contactor portion 3 are electrically connected to each other. The cylinder 34 of the movable contactor portion 3 slides in the conductive contactor 41. Since the cylinder 34 of the movable contactor portion 3 is made of conductive metal, the electrical connection between the fixed contactor portion 4 and the movable contactor portion 3 is ensured regardless of whether the gas circuit breaker 1 is in the closed state or in the opened state.

Piston 42

The piston 42 is a torus-shaped plate arranged on an end surface of the fixed contactor portion 4 on the open-end direction side. The piston 42 is formed of a metal conductor formed into a torus-shape by shaving, etc.

The piston 42 has an outer diameter slidable with the outer diameter of the cylinder 34 of the movable contactor portion 3. The diameter of a torus-shape hole of the piston 42 is slidable with an outer: diameter of an operation rod 35 forming an inner wall of the cylinder 34 of the movable contactor portion 3.

The piston 42 is fixed to the support 43 by a piston support 42*a* provided on an inner wall surface of the support 43 forming the outer circumference of the fixed contactor portion 4.

The piston 42 forms the pressure accumulating chamber 36 for accumulating the arc-extinguishing gas together with the cylinder 34 of the movable contactor portion 3. When the gas circuit breaker 1 becomes the opened state, the piston 42 compresses the arc-extinguishing gas in the pressure accumulating chamber 36 together with the cylinder 34 of the movable contactor portion 3. The piston 42 ensures the air-tightness of the pressure accumulating chamber 36. Accordingly, the arc-extinguishing gas in the pressure accumulating chamber 36 is pressurized.

The arc between the fixed conductive contactor 22 and the movable conductive contactor 32 is extinguished by spraying the arc-extinguishing gas pressurized in the pressure accumulating chamber 36 via the insulation nozzle 33.

Support 43

The support 43 is a cylindrical conductor having a bottom in one end surface, and the bottom end surface is arranged on the driving-device direction side. The cylinder 34 of the movable contactor portion 3 is inserted into the support 43 from the open-end direction side.

Movable Contactor Portion 3

The movable contactor portion 3 includes the movable arc contactor 31, the movable conductive contactor 32, and the insulation nozzle 33, and the cylinder 34.

Movable Conductive Contactor 32

The movable conductive contactor 32 is a ring-shape electrode arranged on an end surface of the movable contactor portion 3 on an cuter circumference portion in the open-end direction. The movable conductive contactor 32 is formed of a metal conductor formed into a ring shape by shaving, etc.

The movable conductive contactor 32 has an outer diameter which is slidable and which has a constant clearance, relative to an inner diameter of the fixed conductive contactor 22 of the fixed contactor portion 2. The movable conductive contactor 32 is arranged at an end of the cylinder 34, which is formed of cylindrical conductive metal, in the open-end direction.

When the gas circuit breaker 1 is in the closed state, the movable conductive contactor 32 is inserted into the fixed conductive contactor 22 of the fixed contactor portion 2. Accordingly, the movable conductive contactor 32 contacts the fixed conductive contactor 22, and the movable contactor portion 3 and the fixed contactor portion 2 are electrically connected to each other.

On the other hand, when the gas circuit breaker 1 is in the opened state, the movable conductive contactor 32 is separated from the fired conductive contactor 22 of the fixed contactor portion 2, and the movable contactor portion 3 and the fixed contactor portion 2 are electrically disconnected from each other.

The movable conductive contactor 32 is formed integrally with the cylinder 34 formed by the conductor. When the gas circuit breaker 1 is in the closed state and in the opened state, the cylinder 34 is inserted into and contacts the conductive contactor 41 of the fixed contactor portion 4, and the movable contactor portion 3 and the fixed contactor portion 4 are electrically connected to each other. Since the cylinder 34 slides in the conductive contactor 41 of the fixed contactor portion 4, the movable contactor portion 3 and the fixed contactor portion 4 are electrically connected to each other regardless of whether the gas circuit breaker 1 is in the closed state or .in the opened state.

Movable Arc Contactor 31

The movable arc contactor 31 is a cylindrical electrode arranged at an end of the movable contactor portion 3 in the open-end direction along a center axis of the cylinder of the movable contactor portion 3. The movable arc contactor 31 is formed of a metal conductor formed into a hollow cylindrical shape in which one end is rounded by shaving, etc.

The movable arc contactor 31 has an outer diameter which is slidable and which has a constant clearance, relative to an outer diameter of the fixed arc contactor 21 of the fixed contactor portion 2. The movable arc contactor 31 is connected to an inner circumference of the cylinder 34 of the movable contactor portion 3. The movable arc contactor 31 is driven by the driving device 9 via the cylinder 34 and the insulation rod 37, and reciprocates between the fixed contactor portion 2 and the fixed contactor portion 4.

When the gas circuit breaker 1 is in the closed state, the fixed arc contactor 21 of the fixed contactor portion 2 is inserted into the movable arc contactor 31. Accordingly, the movable arc contactor 31 contacts the fixed arc contactor 21 of the fixed contactor portion 2, and the movable contactor portion 3 and the fixed contactor portion 2 are electrically connected to each other.

On the other hand, when the gas circuit breaker 1 becomes the opened state, the movable arc contactor 31 is separated from the fixed arc contactor 21 of the fixed contactor portion 2. Accordingly, the movable arc contactor 31 bears an arc generated between the movable contactor portion 3 and the fixed contactor portion 2. The arc is not generated between the movable conductive contactor 32 and the fixed conductive contactor 22 of the fixed contactor portion 2.

The arc generated when the gas circuit breaker 1 is in the opened state concentrates between the movable arc contactor 31 and the fixed arc contactor 21. The arc can be prevented from being generated between the movable conductive contactor 32 and the fixed conductive contactor 22, reducing the degradation of the movable conductive contactor 32 and the fixed conductive contactor 22. Note that the arc between the movable arc contactor 31 and the fixed arc contactor 21 is extinguished by the arc-extinguishing gas in the pressure accumulating chamber 36 formed by the piston 42 and the cylinder 34 of the movable contactor portion 3.

An opening of an inner space of the movable arc contactor 31 at one end communicates with a space (hereinafter, referred to as the arc space) between the movable arc contactor 31 and the fixed arc contactor 21 where the arc is generated. The inner space of the movable arc contactor 31 forms one of exhaust paths for the arc-extinguishing gas when extinguishing the arc.

The driving device 9 drives and moves the movable arc contactor 31 via the operation rod 35 that is fixed to and supported by the movable arc contactor 31. The operation rod 35 has a cylindrical shape in which an opening is formed at one end on the open-end direction side, a bottom is formed at the other end on the driving-device direction side, and the interior is hollow. The operation rod 35 is arranged on a cylinder having the same diameter as that of the movable arc contactor 31.

Cylinder 34

The cylinder 34 is a cylindrical member formed of a metal conductor and has a bottom at one end and an opening at the other end. The cylinder 34 includes the operation rod 35 forming a cylindrical inner wall. The operation rod 35 is a cylindrical member arranged concentric with the cylinder 34.

The cylinder 34 is connected to and moves together with the operation rod 35, such that the bottom of the cylinder 34 is in the same plane as the end surface of the operation rod 35 on the open-end direction side. An inner diameter of the cylinder 34 is larger than an outer diameter of the operation rod 35, and the cylinder 34 and the operation rod 35 have the common center axis. The bottom of the cylinder 34 is in a disc-shape and expands in a flange-shape from the outer circumferential edge of the tip of the operation rod 35, and a side wall of the cylinder 34 extends in the driving-device direction. The end surface of the support 43 of the fixed contactor portion 4 on the driving-device direction side is open, and the operation rod 35 is inserted into this opening and extends through the support 43.

The cylinder 34 has an outer diameter which is slidable and which has a constant clearance, relative to the inner diameter of the fixed conductive contactor 41.

The cylinder 34 has an inner diameter which is slidable with the outer diameter of the piston 42 of the fixed contactor portion 4. Furthermore, the operation rod 35 forming the inner wall of the cylinder 34 has the outer diameter slidable with the diameter of the torus-shape hole of the piston 42.

The cylinder 34 is arranged between the fixed contactor portion 2 and the fixed contactor portion 4 such that the bottom thereof faces the open-end direction and the opening faces the driving-device direction. The cylinder 34 is arranged to be slidable with the conductive contactor 41 of the fixed contactor portion 4.

Furthermore, the piston 42 is inserted into the cylinder 34, and the pressure accumulating chamber 36 for accumulating the arc-extinguishing gas is formed by the cylinder 34 and the piston 42. When the gas circuit breaker 1 becomes the opened state, the cylinder 34 and the piston 42 compress the arc-extinguishing gas in the pressure accumulating chamber 36. The cylinder 34 and the piston 42 ensure air-tightness of the pressure accumulating chamber 36. Accordingly, the arc-extinguishing gas in the pressure accumulating chamber 36 is pressurized.

A through hole 34*a* is provided in the surface of the cylinder 34 on the open-end direction side. The arc-extinguishing gas pressurized in the pressure accumulating chamber 36 is guided to the arc space via the insulation nozzle 33.

The cylinder 34 is driven by the driving device 9 via the insulation rod 37 connected to the operation rod 35, and reciprocates. The reciprocation by the driving device 9 is performed when the gas circuit breaker 1 becomes the closed state or the opened state.

When the gas circuit breaker 1 is in the closed state and in the opened state, the cylinder 34 is inserted into the conductive contactor 41 of the fixed contactor portion 4. Accordingly, the cylinder 34 contacts the conductive contactor 41, and the movable contactor portion 3 and the fixed contactor portion 4 are electrically connected to each other. The cylinder 34 slides in the conductive contactor 41. Since the cylinder 34 is made of conductive metal, the electrical connection between the movable contactor portion 3 and the fixed contactor portion 4 is ensured regardless of whether the gas circuit breaker 1 is in the closed state or in the opened state.

When the gas circuit, breaker 1 becomes the opened state, the cylinder 34 is driven via the operation rod 35 and the insulation rod 37, and moves in the driving-device direction. Accordingly, the cylinder 34 compresses the arc-extinguishing gas in the pressure accumulating chamber 36 in cooperation with the piston 42. As a result, the arc-extinguishing gas in the pressure accumulating chamber 36 is pressurized.

Note that a communication hole communicating a hollow portion of the operation rod 35 and an inner space of the support 43 is provided in a circumference wall of the operation rod 35. In addition, an exhaust hole communicating the inner space of the support 43 and an outer space thereof is provided in a side wall of the support 43. Therefore, the hollow portion of the operation rod 35, the inner space of the support 43, and the interior of the sealed container 8 are communicated, and form one of exhaust paths for the gas from the arc space.

Insulation Nozzle 33

The insulation nozzle 33 is a cylindrical rectifying member having a throat portion that guides a spray direction of the arc-extinguishing gas pressurized in the pressure accumulating chamber 36. The insulation nozzle 33 is made of a heat-resistant insulating material such as polytetrafluoroethylene.

The insulation nozzle 33 is arranged so that an axis of the cylinder of the insulation nozzle 33 is located on the extension of a cylindrical axis of the cylinder 34 at the end of the cylinder 34 on the open-end direction side.

The insulation nozzle 33 extends along the axis toward the fixed arc contactor 21 side to surround the movable arc contactor 31, and when the insulation nozzle 33 extends beyond the tip of the movable arc contactor 31, the inner diameter thereof narrows to a level slightly larger than the outer diameter of the fixed arc contactor 21, and when the insulation nozzle 33 reaches the throat portion where the inner diameter thereof is the smallest, the inner diameter thereof expands linearly in the open-end direction.

The arc-extinguishing gas is guided to the arc space by the insulation nozzle 33. In addition, the arc-extinguishing gas is concentrated in the arc space by the throat portion of the insulation nozzle 33, and the flow velocity of the arc-extinguishing gas is increased.

When the gas circuit breaker 1 becomes the opened state, the arc-extinguishing gas is compressed and pressurized in the pressure accumulating chamber 36 formed by the cylinder 34 and the piston 42. The arc-extinguishing gas pressurized in the pressure accumulating chamber 36 passes through the through hole 34*a* of the cylinder 34, and is guided to the arc space via the interior of the insulation nozzle 33. As a result, the arc-extinguishing gas is sprayed to the arc generated between the movable arc contactor 31 and the fixed arc contactor 21, and the arc is extinguished.

When the gas circuit breaker 1 becomes the opened state, the arc-extinguishing gas pressurized in the pressure accumulating chamber 36 sequentially passes through the through hole 34*a* provided in the end surface of the cylinder 34 on the open-end direction side, an inner circumferential space of the movable arc contactor 31 inside the insulation nozzle 33, the arc space, the inner space of the insulation nozzle 33 on the open-end direction side, and the ventilation cylinder 24, and is exhausted into the sealed container 8. These spaces in series form one of exhaust paths for the arc-extinguishing gas.

Since the insulation nozzle 33 continues to be exposed to the arc with extremely high temperature by the generation of the arc, an insulating material, such as polytetrafluoroethylene, contained in the insulation nozzle 33 melts and is gasified. As a result, this gas of the molten insulating material enters the pressure accumulating chamber 36 from the inner wall of the insulation nozzle 33, and affects the pressurization in the pressure accumulating chamber 36.

Sealed Container 8

The sealed container 8 is a cylindrical sealed container made of metal, glass, etc., and configured to be filled with the arc-extinguishing gas. The sealed container 8 is formed by joining ends of two hollow truncated cone portions 82 and 83, each having a large opening diameter, via the cylindrical portion 81. The sealed container 8 includes a truncated cone portion 82 having tapered portions 82*a* and 82*b*, and a truncated cone portion 83 having tapered portions 83*a* and 83*b*. The truncated cone portions 82 and 83 are joined via the cylindrical portion 81. The sealed container 8 includes the gas chambers 51*a* and 51*b* inside the cylindrical portion 81 to which the two truncated cone portions 82 and 83 are joined.

The sealed container 8 has the cylindrical portion 81 at a portion where the two truncated cone portions 82 and 83 are joined, and the cylindrical portion 81 has a flat portion 81*a* at the ground plane side and a flat portion 81*b* at the side opposite to the ground plane. The gas chamber 51*a* configured to accumulate unnecessary gas such as ozone with a specific gravity heavier than the arc-extinguishing gas is arranged inside the flat portion 81*a* on the ground plate side in the cylindrical portion 81, and the gas chamber 51*b* configured to accumulate unnecessary gas such as carbon monoxide with a specific gravity lighter than the arc-extinguishing gas is arranged inside the flat portion 81*b* at the side opposite to the ground plane in the cylindrical portion 81.

The interior of the sealed container 8 is filled with the arc-extinguishing gas which mainly contains carbon dioxide ($CO_2$ gas). The arc-extinguishing gas is at 0.1 MPa-g or more, and preferably contains equal to or more than 50% of carbon dioxide.

When the gas circuit breaker 1 becomes the opened state, an arc is generated between the fixed contactor portion 2 and the movable contactor portion 3. This arc is extinguished by spraying arc-extinguishing gas filled in the sealed container 8. The arc-extinguishing gas sprayed to the arc generates unnecessary gas such as ozone and carbon monoxide.

The sealed container 8 includes gas chambers 51*a* and 51*b* configured to accumulate the unnecessary gas generated from the arc-extinguishing gas sprayed to the arc. Note that the gas chambers 51*a* and 51*b* may be collectively referred to as a gas chamber 5.

Gas Chamber 5

The gas chamber 5 is formed by the gas chamber 51*a* and the gas chamber 51*b*. The gas chambers 51*a* and 51*b* are formed of the same material as the sealed container 8. The gas chambers 51*a* and 51*b* accumulate the unnecessary gas generated from the arc-extinguishing gas sprayed to the arc.

The sealed container 8 is formed by joining the ends of two hollow truncated cone portions 82 and 83, with the cylindrical portion 81 therebetween. The portions of the two truncated cone portions 82 and 83, each having a large opening diameter, are joined to the cylindrical portion 81, and this cylindrical portion 81 forms the flat portions 81*a* and 81*b*. The flat portion 81*a* is formed at the ground plane side of the cylindrical portion 81, and the flat portion 81*b* is formed at the side opposite to the ground plane of the cylindrical portion 81.

The gas chambers 51*a* and 51*b* are portions provided inside the flat portions 81*a* and 81*b* of the cylindrical portion 81, respectively. The cylindrical portion 81 having the flat portions 81*a* and 81*b* in which the gas chambers 51*a* and 51*b* are arranged, respectively, and the two truncated cone portions 82 and 83 are integrally formed and ensure the airtightness of the sealed container 8 filled with the arc-extinguishing gas. The gas chambers 51*a* and 51*b* accumulate the unnecessary gas generated from the arc-extinguishing gas sprayed to the arc.

The gas chamber 51*a* is a portion provided inside the flat portion 81*a* of the cylindrical portion 81 at the ground plane side. The gas chamber 51*a* arranged at the ground plane side in the sealed container 8 accumulates the unnecessary gas such as ozone with a specific gravity heavier than the arc-extinguishing gas. It is preferable that the volume of the gas chamber 51*a* is equal to or more than 0.01% of the volume of the sealed container 8.

The gas chamber 51*b* is a portion provided inside the flat portion 81*b* at the side opposite to the ground plane in the cylindrical portion 81. The gas chamber 51*b* arranged at the side opposite to the ground plane in the sealed container 8 accumulates the unnecessary gas such as carbon monoxide with a specific gravity lighter than the arc-extinguishing gas. It is preferable that the volume of the gas chamber 51*a* is equal to or more than 0.01% of the volume of the sealed container 8.

It is preferable that the gas chambers 51*a* and 51*b* are arranged in the sealed container 8, which are on a perpendicular line from the arc space between the fixed arc contactor 21 and the movable arc contactor 31, which is the arc generation space, down to the ground plane.

1-2. Action

Next, the action of the gas circuit breaker of the present embodiment will be described based on FIGS. 1 to 2.

A. A Case Where the Gas Circuit Breaker 1 Is in the Closed State

Firstly, a case where the gas circuit breaker 1 of the present embodiment is in the closed state will be described. When in the closed state, the gas circuit breaker 1 conducts the current flowing in the power supply lines 7*a* and 7*b*.

In the case where the gas circuit breaker 1 is in the closed state, the fixed contactor portion 2 and the fixed contactor portion 4 are electrically connected to each other via the movable contactor portion 3, and the current flows between the power supply lines 7*a* and 7*b*. Specifically, the movable conductive contactor 32 of the movable contactor portion 3 is inserted into the fixed conductive contactor 22 of the fixed contactor portion 2. In this way, the fixed conductive contactor 22 contacts the movable conductive contactor 32, and the fixed contactor portion 2 and the movable contactor portion 3 are brought into an electrically conductive state.

In addition, the movable arc contactor 31 of the movable contactor portion 3 is inserted into the fixed arc contactor 21 of the fixed contactor portion 2. In this way, the fixed arc contactor 21 contacts the movable arc contactor 31, and the fixed contactor portion 2 and the movable contactor portion 3 are brought, into an electrically conductive state.

Furthermore, the cylinder 34 of the movable contactor portion 3 is inserted into the conductive contactor 41 of the fixed contactor portion 4. In this way, the conductive contactor 41 contacts the cylinder 34, and the fixed contactor portion 4 and the movable contactor portion 3 are brought into an electrically conductive state.

Moreover, the cylinder 34, the movable conductive contactor 32, and the movable arc contactor 31 of the movable contactor portion 3 are electrically connected to one another. As a result, the fixed contactor portion 2 and the fixed contactor portion 4 are electrically connected to each other via the movable contactor portion 3, and the power supply lines 7*a* and 7*b* are brought into an electrically conductive state.

In this state, the arc is not generated in the space between the movable arc contactor 31 and the fixed arc contactor 21. In addition, the pressure of the arc-extinguishing gas is uniformly applied to each portion in the sealed container 8. Accordingly, the arc-extinguishing gas in the pressure accumulating chamber 36 formed by the cylinder 34 of the movable contactor portion 3 and the piston 42 of the fixed contactor portion 4 is not pressurized.

When the gas circuit breaker 1 is in the closed state, the pressure of the arc-extinguishing gas in the sealed container 8 is uniform and the temperature of the arc-extinguishing gas is at normal temperature. Accordingly, the unnecessary gas such as ozone and carbon monoxide which is generated when the arc-extinguishing gas is at high temperature is not generated.

B. A Case Where the Gas Circuit Breaker 1 Becomes the Opened State

Next, a case where the gas circuit breaker 1 of the present embodiment becomes the opened state will be described. The gas circuit breaker 1 is in the opened state, and the current flowing through the power supply lines 7*a* and 7*b* is broken.

The breaking operation for opening the gas circuit breaker 1 into the opened state is performed when switching the gas circuit breaker 1 from the conductive state to the breaking state, such as when breaking delayed load current like fault current, leading small current, and reactor breaking action, or when breaking extremely small fault current.

When the gas circuit breaker 1 is switched from the closed state to the opened state, the driving device 9 is driven. The movable contactor portion 3 is moved by the driving device 9 along the axis in the fixed contactor portion 4 in the driving-device direction. In this way, the movable conductive contactor 32 is separated from the fixed conductive contactor 22 and the movable arc contactor 31 is separated from the fired arc contactor 21.

As a result, the arc is generated in the arc space between the fixed arc contactor 21 and the movable arc contactor 31. Since this arc has very high temperature, high temperature gas is generated from the arc, and the arc-extinguishing gas around the arc is heated to become high temperature.

Along with the movement of the movable contactor portion 3, the cylinder 34 moves in the driving-device direction to become close to the piston 42. Accordingly, the pressure accumulating chamber 36 formed by the cylinder 34 and the piston 42 is compressed, and the arc-extinguishing gas in the pressure accumulating chamber 36 is pressurized. Furthermore, when the movable contactor portion 3 is pulled by the driving device 9 and the pressure of the arc-extinguishing gas in the pressure accumulating chamber 36 is increased to become a preset pressure, the arc-extinguishing gas is sprayed from the through hole 34*a* of the pressure accumulating chamber 36.

At current zero-point of AC supplied from the power supply lines 7*a* and 7*b*, the arc between the fixed arc contactor 21 and the movable arc contactor 31 becomes small, and is extinguished by spraying the arc-extinguishing gas. As a result, the gas circuit breaker 1 becomes the opened state, and the current flowing through the power supply lines 7*a* and 7*b* is broken.

As the arc-extinguishing gas, sulfur hexafluoride gas ($SF_6$ gas) having excellent arc extinguishing performance has been conventionally mainly used. However, sulfur hexafluoride gas ($SF_6$ gas) is global warming gas, and in recent years, is demanded to reduce the usage amount thereof.

As gas alternative to sulfur hexafluoride gas ($SF_6$ gas), mixed gas mainly containing carbon dioxide is used. Examples of the gas mixed to carbon dioxide include oxygen, fluorinated ether, and fluorinated ketone. In below, the case of using the arc-extinguishing gas in which oxygen is mixed to carbon dioxide ($CO_2$ gas) will be described.

The interior of the sealed container 8 is filled with the arc-extinguishing gas in which oxygen is mixed to carbon dioxide ($CO_2$ gas). The arc-extinguishing gas is at 0.1 MPa-g or more, and preferably contains equal to or more than 501; of carbon dioxide.

When the gas circuit breaker 1 becomes the opened state, an arc is generated between the fixed contactor portion 2 and the movable contactor portion 3. This arc is extinguished by spraying arc-extinguishing gas filled in the sealed container 8. The arc-extinguishing gas sprayed to the arc generates unnecessary gas such as ozone and carbon monoxide.

The arc generated at the time of current breaking action creates a so-called arc-plasma state between the fixed arc contactor 21 and the movable arc contactor 31. The arc-extinguishing gas in the arc-plasma state becomes high temperature and high pressure and reacts to generate the unnecessary gas.

The arc-extinguishing gas in which oxygen ($O_2$) is mixed to carbon dioxide ($CO_2$ gas) is sprayed to the arc, and causes the reactions indicated below.

A. Initial Reaction $$CO_2+e^- \rightarrow CO+O+e^- \quad \text{(Reaction 1)}$$

$$O_2+e^- \rightarrow O+O \quad \text{(Reaction 2)}$$

B. Intermediate Reaction $$CO_2+O \rightarrow CO+O_2 \quad \text{(Reaction 3)}$$

$$_2+O \rightarrow O_3 \quad \text{(Reaction 4)}$$

C. Termination Reaction $$CO+O \rightarrow CO_2 \quad \text{(Reaction 5)}$$

$$CO_3+O+M \rightarrow O_2+O_2+M \quad \text{(Reaction 6)}$$

$$O_3+\text{thermal} \rightarrow O_2+O \quad \text{(Reaction 7)}$$

$$O+O \rightarrow O_2 \quad \text{(Reaction 8)}$$

In the above reactions, each sign represents the following.

O: oxygen atom $e^-$: electron

CO: carbon monoxide $O_3$: ozone

M: predetermined particles (particle types are not specified)

Furthermore, the reaction speed Rf of each reaction can be represented by the following formula.

$$Rf=kf*[A]*[B] \quad \text{(Formula 1)}$$

In the above formula, each sign represents the following, kf: reaction speed constant

[A]: particle density of particle A for reaction

[B]: particle density of particle B for reaction

In addition, the reaction speed constant kf can be represented by the following formula.

$$\text{Speed constant } kf=A*\exp(-Ea/kBT) \quad \text{(Formula 2)}$$

In the above formula, each sign represents the following.

A: constant for frequency factor peculiar to the reaction

Ea: activation energy kB: Boltzmann constant

T: temperature

Note that the above formula is applied in the case of two body collision as an example.

In the above description, $CO_2$ and $O_2$ are in a stable state. In contrast, $O_3$ is spontaneously dissociated within 24 hours by the above reaction 6, for example, in the normal temperature and atmospheric pressure, and returns to $O_2$.

As indicated in Formula 1, the reaction speed depends on the particle density. For example, regarding CO and O indicated in reaction 3, if CO exists but O atom to react with CO does not exit nearby, the reaction does not proceed and CO continues to exist as it is.

Table 1 indicates the actual measured value of remaining ratio of each particle when a certain time period has elapsed since the completion of the current breaking test using $CO_2$ as the arc-extinguishing gas.

TABLE 1

| Existence Ratio (Actual measurement) of CO and O3 After Current is Broken When an Arc-Extinguishing Medium is CO2 Gas | | | |
|---|---|---|---|
| CO | $O_3$ | $H_2O$ | HF |
| 0.01% | 0.01% | 0.01% | 0.1% |

By the experiment by the inventors, $O_3$ is generated even when the gas in which oxygen ($O_2$) is mixed to carbon dioxide ($CO_2$ gas) is used. In Table 1, very small amount of $H_2O$ is included unintentionally. Hydrogen fluoride HF generated by dissociation and recombination of $H_2O$ in the arc-plasma state is also detected.

The present embodiment is directed to the mixed gas containing 50% or more of carbon dioxide ($CO_2$ gas). Since the mixed gas is sufficiently mixed beforehand, the mixed gas is uniformly distributed and the density distribution is not produced in the sealed container 8. When the plasma state is generated at a certain place in the sealed container 8, the density distribution of the mixed gas according to molecular weight is transitionally produced by the reactions indicated in the reactions 1 to 8.

Thereafter, dispersion by natural convection and concentration distribution occurs, and the concentration distribution, including the unnecessary gas, is uniformed in the sealed container 8. Once uniformed concentration distribution is irreversible based on the law of entropy increase, and the concentration distribution does not become non-uniform again.

Accordingly, when the unnecessary gas is not captured before the concentration distribution is uniformed, the unnecessary gas remains in the sealed container 8 for a long time. Table 2 indicates the molecular weight of relatively stable particles generated by the reactions 1 to 8 in the arc-plasma state.

TABLE 2

| Molecular Weight | |
|---|---|
| CO | 28 |
| $CO_2$ | 44 |
| $O_3$ | 48 |

In a transitional state after the occurrence of the arc-plasma state in the sealed container 8, particles with large molecular weight precipitate in the bottom of the sealed container 8, that is, at the ground plane side, and particles with light weight are floated up to the upper portion of the sealed container 8, that is, at the side opposite to the ground plane. In the present embodiment, ozone which has large molecular weight and is heavy precipitates near the bottom at the ground plane side, and carbon monoxide which has small molecular weight and is light stays near the top at the side opposite to the ground plane.

As a result, the gas chamber 51*a* arranged at the ground plane side in the sealed container 8 accumulates the unnecessary gas such as ozone with a specific gravity heavier than the arc-extinguishing gas. The gas chamber 51*b* arranged at the side opposite to the ground plane in the sealed container 8 accumulates the unnecessary gas such as carbon monoxide with a specific gravity lighter than the arc-extinguishing gas.

Ozone precipitating near the bottom of the sealed container 3 is dissociated and recombined by the reactions 6 and 7, and returns to $O_2$.

The reaction 5 needs to occur for CO staying in the top of the sealed container 8 to return to $CO_2$. However, O hardly exists near the top of the sealed container 8, that is, at the side opposite to the ground plane, where a large amount of CO exists. Therefore, CO near the top does not react and continues to stay.

Ozone ($O_3$) may oxidatively deteriorate sealing material (not illustrated) for sealing gas in the sealed container 8. Furthermore, $O_3$ may reduce an electric insulation characteristic of the gas circuit breaker 1. In addition, $O_3$ is harmful to human.

Carbon monoxide (CO) may reduce an electrical insulation characteristic of the gas circuit breaker 1. Furthermore, CO is harmful to human. It is not preferable for workers to inhale CO in the sealed container 8 at the time of periodic inspection, etc.

The gas chambers 51*a* and 51*b* accumulate the unnecessary gas generated from the arc-extinguishing gas sprayed to the arc. The gas chamber 51*a* arranged at the ground plane side in the sealed container 8 accumulates the unnecessary gas such as ozone with a specific gravity heavier than the arc-extinguishing gas, and the unnecessary gas flowing out to the outside of the gas chamber 51*a* is reduced. The gas chamber 51*b* arranged at the side opposite to the ground plane in the sealed container 8 accumulates the unnecessary gas such as carbon monoxide with a specific gravity lighter than the arc-extinguishing gas, and the unnecessary gas flowing out to the outside of the gas chamber 51*b* is reduced.

By the experiment by the inventors, it is discovered that the arc-extinguishing gas sprayed to the arc generates ozone of about 0.01% of volume of the sealed container 8. The volume of the gas chamber 51*a* is equal to or more than 0.01% of the volume of the sealed container 8, and the gas chamber 51*a* accumulates the unnecessary gas such as ozone with a specific gravity heavier than the arc-extinguishing gas.

By the experiment by the inventors, it is discovered that, the arc-extinguishing gas sprayed to the arc generates carbon monoxide of about 0.01% of volume of the sealed container 8. The volume of the gas chamber 51*b* is equal to or more than 0.01% of the volume of the sealed container S, and the gas chamber 51*b* accumulates the unnecessary gas such as carbon monoxide with a specific gravity lighter than the arc-extinguishing gas.

Out of the unnecessary gas generated from the arc-extinguishing gas sprayed to the arc, unnecessary gas such as ozone with a specific gravity heavier than the arc-extinguishing gas falls to the ground plane side in the sealed container 8. Furthermore, unnecessary gas such as ozone with a specific gravity heavier than the arc-extinguishing gas falls along the tapered portions 82*a* and 83*a* at the ground plane side inside the hollow truncated cone portions 82 and 83 of the sealed container 8, and is accumulated in the gas chamber 51*a*. The gas chamber 51*a* accumulates the unnecessary gas such as ozone with a specific gravity heavier than the arc-extinguishing gas. The volume of the gas chamber 51*a* is preferably equal to or more than 0.01% of the volume of the sealed container 8.

Out of the unnecessary gas generated from the arc-extinguishing gas sprayed to the arc, unnecessary gas such as carbon monoxide with a specific gravity lighter than the arc-extinguishing gas rises to the side opposite to the ground plane in the sealed container 8. Furthermore, unnecessary gas such as carbon monoxide with a specific gravity lighter than the arc-extinguishing gas rises along the tapered portions 82*b* and 83*b* at the side opposite to the ground plane inside the hollow truncated cone portions 82 and 83 of the sealed container 8, and is accumulated in the gas chamber 51*b*. The gas chamber 51*b* accumulates the unnecessary gas such as carbon monoxide with a specific gravity lighter than the arc-extinguishing gas. The volume of the gas chamber 51*b* is preferably equal to or more than 0.01% of the volume of the sealed container 8.

Furthermore, the gas chambers 51*a* and 51*b* are arranged in the sealed container 6, which are on a perpendicular line from the arc space between the fixed arc contactor 21 and the movable arc contactor 31, which is the arc generation space, down to the ground plane, and accumulate the unnecessary gas generated in the arc space before the unnecessary gas is dispersed in the sealed container 8.

1-3. Effect (1) According to the present embodiment, since a gas circuit breaker that includes the sealed container 8 in which the arc-extinguishing gas is enclosed, the first fixed contactor portion 2 fixed to the sealed container 8, the second fixed contactor portion 4 fixed to the sealed container 8, and the movable contactor portion 3 which moves between the first fixed contactor portion 2 and the second fixed contactor portion 4, to conduct and break current between the first fixed contactor portion 2 and the second fixed contactor portion 4 can be provided, in which an arc generated between the fixed arc contactor 21 provided to the first, fixed contactor portion 2 and the movable arc contactor 31 provided to the movable contactor portion 3 at a time of current breaking action is extinguished by spraying the arc-extinguishing gas, the gas circuit breaker includes the gas chamber 5 configured to accumulate the unnecessary gas generated from the arc-extinguishing gas sprayed to the arc, the sealed container 8 is formed by joining ends of the two hollow truncated cone portions 82 and 83, each having a large opening diameter, with the cylindrical portion 81 therebetween, and the gas chamber 5 is formed inside the cylindrical portion 81 forming the sealed container 8, the deterioration in insulation performance and current breaking performance due to the unnecessary gas generated from the arc-extinguishing gas sprayed to the arc can be reduced.

Since the unnecessary gas generated from the arc-extinguishing gas sprayed to the arc is accumulated in the gas chamber 5, making it hard to contact the insulation member, the first fixed contactor portion 2, the second fixed contactor portion A, and the movable contactor portion 3 forming the gas circuit breaker 1, the deterioration in insulation performance and current breaking performance of the gas circuit breaker 1 due to the unnecessary gas generated from the arc-extinguishing gas sprayed to the arc can be reduced.

(2) According to the present embodiment, since the gas chamber 5 is the gas chamber 51*a* arranged at the ground plane side in the sealed container 8 and configured to accumulate the unnecessary gas with a specific gravity heavier than the arc-extinguishing gas, the unnecessary gas such as ozone with a specific gravity heavier than the arc-extinguishing gas is accumulated in the gas chamber 5, the unnecessary gas being generated from the arc-extinguishing gas sprayed to the arc, making it hard to contact the insulation member, the first fixed contactor portion 2, the second fixed contactor portion 4, and the movable contactor portion 3 forming the gas circuit breaker 1, the deterioration in insulation performance and current breaking performance of the gas circuit breaker 1 due to the unnecessary gas can be reduced.

(3) According to the present embodiment, since the gas chamber 5 is the gas chamber 53*b* arranged at the side opposite to the ground plane in the sealed container and configured to accumulate the unnecessary gas with a specific gravity lighter than the arc-extinguishing gas, the unnecessary gas such as carbon monoxide is accumulated in the gas chamber 5, the unnecessary gas being generated from the arc-extinguishing gas sprayed to the arc, making it hard to contact the insulation member, the first fixed contactor portion 2, the second fixed contactor portion 4, and the movable contactor portion 3 forming the gas circuit breaker 1, the deterioration in insulation performance and current breaking performance of the gas circuit breaker 1 due to the unnecessary gas can be reduced.

(4) According to the present embodiment, the gas circuit breaker can be provided in which since the arc-extinguishing gas is at 0.1 MPa-g or more, and contains equal to or more than 50% of carbon dioxide, the arc-extinguishing gas is less harmful to environment, and the deterioration in insulation performance and current breaking performance due to the unnecessary gas generated from the arc-extinguishing gas sprayed to the arc can be reduced.

(5) According to the present embodiment, the gas circuit breaker can be provided in which since a volume of the gas chamber 5 is equal to or more than 0.01% of a volume of the sealed container 8, the gas circuit breaker becomes compact, and the deterioration in insulation performance and current breaking performance due to the unnecessary gas generated from the arc-extinguishing gas sprayed to the arc can be reduced.

(6) According to the present embodiment, since the sealed container 8 includes the truncated cone portions 82 and 83, and the gas chamber 5 is formed inside the flat portions 81*a* and 81*b* of the cylindrical portion 81 to which two truncated cone portions 82 and 83 of the sealed container 8 each forming hollow truncated cone are joined, the unnecessary gas is guided to the gas chamber 5 by the tapered portions 82*a*, 82*b*, 83*a*, and 83*b* forming the truncated cone portions 82 and 83 of the sealed container 3, and the unnecessary gas is guided to the gas chamber 5 and the unnecessary gas can be accumulated in the gas chamber 5 more surely.

(7) According to the present embodiment, since the sealed container 8 is formed by joining ends of the two truncated cone portions 82 and 83, each having a large opening diameter, and the gas chamber 5 is formed inside the cylindrical portion 81 to which the two truncated cone portions 82 and 83 forming the sealed container 8 are joined, the gas chamber 5 can be arranged near the place where the arc-extinguishing gas is sprayed to the arc. As a result, the unnecessary gas can be guided to the gas chamber 5 more surely, and the unnecessary gas can be accumulated in the gas chamber 5.

Furthermore, the sealed container 8 is formed by joining the ends of the two truncated cone portions 32 and 33, each having a large opening diameter, with the cylindrical portion 81 therebetween, and the members of the two truncated cone portions 82 and 83 forming the sealed container 8 can be manufactured by the same manufacturing process, and are easy to manufacture. Therefore, the gas circuit breaker that can be easily manufactured can be provided.

1-4. Modified Example (1) First Modified Example

Figure 3:
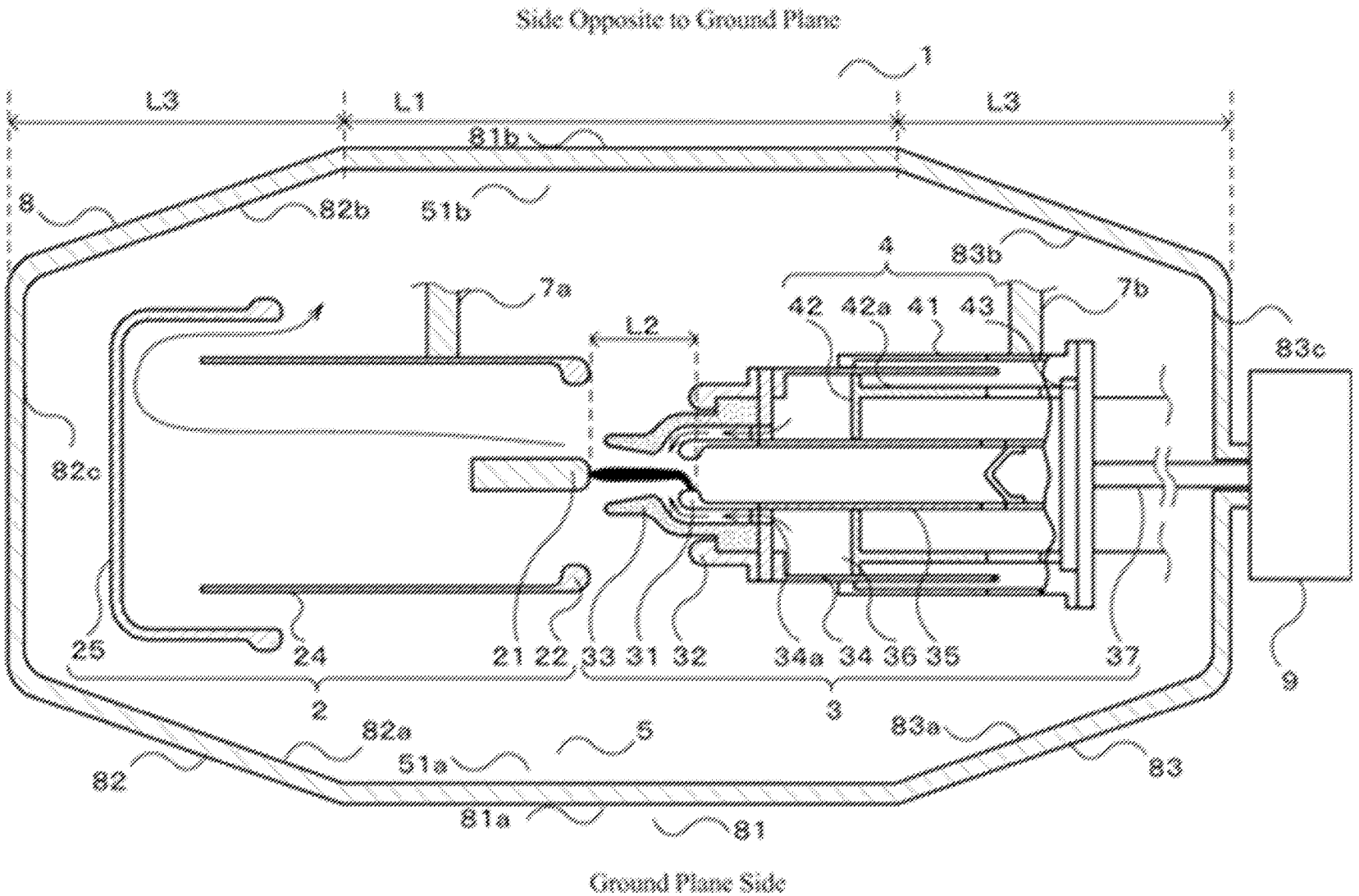
FIG. 3 is a diagram illustrating a configuration of a gas circuit breaker according to a first modified example of the first embodiment.

The sealed container 8 is not limited to the above-described configuration, the sealed container 8 may be formed as illustrated in FIG. 3.

The sealed container 8 is formed by joining the ends of the two hollow truncated cone portions 82 and 83, each having a large opening diameter, with the cylindrical portion 81 therebetween, and a height L1 of the cylindrical portion 81 is equal to or more than a length L2 of the arc generated between the fixed arc contactor 21 and the movable arc contactor 31 at the time of current breaking action. The gas chamber 5 is formed inside the cylindrical portion 81 of the sealed container 8.

The gas chambers 51*a* and 51*b* are formed in portions inside the cylindrical portion 81 including a perpendicular line from an end of the generated arc on the fixed arc contactor 21 side down to the ground plane and a perpendicular line from an end of the generated arc on the movable arc contactor 31 side down to the ground plane.

The height L1 of the cylindrical portion 81 is equal to or more than the length L2 of the arc generated between the fixed arc contactor 21 and the movable arc contactor 31 at the time of current breaking action, and accordingly, the volume of the gas chamber 5 can be further increased. This enables the unnecessary gas to be accumulated in the gas chamber 5 more surely even when the unnecessary gas generated from the arc is dispersed.

In the gas chamber 51*a* provided inside the flat portion 81*a* at the ground plane side in the cylindrical portion 81, the unnecessary gas such as ozone with a specific gravity heavier than the arc-extinguishing gas can be accumulated more surely. In the gas chamber 51*b* provided inside the flat portion 81*b* at the side opposite to the ground plane in the cylindrical portion 81, the unnecessary gas such as carbon monoxide with a specific gravity lighter than the arc-extinguishing gas can be accumulated more surely.

The gas circuit breaker 1 can be provided in which since the height L1 of the cylindrical portion 81 is equal to or more than the length of the arc generated between the fixed arc contactor 21 and the movable arc contactor 31 at the time of current breaking action, the unnecessary gas can be accumulated in the gas chamber 5 more surely.

The sealed container 8 is formed by joining the ends of the two hollow truncated cone portions 82 and 83, each having a large opening diameter, with the cylindrical portion 81 therebetween, so that the height of the cylindrical portion 81 may be equal to or more than a height L3 of the truncated cone portion 82 or the truncated cone portion 83. The gas chamber 5 is formed inside the cylindrical portion 81 of the sealed container 8.

Since the height L1 of the cylindrical portion 81 is equal to or more than the height L3 of each of the truncated cone portions 82 and 83 forming the sealed container 8, the height L3 of each of the truncated cone portions 82 and 83 can be shortened, and the truncated cone portions 82 and 83 can be easily formed. Therefore, the gas circuit breaker 1 that, can be easily manufactured can be provided. Furthermore, since the height L3 of each of the truncated cone portions 82 and 83 can be shortened, a bottom 82*c* arranged at an end of the truncated cone portion 82, having a small opening diameter, can be formed integrally with the tapered portions 82*a* and 82*b*, and a bottom 83*c* arranged at an end of the truncated cone portion 83, having a small opening diameter, can be formed integrally with the tapered portions 83*a* and 83*b*. Therefore, the gas circuit breaker 1 can be provided which is capable of achieving higher air-tightness with respect to the arc-extinguishing gas.

(2) Second Modified Example

The gas chamber 5 is not limited to the above-described configuration. The gas chamber 5 may be formed as illustrated in FIG. 4.

In the above-described embodiment, the sealed container 8 is formed by joining the ends of the two truncated cone portions 82 and 83, each having a large opening diameter, with the cylindrical portion 81 therebetween, and includes the gas chambers 51*a* and 51*b* inside the cylindrical portion 81 to which the two truncated cone portions 82 and 83 are joined. However, the gas chambers 51*a* and 51*b* are not limited to the above-described configuration.

Figure 4:
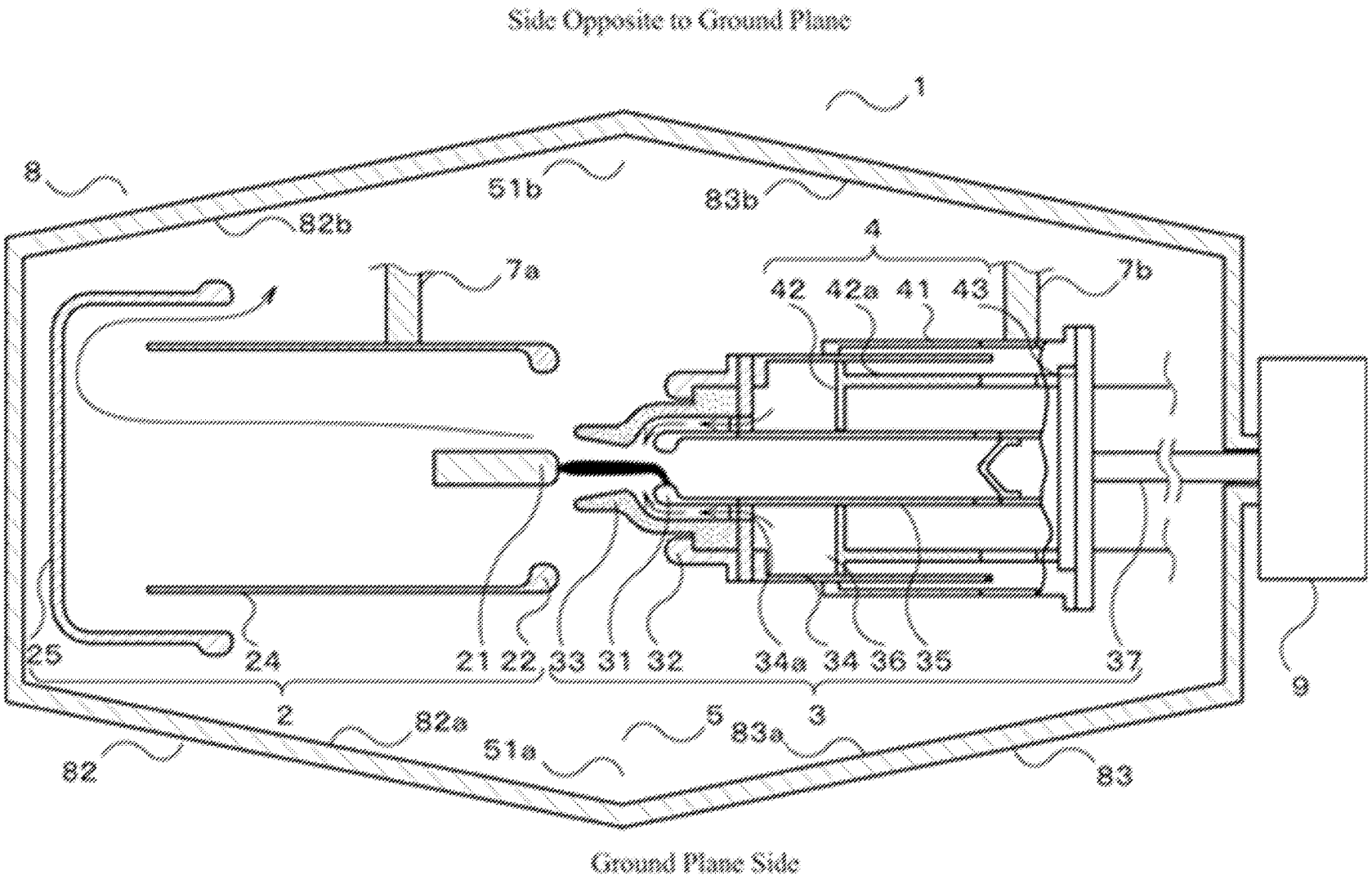
FIG. 4 is a diagram illustrating a configuration of a gas circuit breaker according to a second modified example of the first embodiment.

As illustrated in FIG. 4, the sealed container 8 is formed by directly joining the ends of the two hollow truncated cone portions 82 and 83, each having a large opening diameter, so that the gas chambers 51*a* and 51*b* may be formed inside the portion to which the two truncated cone portions 82 and 83 are joined.

In the sealed container 8, the gas chambers 51*a* and 51*b* are arranged inside the portion to which the ends of the two truncated cone portions 82 and 83 are joined, each end having a large opening diameter.

The gas chamber 51*a* is formed inside the joined portion of the truncated cone portions 82 and 83 at the ground plane side in the sealed container 8. The gas chamber 51*b* is formed inside the joined portion of the truncated cones at the side opposite to the ground plane in the sealed container 8.

The gas chamber 51*a*accumulates the unnecessary gas such as ozone with a specific gravity heavier than the arc-extinguishing gas, the unnecessary gas being generated from the arc-extinguishing gas sprayed to the arc. The gas chamber 51*a* accumulates the unnecessary gas such as carbon monoxide with a specific gravity lighter than the arc-extinguishing gas, the unnecessary gas being generated from the arc-extinguishing gas sprayed to the arc.

The sealed container 8 is formed by joining the ends of the two hollow truncated cones, each having a large opening diameter, and the members of the two truncated cones forming the sealed container 8 can be manufactured by the same manufacturing process, and are easy to manufacture. Therefore, the gas circuit breaker that can be easily manufactured can be provided.

(3) Third Modified Example

The gas chamber 5 is not limited to the above-described configuration. The gas chamber 5 may be formed as illustrated in FIG. 5.

Figure 5:
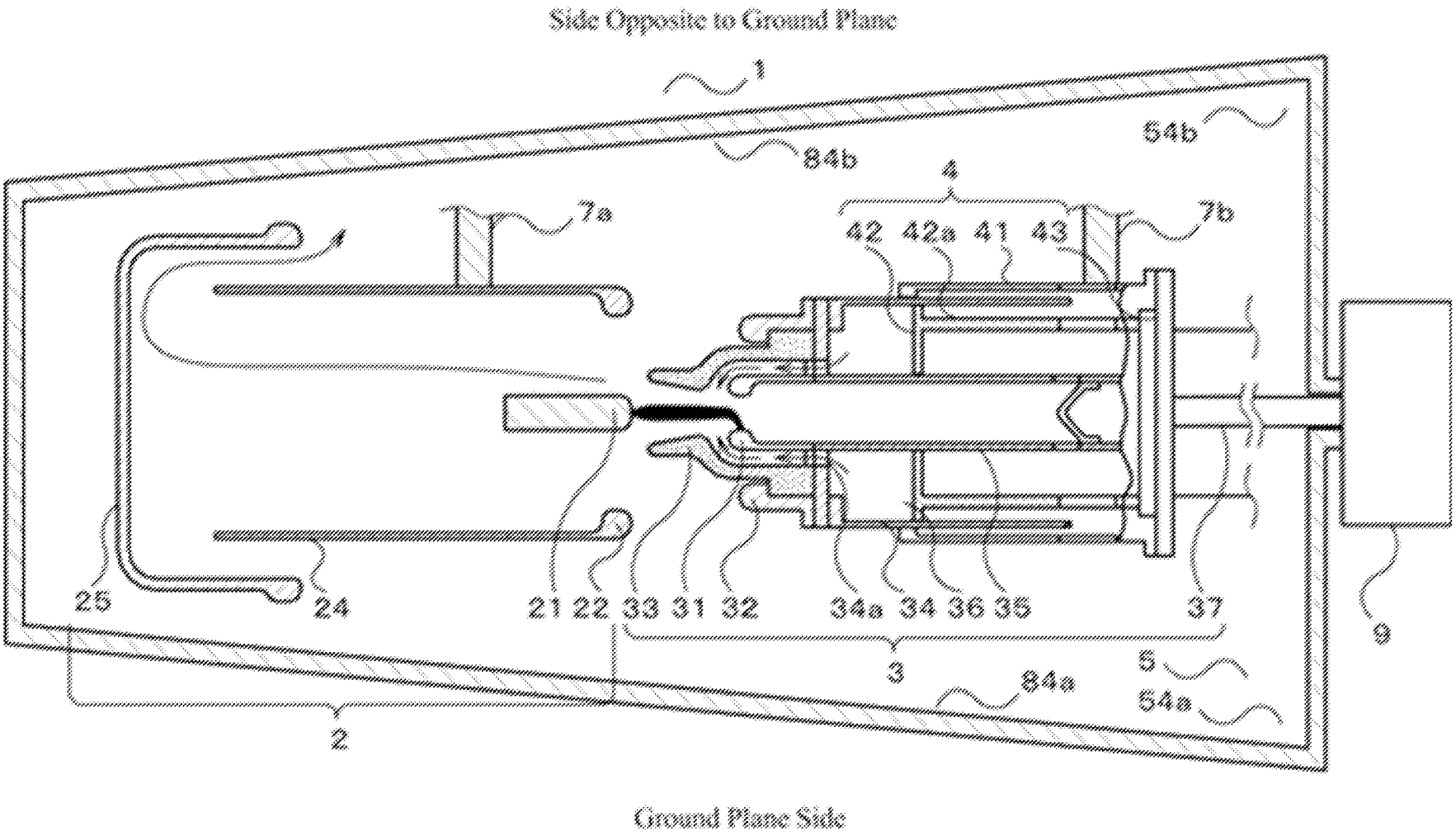
FIG. 5 is a diagram illustrating a configuration of a gas circuit breaker according to a third modified example of the first embodiment.

As illustrated in FIG. 5, the sealed container 8 is formed into a hollow truncated cone shape, and includes gas chambers 54*a* and 54*b* configured to accumulate the unnecessary gas generated from the arc-extinguishing gas sprayed to the arc inside the end of a truncated cone, having a large opening diameter.

As illustrated in FIG. 5, the sealed container 8 is formed into a hollow truncated cone shape with the bottom. The sealed container 8 is arranged such that the bottom of the hollow truncated cone having a large diameter faces the driving-device direction. The sealed container 8 includes the gas chambers 54*a* and 54*b* inside the hollow truncated cone at the bottom side having the large diameter In the sealed container 8, the gas chamber 54*a* is formed inside the bottom of the hollow truncated cone having the large diameter at the ground plane side. In the sealed container 8, the gas chamber 54*b*is formed inside the bottom of the hollow truncated cone having the large diameter at the side opposite to the ground plane. The gas chambers 54*a* and 54*b* accumulate the unnecessary gas generated from the arc-extinguishing gas sprayed to the arc.

Out of the unnecessary gas generated from the arc-extinguishing gas sprayed to the arc, unnecessary gas such as ozone with a specific gravity heavier than the arc-extinguishing gas fails to the ground plane side in the sealed container 8. Furthermore, unnecessary gas such as ozone with a specific gravity heavier than the arc-extinguishing gas falls along a tapered portions 84*a* at the ground plane side inside the hollow truncated cone of the sealed container 8, and is accumulated in the gas chamber 54*a*. The gas chamber 54*a* accumulates the unnecessary gas such as ozone with a specific gravity heavier than the arc-extinguishing gas. The volume of the gas chamber 54*a* is preferably equal to or more than 0.01% of the volume of the sealed container 8.

Out of the unnecessary gas generated from the arc-extinguishing gas sprayed to the arc, unnecessary gas such as carbon monoxide with a specific gravity lighter than the arc-extinguishing gas rises to the side opposite to the ground plane in the sealed container 8. Furthermore, unnecessary gas such as carbon monoxide with a specific gravity lighter than the arc-extinguishing gas rises along a tapered portion 84*b* at the side opposite to the ground plane inside the hollow truncated cone of the sealed container 8, and is accumulated in the gas chamber 54*b*. The gas chamber 54*b* accumulates the unnecessary gas such as carbon monoxide with a specific gravity lighter than the arc-extinguishing gas. The volume of the gas chamber 54*b* is preferably equal to or more than 0.01% of the volume of the sealed container 8.

According to the embodiment according to the third modified example, the gas circuit breaker can be provided which includes the gas chambers 54*a* and 54*b* configured to accumulate the unnecessary gas generated from the arc-extinguishing gas sprayed to the arc, and accordingly, the deterioration in insulation performance and current breaking performance due to the unnecessary gas generated from the arc-extinguishing gas sprayed to the arc can be reduced.

Since the unnecessary gas generated from the arc-extinguishing gas sprayed to the arc is accumulated in the gas chambers 54*a* and 54*b*, making it hard to contact the insulation member, the first fixed contactor portion 2, the second fixed contactor portion 4, and the movable contactor, portion 3 forming the gas circuit breaker 1, the deterioration in insulation performance and current breaking performance of the gas circuit breaker 1 due to the unnecessary gas generated from the arc-extinguishing gas sprayed to the arc can be reduced.

According to the embodiment according to the third modified example, since the sealed container 8 is formed into the truncated cone shape, and the gas chambers 54*a* and 54*b* are formed inside the sealed container 8 forming the hollow truncated cone at the bottom side having the large diameter, the unnecessary gas can be guided to the gas chambers 54*a* and 54*b* by the tapered portions 84*a* and 84*b* forming the truncated cone of the sealed container 8, so that the unnecessary gas can be accumulated in the gas chamber 5 more surely.

According to the embodiment according to the third modified example, the sealed container 3 can be formed in a simpler shape, and the gas circuit breaker that can be easily manufactured can be provided.

Figure 6:
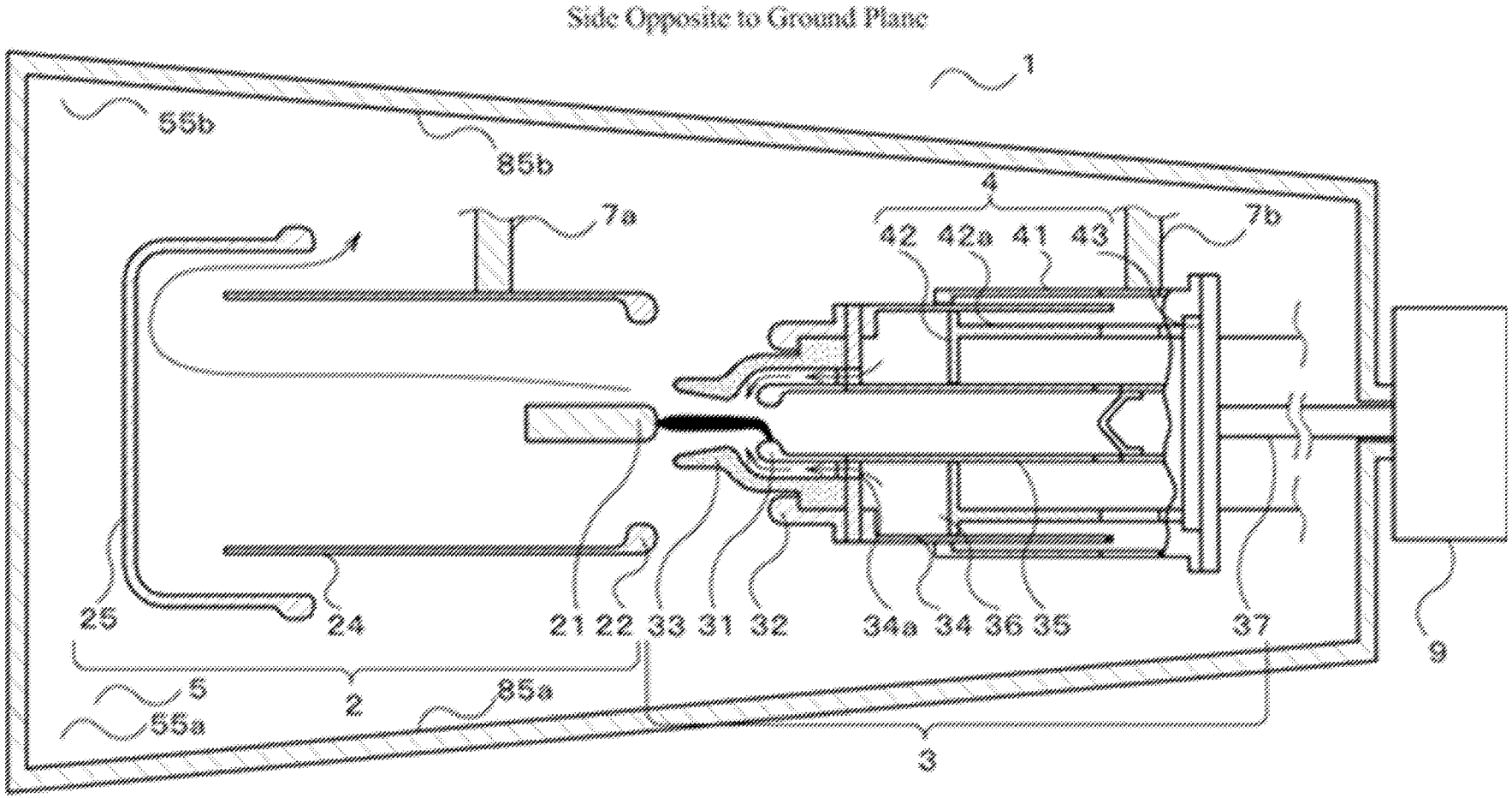
FIG. 6 is a diagram illustrating a configuration of a gas circuit breaker according to another form of the third modified example of the first embodiment.

In the embodiment according to the third modified example, although the sealed container 8 is arranged so that the bottom of the hollow truncated cone having the large diameter faces the driving-device direction, and the gas chambers 54*a* and 54*b* are arranged inside the hollow truncated cone at the bottom side having the large diameter, the sealed container 8 may be arranged so that the bottom of the hollow truncated cone having the large diameter faces the open-end direction, and gas chambers 55*a* and 55*b* may be arranged inside the hollow truncated cone on the bottom side having the large diameter, as illustrated in FIG. 6. The sealed container 8 includes tapered portions 85*a* and 85*b*, and the unnecessary gas is guided by the tapered portions 85*a* and 85*b*, and is accumulated in the gas chamber 5.

When the sealed container 8 forming the hollow truncated cone is thus arranged so that the bottom having the large diameter faces the open-end direction, the installation location of the gas circuit breaker 1 can be selected flexibly.

(4) Fourth Modified Example

The gas chamber 5 is not limited to the above-described configuration. The gas chamber 5 may be formed as illustrated in FIGS. 7 to 8.

Figure 7:
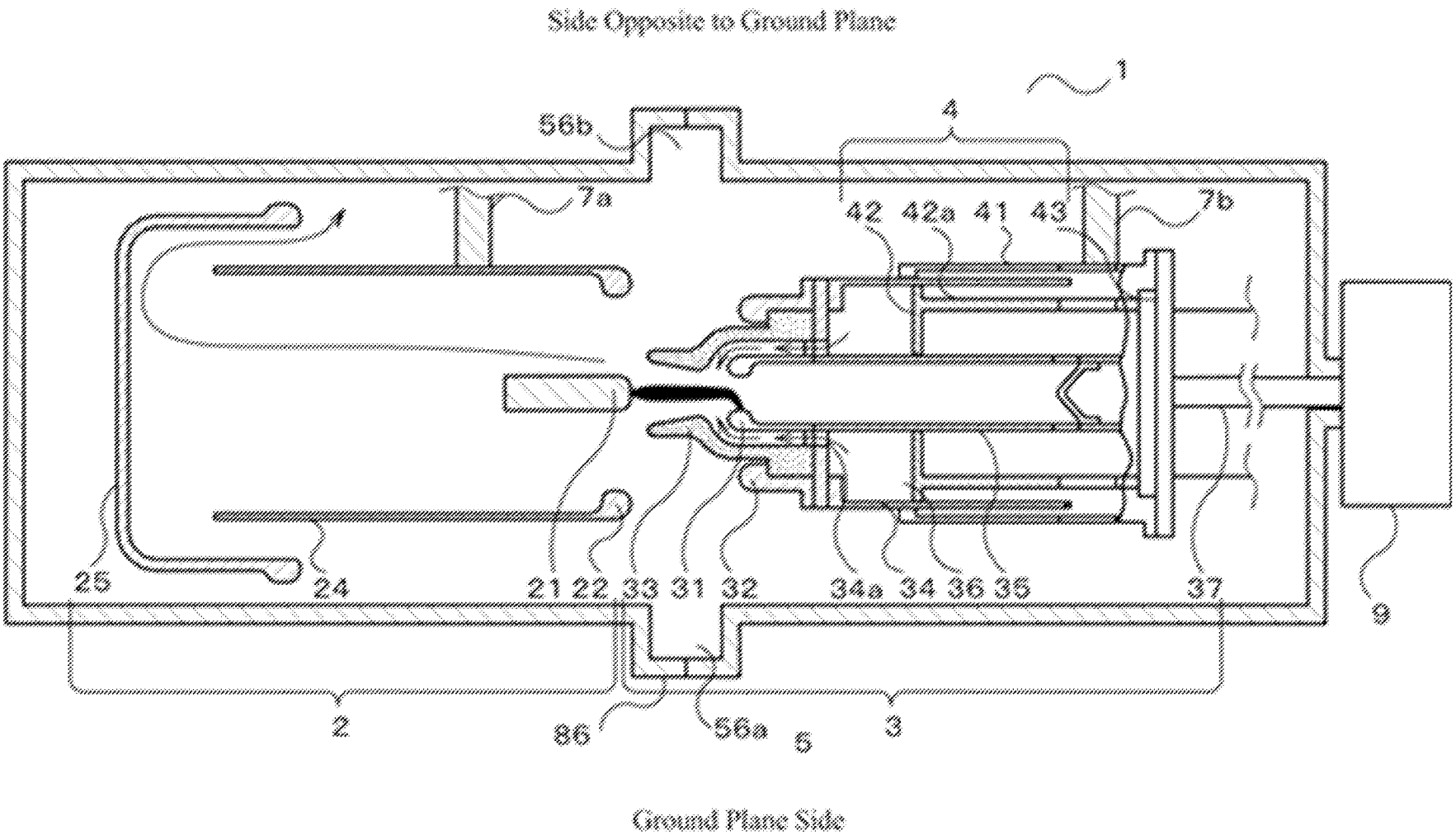
FIG. 7 is a diagram illustrating a configuration of a gas circuit breaker according to a fourth modified example of the first embodiment.
Figure 8:
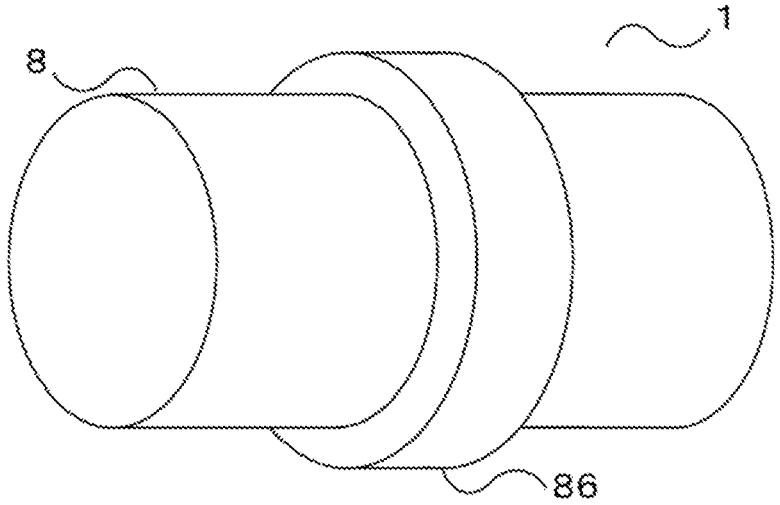
FIG. 8 is a diagram illustrating a configuration of an appearance of the gas circuit breaker according to the fourth modified example of the first embodiment.

As illustrated in FIGS. 7 to 8, the sealed container 8 further induces a cylindrical portion 86 having an inner diameter larger than the inner diameter of the sealed container 8 at a middle portion of the circumference of the cylindrical member forming the sealed container 8. The sealed container 8 includes the gas chambers 56*a* and 56*b* inside the cylindrical portion 86. The gas chambers 56*a* and 56*b* accumulate the unnecessary gas generated from the arc-extinguishing gas sprayed to the arc.

The cylindrical portion 86 which has the inner diameter larger than the inner diameter of the sealed container 8 and which is arranged at the middle portion of the circumference of the cylindrical member forming the sealed container 8 is formed into a hollow tire-shape, and has a space which has a U-shape in a cross-section from the cylinder axis in the cylinder circumference direction. The gas chamber 56*a* is provided in the space, which has a U-shape, of the cylindrical portion 86 at the ground plane side. The gas chamber 56*b* is provided in the space, which has a U-shape, of the cylindrical portion 86 at the side opposite to the ground plane.

The gas chambers 56*a* and 56*b* are made of the same materials as the sealed container 8. The cylindrical portion 86 including the gas chambers 56*a* and 56*b* is joined integrally with the sealed container 8, and ensures air-tightness with respect to the arc-extinguishing gas.

The gas chamber 56*a* accumulates the unnecessary gas such as ozone with a specific gravity heavier than the arc-extinguishing gas. The volume of the gas chamber 56*a* is preferably equal to or more than 0.01% of the volume of the sealed container 8. The gas chamber 56*b* accumulates the unnecessary gas such as carbon monoxide with a specific gravity lighter than the arc-extinguishing gas. The volume of the gas chamber 56*b* is preferably equal to or more than 0.01% of the volume of the sealed container 8.

It is preferable that the gas chambers 56*a* and 56*b* are arranged in the sealed container 8, which are on a perpendicular line from the arc space between the fixed arc contactor 21 and the movable arc contactor 31, which is the arc generation space, down to the ground plane.

The gas chambers 56*a* and 56*b* accumulate the unnecessary gas generated from the arc-extinguishing gas sprayed to the arc. The gas chamber 56*a* arranged at the ground plane side in the sealed container 8 accumulates the unnecessary gas such as ozone with a specific gravity heavier than the arc-extinguishing gas, and the unnecessary gas flowing out to the outside of the gas chamber 56*a* is reduced. The gas chamber 56*b* arranged at the side opposite to the ground plane in the sealed container 8 accumulates the unnecessary gas such as carbon monoxide with a specific gravity lighter than the arc-extinguishing gas, and the unnecessary gas flowing out to the outside of the gas chamber 56*b* is reduced.

According to the embodiment according to the fourth modified example, the gas circuit breaker can be provided which includes the gas chambers 56*a* and 56*b* configured to accumulate the unnecessary gas generated from the arc-extinguishing gas sprayed to the arc, and accordingly, the deterioration in insulation performance and current breaking performance due to the unnecessary gas generated from the arc-extinguishing gas sprayed to the arc can be reduced.

Since the unnecessary gas generated from the arc-extinguishing gas sprayed to the arc is accumulated in the gas chambers 56*a* and 56*b*, making it hard to contact the insulation member, the first fixed contactor portion 2, the second fixed contactor portion 4, and the movable contactor portion 3 forming the gas circuit breaker 1, the deterioration in insulation performance and current breaking performance of the gas circuit breaker 1 due to the unnecessary gas generated from the arc-extinguishing gas sprayed to the arc can be reduced.

According to the embodiment, according to the fourth modified example, since the unnecessary gas such as ozone with a specific gravity heavier than the arc-extinguishing gas, the unnecessary gas being generated from the arc-extinguishing gas sprayed to the arc, is accumulated in the gas chamber 56*a*, and the unnecessary gas such as carbon monoxide with a specific gravity lighter than the arc-extinguishing gas, the unnecessary gas being generated from the arc-extinguishing gas sprayed to the arc, is accumulated in the gas chamber 56*b*, making it hard to contact the insulation member, the first fixed contactor portion 2, the second fixed contactor portion 4, and the movable contactor portion 3 forming the gas circuit breaker 1, the deterioration in insulation performance and current breaking performance of the gas circuit breaker 1 due to the unnecessary gas can be reduced.

According to the embodiment according to the fourth modified example, since the sealed container 8 is formed into a cylindrical shape, and the gas chambers 56*a* and 56*b* are provided on the cylinder circumference of the sealed container 8, and formed inside the tire-shaped cylindrical portion 86 having the inner diameter larger than the inner diameter of the sealed container 8, the volume of the sealed container 8 can be reduced. As a result, a compact gas circuit breaker that is easy to install in small installation location can be provided.

In the embodiment according to the fourth modified example, although the cylindrical portion 36 including the gas chambers 56*a* and 56*b* is arranged at the middle portion of the cylinder of the sealed container 8, the location where the cylindrical portion 86 is arranged is not limited thereto. The cylindrical portion 86 including the gas chambers 56*a* and 56*b* may be arranged to the end of the cylinder side surface of the sealed container 8.

When the cylindrical portion 86 including the gas chambers 56*a* and 56*b* is thus arranged, the installation location of the gas circuit breaker 1 can be selected flexibly.

(5) Fifth Modified Example

The gas chamber 5 is not limited to the above-described configuration. The gas chamber 5 may be formed as illustrated in FIGS. 9 to 10.

Figure 9:
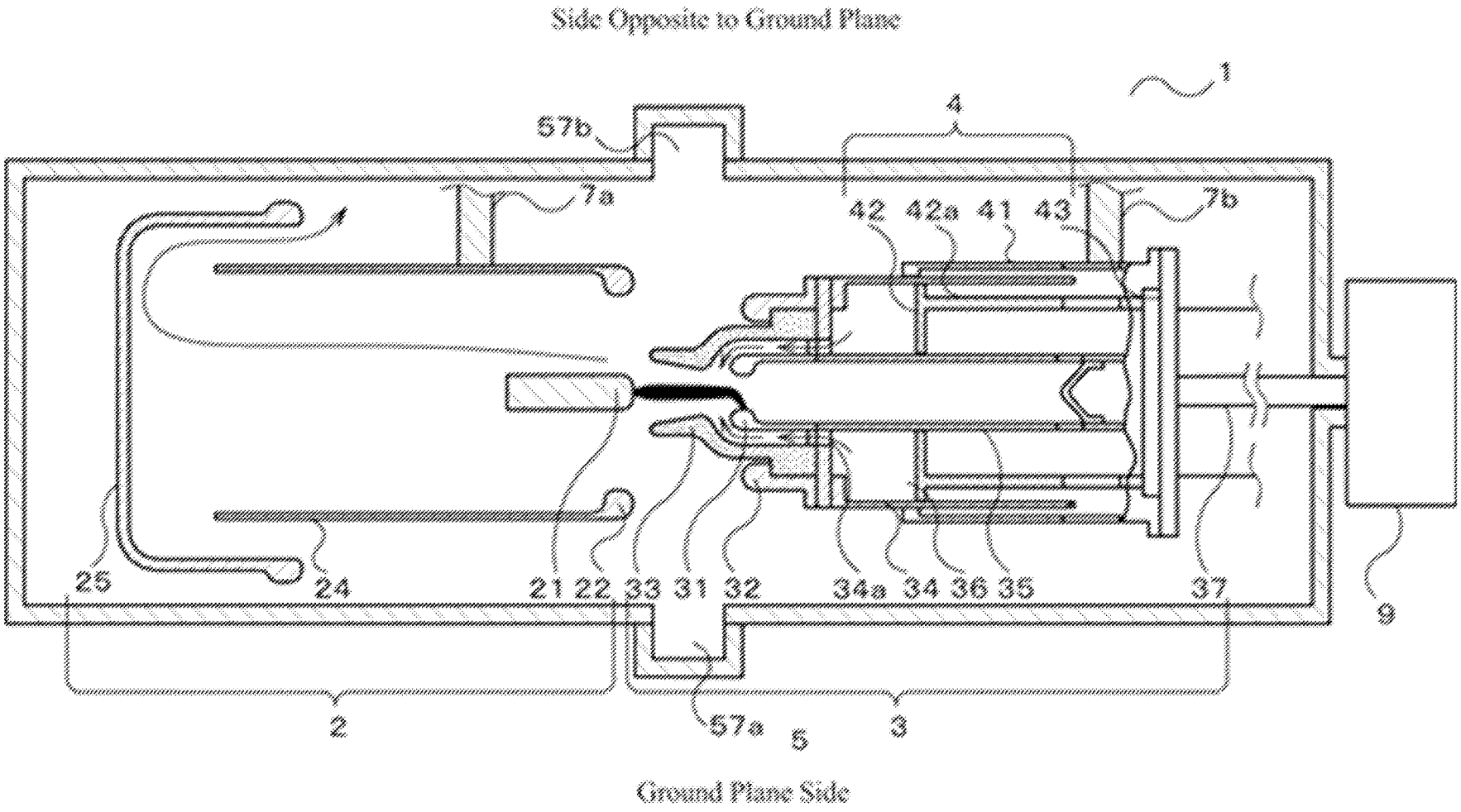
FIG. 9 is a diagram illustrating a configuration of a gas circuit breaker according to a fifth modified example of the first embodiment.
Figure 10:
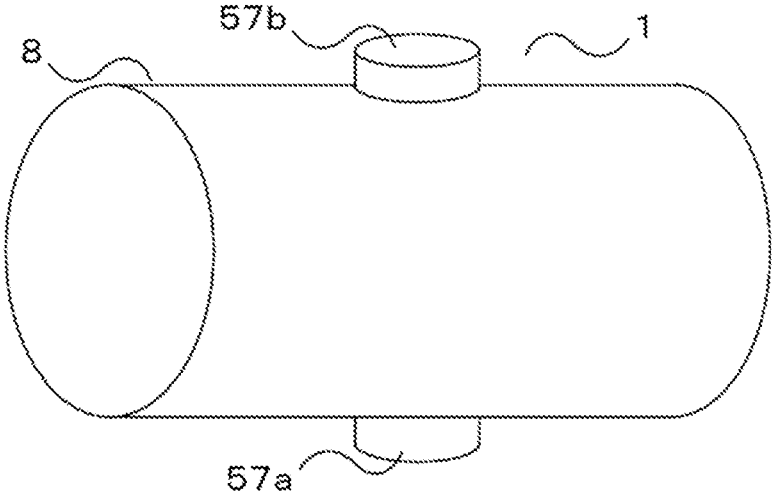
FIG. 10 is a diagram illustrating a configuration of an appearance of the gas circuit breaker according to the fifth modified example of the first embodiment.

As illustrated in FIGS. 9 to 10, the sealed container 8 has gas chambers 57*a* and 57*b* each formed of a cup-shaped member protruding from the circumference of the cylindrical member forming the sealed container 8. The gas chambers 57*a* and 57*b* are made of the same materials as the sealed container 8. The gas chambers 57*a* and 57*b* accumulate the unnecessary gas generated from the arc-extinguishing gas sprayed to the arc.

The gas chamber 57*a*is formed of a cup-shaped member arranged to protrude outward from the sealed container 8 at the ground plane side. The opening of the cup-shape of the gas chamber 57*a* is joined with an inner surface of the sealed container 8. The gas chamber 57*a* is joined integrally with the sealed container 8, and ensures the air-tightness of the sealed container 8 filled with the arc-extinguishing gas. The gas chamber 57*a* accumulates the unnecessary gas such as ozone with a specific gravity heavier than the arc-extinguishing gas. The volume of the gas chamber 57*a* is preferably equal to or more than 0.01%, of the volume of the sealed container 8.

The gas chamber 57*b* is formed of a cup-shaped member arranged to protrude outward from the sealed container 8 at the side opposite to the ground plane. The opening of the cup-shape of the gas chamber 57*b* is joined with the inner surface of the sealed container 8. The gas chamber 57*b* is joined integrally with the sealed container 8, and ensures the air-tightness of the sealed container 8 filled with the arc-extinguishing gas. The gas chamber 57*b* accumulates the unnecessary gas such as carbon monoxide with a specific gravity lighter than the arc-extinguishing gas. The volume of the gas chamber 57*b* is preferably equal to or more than 0.01% of the volume of the sealed container 8.

It is preferable that the gas chambers 57*a* and 57*b* are arranged in the sealed container 8, which are on a perpendicular line from the arc space between the fixed arc contactor 21 and the movable arc contactor 31, which is the arc generation space, down to the ground plane.

The gas chambers 57*a* and 57*b* accumulate the unnecessary gas generated from the arc-extinguishing gas sprayed to the arc. The gas chamber 57*a* arranged at the ground plane side in the sealed container 8 accumulates the unnecessary gas such as ozone with a specific gravity heavier than the arc-extinguishing gas, and the unnecessary gas flowing out to the outside of the gas chamber 57*a* is reduced. The gas chamber 57*b* arranged at the side opposite to the ground plane in the scaled container 8 accumulates the unnecessary gas such as carbon monoxide with a specific gravity lighter than the arc-extinguishing gas, and the unnecessary gas flowing out to the outside of the gas chamber 57*b* is reduced.

According to the embodiment according to the fifth modified example, the gas circuit breaker can be provided which includes the gas chambers 57*a* and 57*b* configured to accumulate the unnecessary gas generated from the arc-extinguishing gas sprayed to the arc, and accordingly, the deterioration in insulation performance and current breaking performance due to the unnecessary gas generated from the arc-extinguishing gas sprayed to the arc can be reduced.

Since the unnecessary gas generated from the arc-extinguishing gas sprayed to the arc is accumulated in the gas chambers 57*a* and 57*b*, making it hard to contact the insulation member, the first fixed contactor portion 2, the second fixed contactor portion 4, and the movable contactor portion 3 forming the gas circuit breaker 1, the deterioration in insulation performance and current breaking performance of the gas circuit breaker 1 due to the unnecessary gas generated from the arc-extinguishing gas sprayed to the arc can be reduced.

According to the embodiment according to the fifth modified example, since the unnecessary gas such as ozone with a specific gravity heavier than the arc-extinguishing gas, the unnecessary gas being generated from the arc-extinguishing gas sprayed to the arc, is accumulated in the gas chamber 57*a*, and the unnecessary gas such as carbon monoxide with a specific gravity lighter than the arc-extinguishing gas, the unnecessary gas being generated from the arc-extinguishing gas sprayed to the arc, is accumulated in the gas chamber 57*b*, making it hard to contact the insulation member, the first fixed contactor portion 2, the second fixed contactor portion 4, and the movable contactor portion 3 forming the gas circuit breaker 1, the deterioration in insulation performance and current breaking performance of the gas circuit breaker 1 due to the unnecessary gas can be reduced.

According to the embodiment according to the fifth modified example, since the gas chambers 57*a* and 57*b* each are formed of the cup-shaped member protruding from the sealed container 8, the volume of the sealed container 8 can be reduced. As a result, a compact gas circuit breaker that is easy to install in small installation location can be provided.

According to the embodiment according to the fifth modified example, since the gas chambers 57*a* and 57*b* each are formed of the cup-shaped member protruding from the sealed container 8, the gas chambers 57*a* and 57*b* can be formed of simple members, and the gas circuit breaker that can be easily manufactured can be provided.

In the embodiment according to the fifth modified example, although the gas chambers 57*a* and 57*b* each are formed of a cup-shaped member protruding from the circumference of the cylindrical member forming the sealed container 8, the installation locations of the gas chambers 57*a* and 57*b* are not limited thereto. The gas chambers 57*a* and 57*b* may be arranged as illustrated in FIG. 11.

Figure 11:
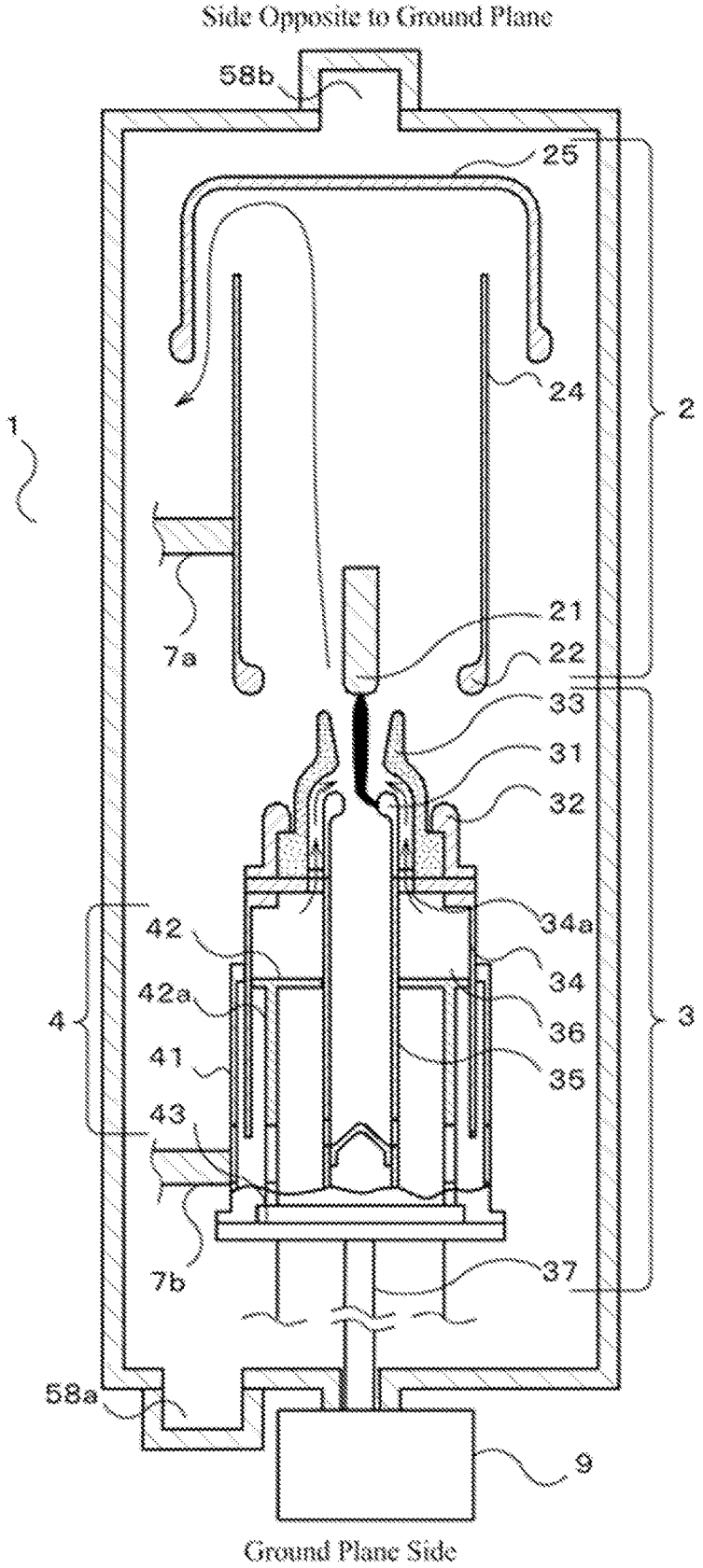
FIG. 11 is a diagram illustrating a configuration of a gas circuit breaker according to another form of the fifth modified example of the first embodiment.

In the gas circuit breaker 1 illustrated in FIG. 11, the open-end direction is at the side opposite to the ground plane, and the driving-device direction is at the ground plane side. The gas chamber 58*a* may be arranged in the cylinder bottom at the ground plane side in the sealed container 8, and the gas chamber 58*b* may be arranged in the cylinder top at the side opposite to the ground plane in the sealed container 8 to protrude outward.

When the gas chambers 58*a* and 58*b* are thus arranged, the installation location of the gas circuit breaker 1 can be selected flexibly. For example, when other apparatuses are installed adjacent to the gas circuit breaker 1, the gas circuit breaker 1 can be installed in a small installation area.

In the embodiment, according to the fifth modified example, the gas chambers 57*a* and 57*b* or the gas chambers 58*a* and 58*b* each are formed of a hollow cup-shaped member arranged to protrude outward from the sealed container 8. The gas chambers 57*a* and 57*b* or the gas chambers 58*a* and 58*b* formed into a cup shape may be joined to the sealed container 8 by machining or welding to have a structure not using packing for sealing, etc. Applying the structure not using packing for sealing, etc. can prevent the deterioration of the sealing material due to ozone and reduce the leakage of the arc-extinguishing gas.

2. Second Embodiment

2-1. Configuration

A gas circuit breaker according to a second embodiment will be described with reference to FIG. 12. Note that in the configuration of the gas circuit breaker according to the second embodiment, the same components as those in the first embodiment illustrated in FIGS. 1 to 11 are denoted by the same reference signs.

Although the gas circuit breaker 1 according to the first embodiment includes the gas chamber 51*a* in the sealed container 8, the gas circuit breaker according to the second embodiment is different in that a gas chamber 51*a* in which an ozone decomposition catalyst 61*a* is placed is included in the sealed container 8.

Figure 12:
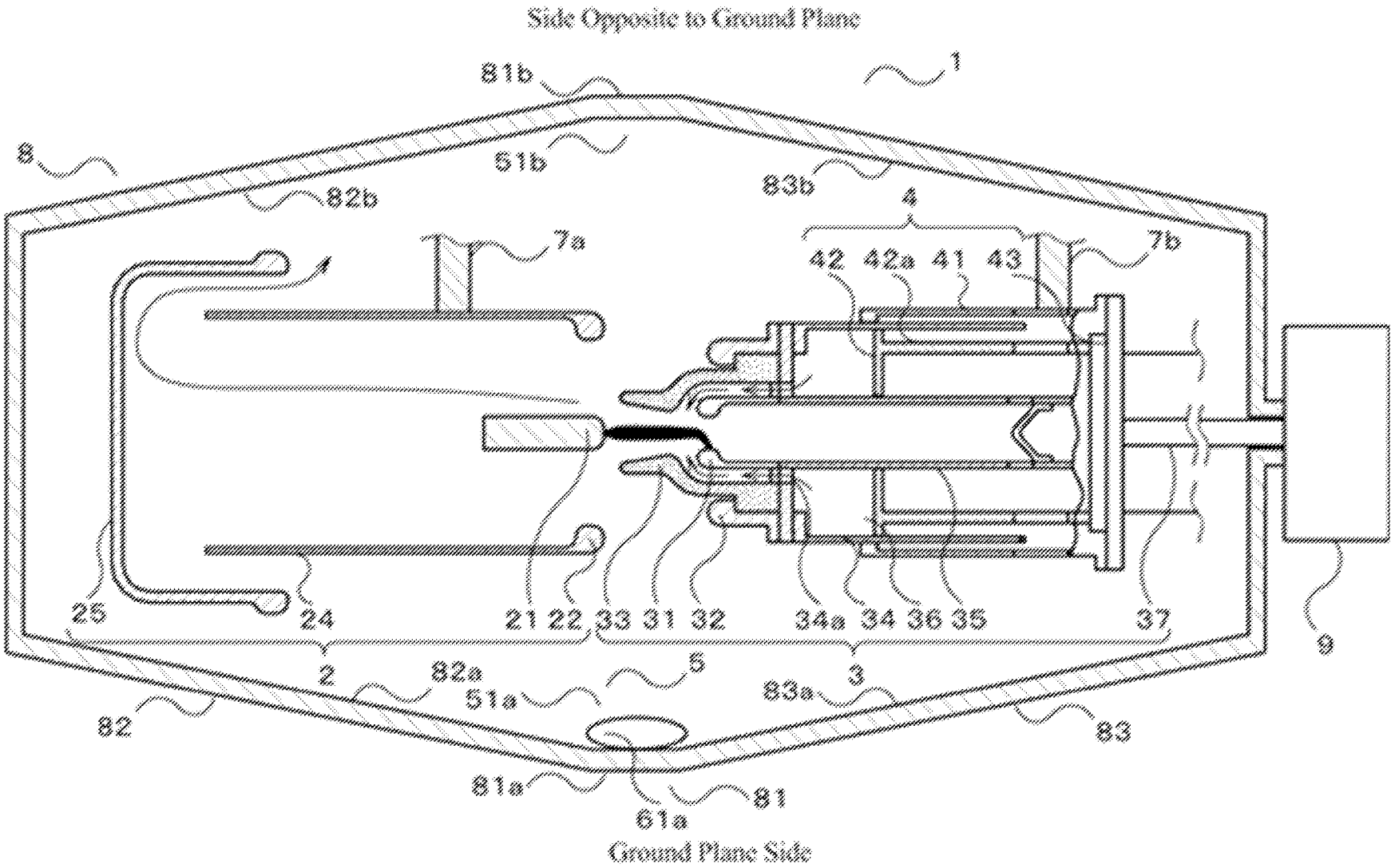
FIG. 12 is a diagram illustrating a configuration of a gas circuit breaker according to a second embodiment.

As illustrated in FIG. 12, the sealed container 8 has a cylindrical portion 81 at a joined portion of two hollow truncated cone portions 82 and 83, and the cylindrical portion 81 has a flat portion 81*a* at the ground plane side and a flat portion 81*b* at the side opposite to the ground plane. The gas chamber 51*a* configured to accumulate unnecessary gas such as ozone with a specific gravity heavier than the arc-extinguishing gas is arranged inside the flat portion 81*a* at the ground plane side in the cylindrical portion 81, and the ozone decomposition catalyst 61*a* is placed in the gas chamber 51*a*. The gas chamber 51*b* configured to accumulate unnecessary gas such as carbon monoxide with a specific gravity lighter than the arc-extinguishing gas is arranged inside the flat portion 81*b* at the side opposite to the ground plane in the cylindrical portion 81, as in the first embodiment.

2-2. Action

Between the fixed arc contactor 21 and the movable arc contactor 31 becomes a so-called arc-plasma state by the arc generated at the time of current breaking action. The arc-extinguishing gas in the arc-plasma state becomes high temperature and high pressure and reacts to generate the unnecessary gas. Ozone, which has large molecular weight and which is heavy, is precipitated at the ground plane side in the sealed container 8, and carbon monoxide, which has small molecular weight and which is light, rises to and stay in the side opposite to the ground plane in the sealed container 8.

The gas chambers 51*a* and 51*b* accumulate the unnecessary gas generated from the arc-extinguishing gas sprayed to the arc. The gas chamber 51*a* arranged at the ground plane side in the sealed container 8 accumulates the unnecessary gas such as ozone with a specific gravity heavier than the arc-extinguishing gas, and the unnecessary gas flowing out to the outside of the gas chamber 51*a* is reduced. The gas chamber 51*b* arranged at the side opposite to the ground plane in the sealed container 8 accumulates the unnecessary gas such as carbon monoxide with a specific gravity lighter than the arc-extinguishing gas, and the unnecessary gas flowing out to the outside of the gas chamber 51*b* is reduced.

The ozone decomposition catalyst 61*a* placed in the gas chamber 51*a* is formed of activated carbon. The activated carbon is arranged at the bottom of the gas chamber 51*a*. Ozone $O_3$ is decomposed by the ozone decomposition catalyst 61*a* which is activated carbon, as follows.

$$2O_3+C \rightarrow CO_2+CO_2+679\ \text{kJ} \qquad \text{(Reaction 9)}$$

The above-described reaction is an exothermic reaction, and generates high temperature. The ozone decomposition reaction of the above-described reactions 6 and 7 is further accelerated by the heat generation by the reaction.

The activated carbon is generally known as adsorbent, and has high adsorption effect relative to non-polar material. The activated carbon is formed of carbon, and carbon produces catalytic reaction of the following reactions 10 and 11 with ozone.

[Formula 1]

(Reaction 10)

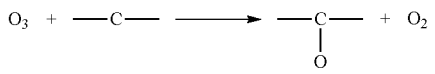

(Reaction 11)

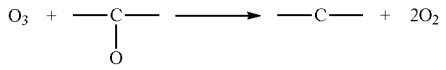

The ozone decomposition catalyst 61*a* which is activated carbon decomposes ozone which is the unnecessary gas generated from the arc-extinguishing gas sprayed to the arc.

As an alternative to or in addition to activated carbon, the ozone decomposition catalyst 61*a* may be manganese, aluminum, cerium, barium, platinum, palladium, rhodium, and ruthenium. Dissociation and recombination reaction of an oxygen atom shown in the above-described reactions 10 and 11 can be achieved by using manganese, aluminum, cerium, barium, platinum, palladium, rhodium, and ruthenium, other than carbon.

Furthermore, the activated carbon has $H_2O$ adsorption effect. The ozone decomposition catalyst 61*a*, which is activated carbon, placed at the bottom of the gas chamber 51*a* adsorbs moisture in the sealed container 8. In addition, the ozone decomposition catalyst 61*a*, which is activated carbon, adsorbs hydrogen fluoride.

2-3. Effect (1) According to the present embodiment, since the ozone decomposition catalyst 61*a* is placed in the gas chamber 51*a*, ozone which is the generated unnecessary gas is decomposed.

(2) According to the present embodiment, since ozone which is the unnecessary gas generated from the arc-extinguishing gas sprayed to the arc is decomposed by the ozone decomposition catalyst 61*a*, making it hard to contact the insulation member, the first fixed contactor portion 2, the second fixed contactor portion 4, and the movable contactor portion 3 forming the gas circuit breaker 1, the deterioration in insulation performance and current breaking performance of the gas circuit, breaker 1 due to the unnecessary gas can be reduced.

(3) According to the present embodiment, since the ozone decomposition catalyst 61*a* includes at least one of activated carbon, carbon, manganese, aluminum, cerium, barium, platinum, palladium, rhodium, and ruthenium, the gas circuit breaker can be provided which is capable of reducing the deterioration in insulation performance and current breaking performance due to the unnecessary gas generated from the arc-extinguishing gas sprayed to the arc, by using general catalyst.

(4) According to the present embodiment, since the ozone decomposition catalyst 61*a*, which is activated carbon, is placed at the bottom of the gas chamber 51*a*, moisture in the sealed container 8 can be adsorbed. In addition, since the ozone decomposition catalyst 61*a*, which is activated carbon, adsorbs hydrogen fluoride, the deterioration of the gas circuit breaker 1 can be reduced.

2-4. Modified Example

(1) First Modified Example

Figure 13:
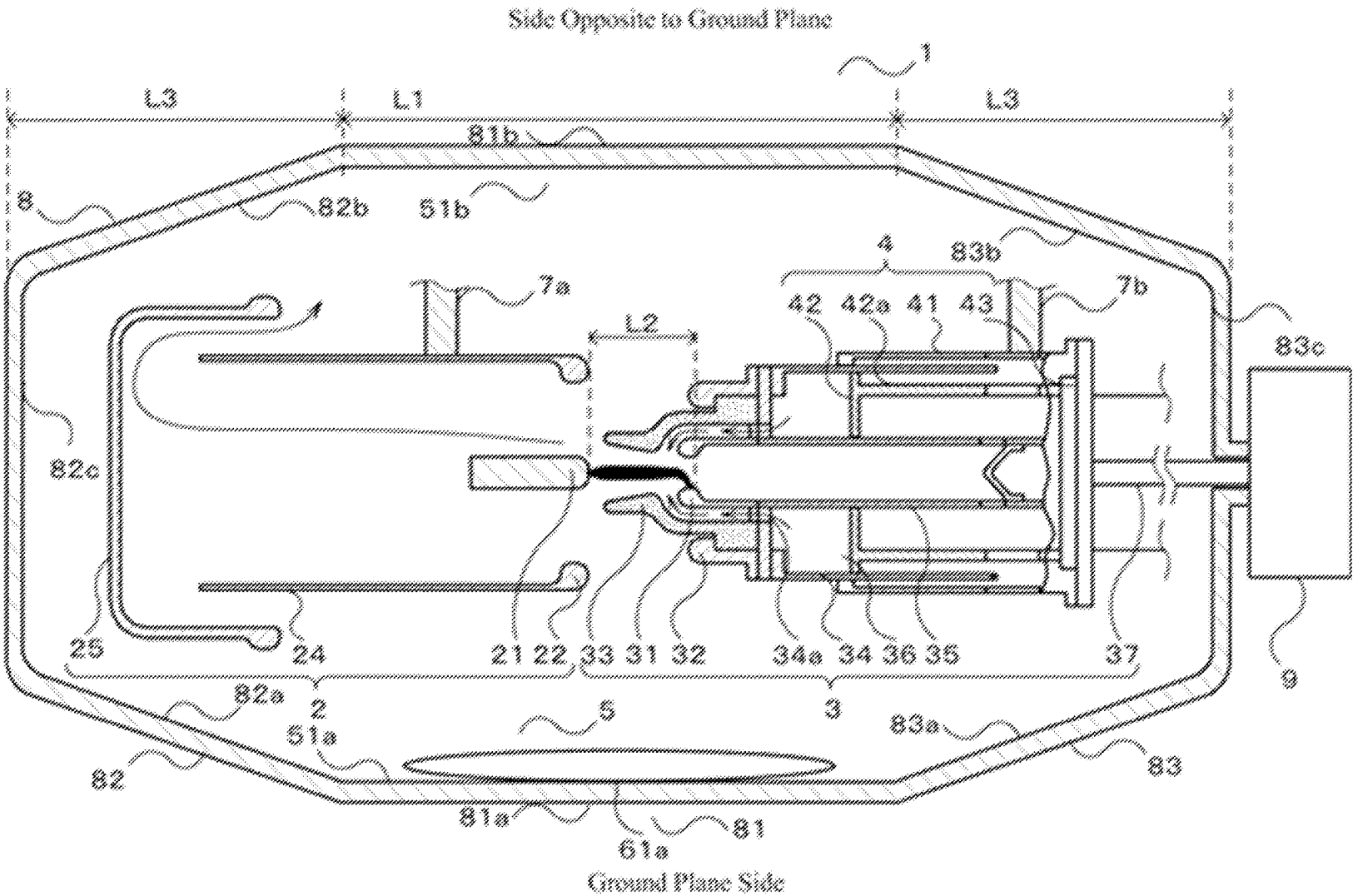
FIG. 13 is a diagram illustrating a configuration of a gas circuit; breaker according to a first modified example of the second embodiment.

As illustrated in FIG. 13, the sealed container 8 may be configured so that a height L1 of the cylindrical portion 81 of the sealed container 8 is equal to or more than a length L2 of an arc generated between the fixed arc contactor 21 and the movable arc contactor 31 at a time of current breaking action. An ozone decomposition catalyst 61*a* is placed in the gas chamber 51*a* configured to accumulate the unnecessary gas such as ozone with a specific gravity heavier than the arc-extinguishing gas, the gas chamber 51*a* being arranged inside the flat portion 81*a* on a ground plane side m the cylindrical portion 81.

The height L1 of the cylindrical portion 81 is equal to or more than the length L2 of the arc generated between the fixed arc contactor 21 and the movable arc contactor 31 at the time of current breaking action, and accordingly, the volume of the gas chamber 51*a* can be further increased. This enables the unnecessary gas to be accumulated in the gas chamber 51*a* more surely even when the unnecessary gas generated from the arc is dispersed, and enables the ozone which is the unnecessary gas to be decomposed more surely by the ozone decomposition catalyst 61*a* placed in the gas chamber 51*a*.

The sealed container 8 may be configured so that the height L1 of the cylindrical portion 81 of the sealed container 8 is equal to or more than the height L3 of the truncated cone portion 82 or the truncated cone portion 83 forming the sealed container 8. Since the height L3 of each of the truncated cone portions 82 and 83 can be shortened, the truncated cone portions 82 and 83 can be easily formed, and the gas circuit breaker 1 that can be easily manufactured can be provided.

(2) Second Modified Example

Figure 14:
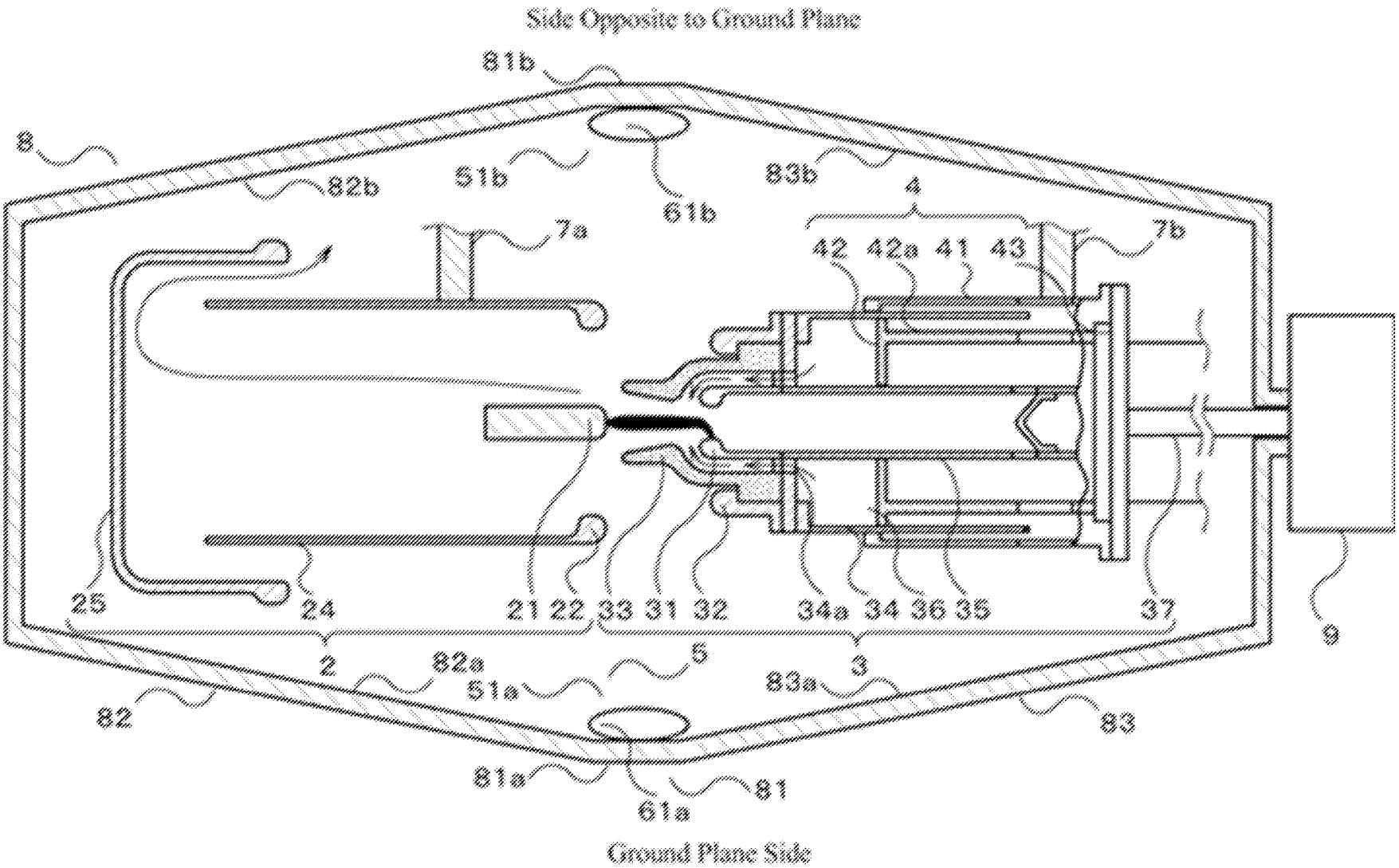
FIG. 14 is a diagram illustrating a configuration of a gas circuit breaker according to a second modified example of the second embodiment.
Figure 15:
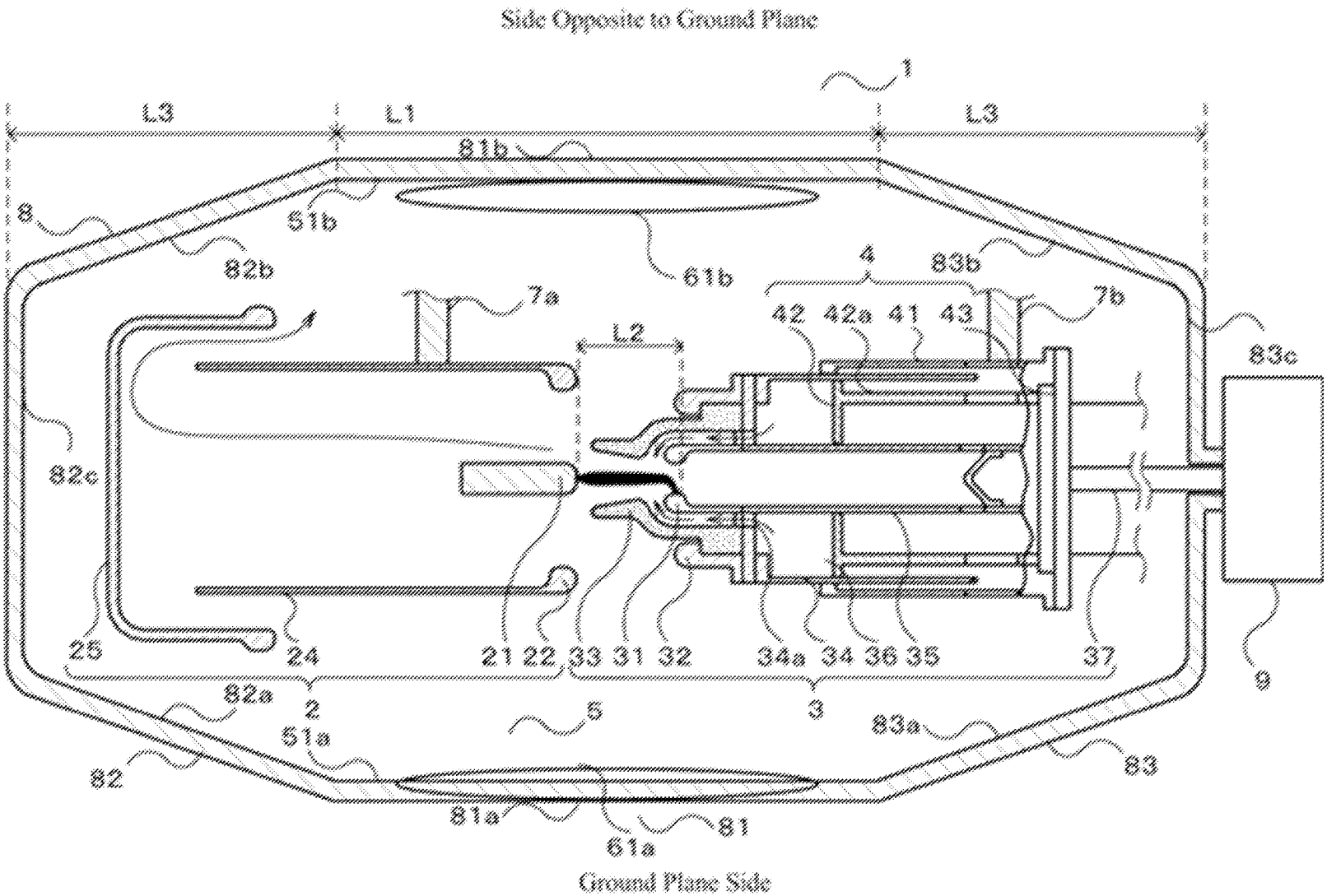
FIG. 15 is a diagram illustrating a configuration of a gas circuit breaker according to another form of the second modified example of the second embodiment.

In addition to the above-described embodiment, as illustrated in FIG. 14 or 15, an ozone decomposition catalyst 61*b* may be placed in the gas chamber 51*b* formed inside the flat portion 81*b* at the side opposite to the ground plane of the cylindrical portion 81 to which two truncated cone portions 82 and 83 are joined in the sealed container 8.

The ozone decomposition catalyst 61*b* which is activated carbon reduces carbon monoxide to carbon dioxide as in the reaction 12 below, in addition to the reactions 10 and 11.

(Reaction 12)

[Formula 12]

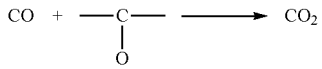

By activated carbon placed in the gas chamber 51*b*, carbon monoxide is reduced to carbon dioxide as in the above-described reaction 12.

Since carbon monoxide is reduced to carbon dioxide by activated carbon placed in the gas chamber 51*b*, making it hard to contact the insulation member, the first fixed contactor portion 2, the second fixed contactor portion 4, and the movable contactor portion 3 forming the gas circuit breaker 1, the deterioration in insulation performance and current breaking performance of the gas circuit breaker 1 due to the unnecessary gas can be reduced.

(3) In addition to the above-described embodiment, the ozone decomposition catalyst 61*a* may be placed in the gas chamber 51*a* in the second modified example illustrated in FIG. 4, the gas chambers 54*a* and 55*a* in the third modified example illustrated in FIGS. 5 and 6, the gas chamber 56*a* in the fourth modified example illustrated in FIG. 7, and the gas chambers 57*a* and 58*a* in the fifth modified example illustrated in FIGS. 9 and 11, according to the first embodiment, to decompose ozone. Such a configuration enables the volume of the sealed container 8 to be reduced. As a result, a compact gas circuit breaker that is easy to install in small installation location can be provided.

(4) In addition to the above-described embodiment, the ozone decomposition catalyst 61*b*, which is activated carbon, may be placed in the gas chamber 51*b* in the second modified example illustrated in FIG. 4, the gas chambers 54*b* and 55*b* in the third modified example illustrated in FIGS. 5 and 6, the gas chamber 56*b* in the fourth modified example illustrated in FIG. 7, and the gas chambers 57*b* and 58*b* in the fifth modified example illustrated in FIGS. 9 and 11, according to the first embodiment, to decompose carbon monoxide. Such a configuration enables the volume of the sealed container 3 to be reduced. As a result, a compact gas circuit breaker that is easy to install in small installation location can be provided.

3. Third Embodiment

3-1 Configuration

A gas circuit breaker 1 according to a third embodiment will be described with reference to FIG. 16. Note that in the configuration of the gas circuit breaker 1 according to the third embodiment, the same components as those in the first embodiment illustrated in FIGS. 1 to 11 are denoted by the same reference signs.

Although the gas circuit breaker 1 according to the first embodiment includes the gas chambers 51*a* and 51*b* in the sealed container 8, the gas circuit breaker 1 according to the third embodiment is different in that an exhaust pipe 62*a* connected to the gas chamber 51*a*, an exhaust pipe 62*b* connected to the gas chamber 51*b*, a sensor 63*a* arranged near the gas chamber 51*a*, and a sensor 63*b* arranged near the gas chamber 51*b* are included.

Figure 16:
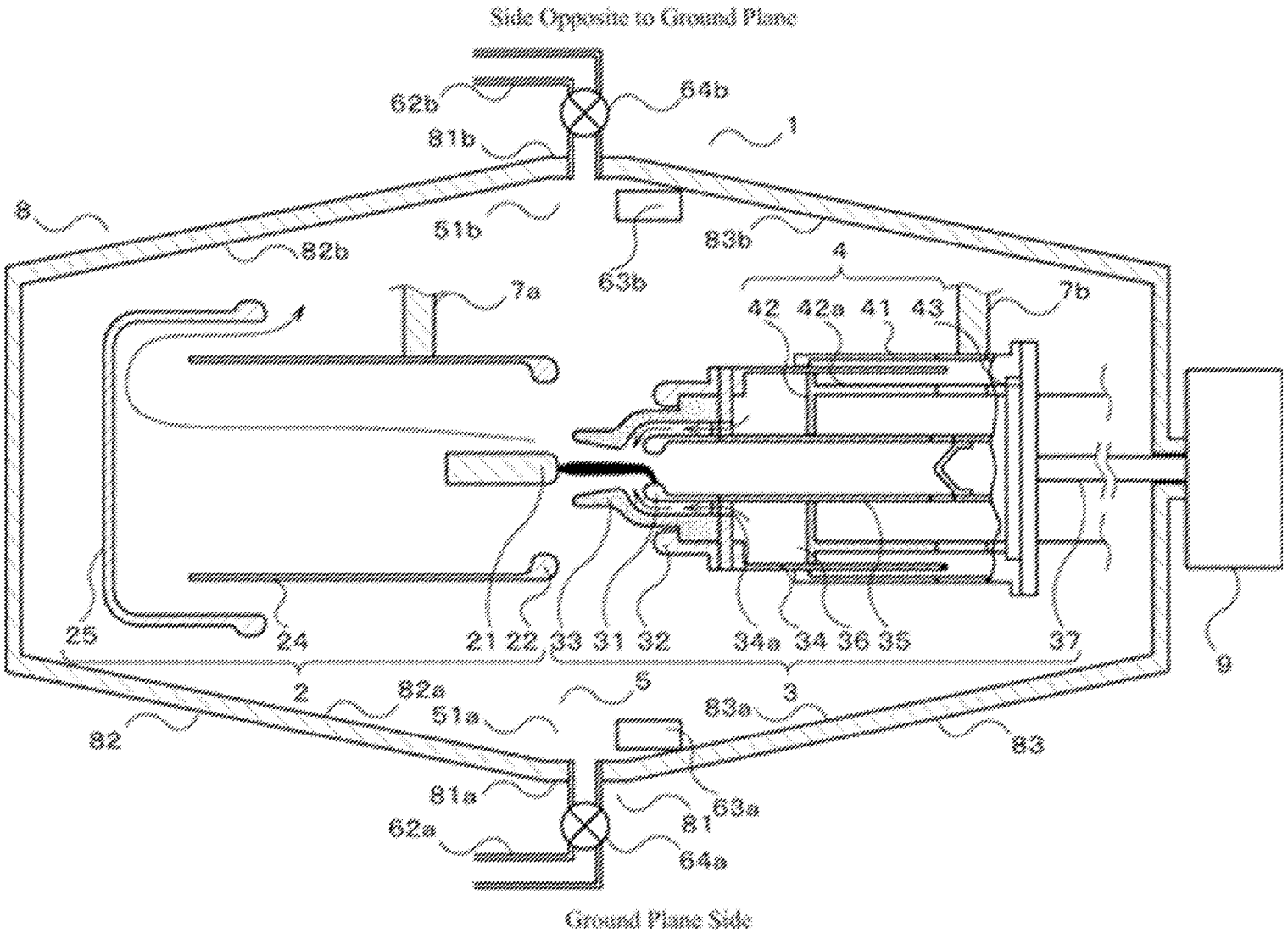
FIG. 16 is a diagram illustrating a structure of a gas circuit breaker according to a third embodiment.

As illustrated in FIG. 16, the sealed container 8 has a cylindrical portion 81 at a joined portion of two hollow truncated cone portions 82 and 33, and the cylindrical portion 81 has a flat portion 81*a* at the ground plane side and a flat portion 81*b* at the side opposite to the ground plane. As in the first embodiment, the gas chamber 51*a* configured to accumulate unnecessary gas such as ozone with a specific gravity heavier than the arc-extinguishing gas is arranged inside the flat portion 81*a* at the ground plane side in the cylindrical portion 81. Furthermore, the gas chamber 51*b* configured to accumulate unnecessary gas such as carbon monoxide with a specific gravity lighter than the arc-extinguishing gas is arranged inside the flat portion 81*b* at the side opposite to the ground plane in the cylindrical portion 81.

The exhaust pipe 62*a* is connected to the gas chamber 51*a* provided to the flat portion 81*a* at the ground plane side in the cylindrical portion 81. The exhaust pipe 62*a* forms a flow path in which the unnecessary gas flows from the interior of the sealed container 8 to the outside via the gas chamber 51*a*.

The exhaust pipe 62*a* is formed by a pipe made of metal such as aluminum. The exhaust pipe 62*a* is arranged to the gas chamber 51*a* at the ground plane side in the sealed container 8. Furthermore, the exhaust pipe 62*a* includes a cock 64*a* for opening and closing the exhaust pipe 62*a* which is outside the sealed container 8 and at the middle portion connecting the inside and the outside of the sealed container 8.

The exhaust pipe 62*a* exhausts ozone with the specific gravity heavier than the arc-extinguishing gas in the unnecessary gas generated from the arc-extinguishing gas sprayed to the arc. The cock 64*a* is opened by a worker to recover ozone with the specific gravity heavier than the arc-extinguishing gas in the unnecessary gas generated from the arc-extinguishing gas sprayed to the arc.

The sensor 63*a* is formed by an ozone sensor formed of a semiconductor, etc. The sensor 63*a* is a sensor configured to detect the unnecessary gas generated from the arc-extinguishing gas sprayed to the arc. The sensor 63*a* detects the concentration of ozone in the unnecessary gas generated from the arc-extinguishing gas sprayed to the arc. The sensor 63*a* is arranged near the gas chamber 51*a* at the ground plane side in the sealed container 8. The output signal of the sensor 63*a* is input to external data logger (not illustrated in the figure), etc.

The exhaust pipe 62*b* is connected to the gas chamber 51*b* provided to the flat portion 81*b* at the side opposite to the ground plane in the cylindrical portion 81. The exhaust pipe 62*b* forms a flow path in which the unnecessary gas flows from the interior of the sealed container 8 to the outside via the gas chamber 51*b*.

The exhaust pipe 62*b* is formed by a pipe made of metal such as aluminum. The exhaust pipe 62*b* is arranged to the gas chamber 51*b* at the ground plane side in the sealed container 8. Furthermore, the exhaust pipe 62*b* includes a cock 64*a* for opening and closing the exhaust pipe 62*b* which is outside the sealed container 8 and at the middle portion connecting the inside and the outside of the sealed container 8.

The exhaust pipe 62*b* exhausts carbon monoxide with the specific gravity lighter than the arc-extinguishing gas in the unnecessary gas generated from the arc-extinguishing gas sprayed to the arc. The cock 64*b* is opened by a worker to recover carbon monoxide with the specific gravity lighter than the arc-extinguishing gas in the unnecessary gas generated from the arc-extinguishing gas sprayed to the arc.

The sensor 63*b* is formed by a carbon monoxide sensor formed of a semiconductor, etc. The sensor 63*b* is a sensor configured to detect the unnecessary gas generated from the arc-extinguishing gas sprayed to the arc. The sensor 63*b* detects the concentration of carbon monoxide in the unnecessary gas generated from the arc-extinguishing gas sprayed to the arc. The sensor 63*b* is arranged near the gas chamber 51*b* at the side opposite to the ground plane in the sealed container 8. The output signal of the sensor 63*b* is input to external data logger (not illustrated in the figure), etc.

3-2. Action

As described above, the arc-extinguishing gas sprayed to the arc generates the unnecessary gas containing ozone and carbon monoxide. Since ozone has the specific gravity heavier than the arc-extinguishing gas, ozone is accumulated in the gas chamber 51*a* at the ground plane side in the sealed container 8. Furthermore, since carbon monoxide has the specific gravity lighter than the arc-extinguishing gas, carbon monoxide is accumulated in the gas chamber 51*b* at the side opposite to the ground plane in the sealed container 8.

The accumulated amount of the accumulated ozone and carbon monoxide decreases as time elapses. However, when the breaking action of the gas circuit breaker 1 is repeated before the time required for the accumulated amount to decrease is elapsed, ozone and carbon monoxide are accumulated cumulatively.

The worker monitors the concentration of ozone output from the sensor 63*a* and the concentration of carbon monoxide output from the sensor 63*b* by the external apparatus such as data logger.

By monitoring the concentration of ozone output from the sensor 63*a* and the concentration of carbon monoxide output from the sensor 63*b*, the worker can know the accumulated amount of ozone and carbon monoxide.

When the worker determines that the accumulated amount of ozone is equal to or more than a certain value, the worker opens the cock 64*a*, and recovers ozone via the exhaust pipe 62*a*. When the worker determines that the accumulated amount of carbon monoxide is equal, to or more than a certain value, the worker opens the cock 64*b*, and recovers carbon monoxide via the exhaust pipe 62*b*.

3-3. Effect (1) According to the present embodiment, since the sensors 63*a* and 63*b* configured to detect the unnecessary gas generated from the arc-extinguishing gas sprayed to the arc are provided, the worker can know the accumulated amount of ozone and carbon nonoxide.

(2) According to the present embodiment, since the exhaust pipes 62*a* and 62*b* configured to exhaust the unnecessary gas generated from the arc-extinguishing gas sprayed to the arc are provided, the worker can recover ozone and carbon monoxide from the exhaust pipes 62*a* and 62*b*. As a result, ozone and carbon monoxide are removed from the interior of the sealed container 8, and the gas circuit breaker can be provided which is capable of reducing the deterioration in insulation performance and current breaking performance due to the unnecessary gas generated from the arc-extinguishing gas sprayed to the arc.

Figure 17:
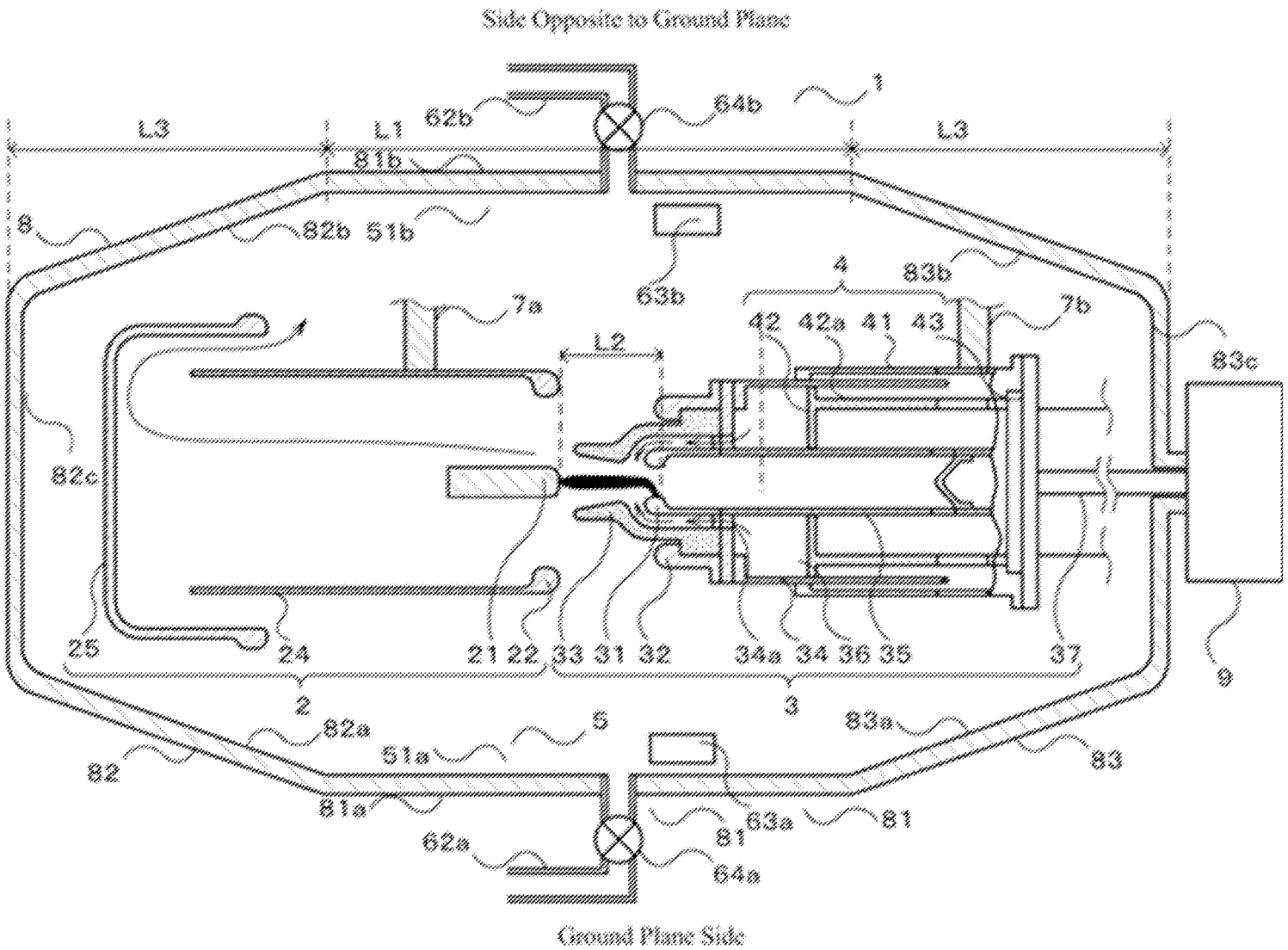
FIG. 17 is a diagram illustrating a structure of a gas circuit breaker according to a modified example of the third embodiment.

3-4. Modified Example (1) As illustrated in FIG. 17, the sealed container 8 may be configured so that a height L1 of the cylindrical portion 81 of the sealed container 8 is equal to or more than a length L2 of an arc generated between the fixed arc contactor 21 and the movable arc contactor 31 at a time of current breaking action. The exhaust pipe 62*a* is connected to the gas chamber 51*a*, and the exhaust pipe 62*b* is connected to the gas chamber 51*b*. The sensor 63*a* is arranged near the gas chamber 51*a*, and the sensor 63*b* is arranged near the gas chamber 51*b*.

The height L1 of the cylindrical portion 81 is equal to or more than the length L2 of the arc generated between the fixed arc contactor 21 and the movable arc contactor 31 at the time of current breaking action, and accordingly, the volume of the gas chambers 51*a* and 51*b* can be further increased. This enables the unnecessary gas to be accumulated in the gas chambers 51*a* and 51*b* more surely oven when the unnecessary gas generated from the arc is dispersed.

Ozone with the specific gravity heavier than the arc-extinguishing gas in the unnecessary gas is accumulated in the gas chamber 51*a*, and is exhausted from the exhaust pipe 62*a* more surely. The concentration of ozone is detected by the sensor 63*a* more surely.

Carbon monoxide with the specific gravity lighter than the arc-extinguishing gas in the unnecessary gas is accumulated in the gas chamber 51*b*, and is exhausted from the exhaust pipe 62*b* more surely. The concentration of carbon monoxide is detected by the sensor 63*b* more surely.

The sealed container 8 may be configured so that the height L1 of the cylindrical portion 81 of the sealed container 8 is equal to or more than the height L3 of the truncated cone portion 82 or the truncated cone portion 83 forming the sealed container 8. Since the height L3 of each of the truncated cone portions 82 and 83 can be shortened, the truncated cone portions 82 and 83 can be easily formed, and the gas circuit breaker 1 that can be easily manufactured can be provided.

(2) In the above-described embodiment, although the sensor 63*a* is an ozone sensor formed of a semiconductor, etc., the sensor 63*a* is not limited thereto. The sensor 63*a* may be a UV absorption-type ozone sensor, etc. Furthermore, although the sensor 63*a* is arranged near the gas chamber 51*a* of the sealed container 8, the installation location of the sensor 63*a* is not limited thereto. The sensor 63*a* may be arranged to the exhaust pipe 62*a* outside the sealed container 8.

(3) In the above-described embodiment, although the sensor 63*b* is a carbon monoxide sensor formed of a semiconductor, etc., the sensor 63*b* is not limited thereto. The sensor 63*b* may be an IR absorption-type carbon monoxide sensor, etc. Furthermore, although the sensor 63*b* is arranged near the gas chamber 51*b* of the sealed container 8, the installation location of the sensor 63*b* is not limited thereto. The sensor 63*b* may be arranged to the exhaust pipe 62*a* outside the sealed container 8.

(4) As an alternative to the above-described embodiment, the exhaust pips 62*a* may be connected to and the sensor 63*a* may be arranged near the gas chamber 51*a* in the second modified example illustrated in FIG. 4, the gas chambers 54*a* and 55*a* in the third modified example illustrated in FIGS. 5 and 6, the gas chamber 56*a* in the fourth modified example illustrated in FIG. 7, and the gas chambers 57*a* and 58*a* in the fifth modified example illustrated in FIGS. 9 and 11, according to the first embodiment. Such a configuration enables the volume of the sealed container 8 to be reduced. As a result, a compact gas circuit breaker that is easy to install in small installation location can be provided.

(5) As an alternative to the above-described embodiment, the exhaust pipe 62*b* may be connected to and the sensor 63*b* may be arranged near the gas chamber 51*b* in the second modified example illustrated in FIG. 4, the gas chambers 54*b* and 55*b* in the third modified example illustrated in FIGS. 5 and 6, the gas chamber 56*b* in the fourth modified example illustrated in FIG. 7, and the gas chambers 57*b* and 58*b* in the fifth modified example illustrated in FIGS. 9 and 11, according to the first embodiment. Such a configuration enables the volume of the sealed container 8 to be reduced. As a result, a compact gas circuit breaker that is easy to install in small installation location can be provided.

Figure 18:
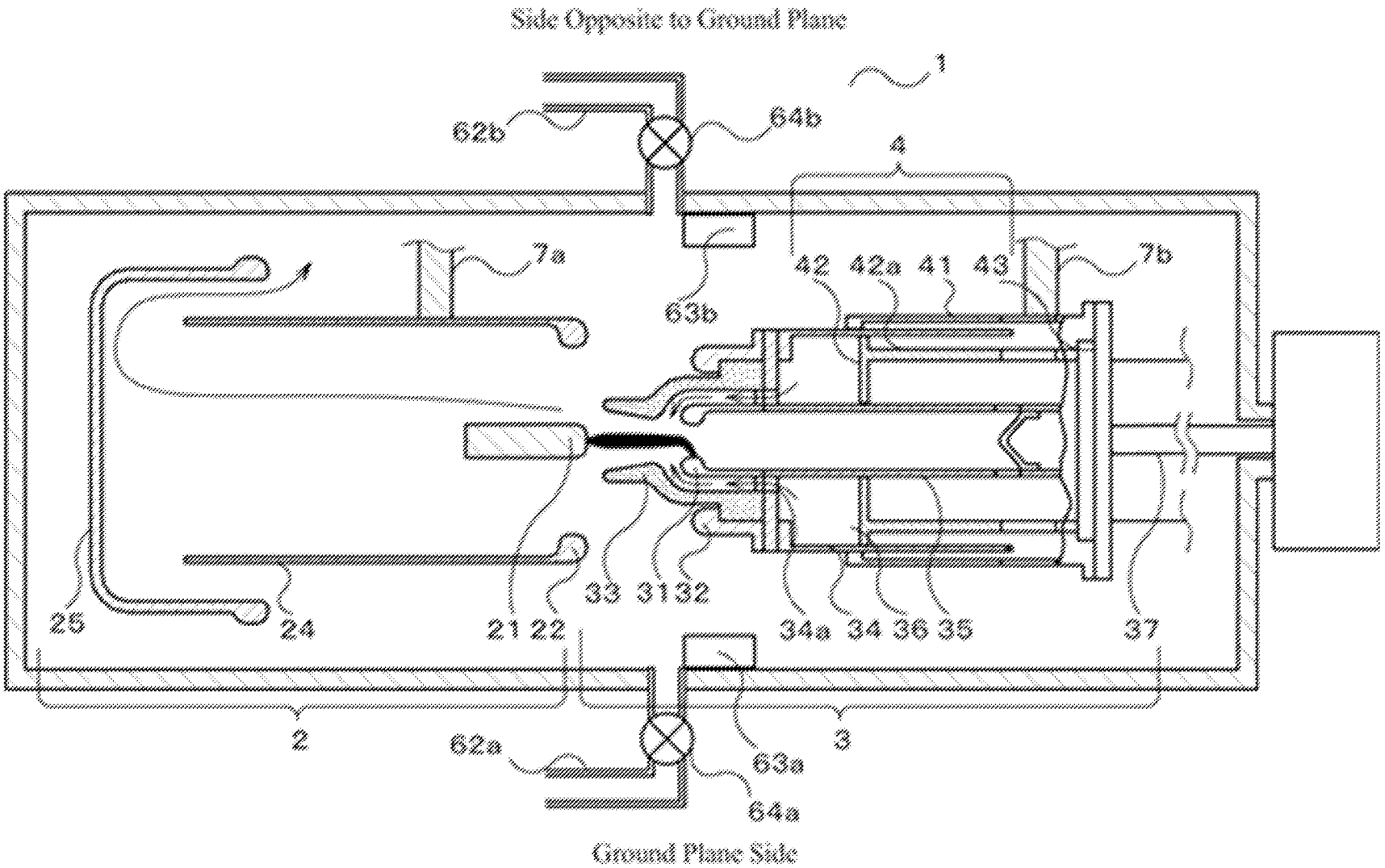
FIG. 18 is a diagram illustrating a structure of a gas circuit breaker according to another form of the modified example of the third embodiment.

(6) In the above-described embodiment, although the exhaust pipe 62*a* is connected to the gas chamber 51*a*, and the sensor 63*a* is arranged near the gas chamber 51*a*, the installation locations of the exhaust pipe 62*a* and the sensor 63*a* are not limited thereto. As illustrated in FIG. 18, a configuration may be adopted in which the scaled container 8 does not include the gas chamber 51*a*, the exhaust pipe 62*a* is connected to the sealed container 8 at the ground plane side, and the sensor 63*a* is arranged inside the sealed container 3 at the ground plane side.

(7) In the above-described embodiment, although the exhaust pipe 62*b* is connected to the gas chamber 51*b*, and the sensor 63*b* is arranged near the gas chamber 51*b*, the installation locations of the exhaust pipe 62*b* and the sensor 63*b* are not limited thereto. As illustrated in FIG. 18, a configuration may be adopted in which the sealed container 8 does not include the gas chamber 51*b*, the exhaust pipe 62*b* is connected to the sealed container 8 at the side opposite to the ground plane, and the sensor 63*b* is arranged inside the sealed container 8 at the side opposite to the ground plane.

4. Fourth Embodiment

4-1. Configuration

A gas circuit breaker 1 according to a fourth embodiment will be described with reference to FIG. 19. Note that in the configuration of the gas circuit breaker 1 according to the fourth embodiment, the same components as those in the first embodiment illustrated in FIGS. 1 to 11 are denoted by the same reference signs.

Although the gas circuit breaker 1 according to the first embodiment includes the gas chambers 51*a* and 51*b* in the sealed container 8, the gas circuit breaker 1 according to the fourth embodiment is different in that a processing portion 67 provided outside the sealed container 8 and configured to decompose the unnecessary gas generated from the arc-extinguishing gas sprayed to the arc, discharge pipes 65*a* and 65*b* configured to send the arc-extinguishing gas containing the unnecessary gas to the processing portion 67 from the sealed container 8, and an air supply pipe 66 configured to send, to the sealed container 8, the arc-extinguishing gas in which the unnecessary gas is decomposed in the processing portion 67.

Figure 19:
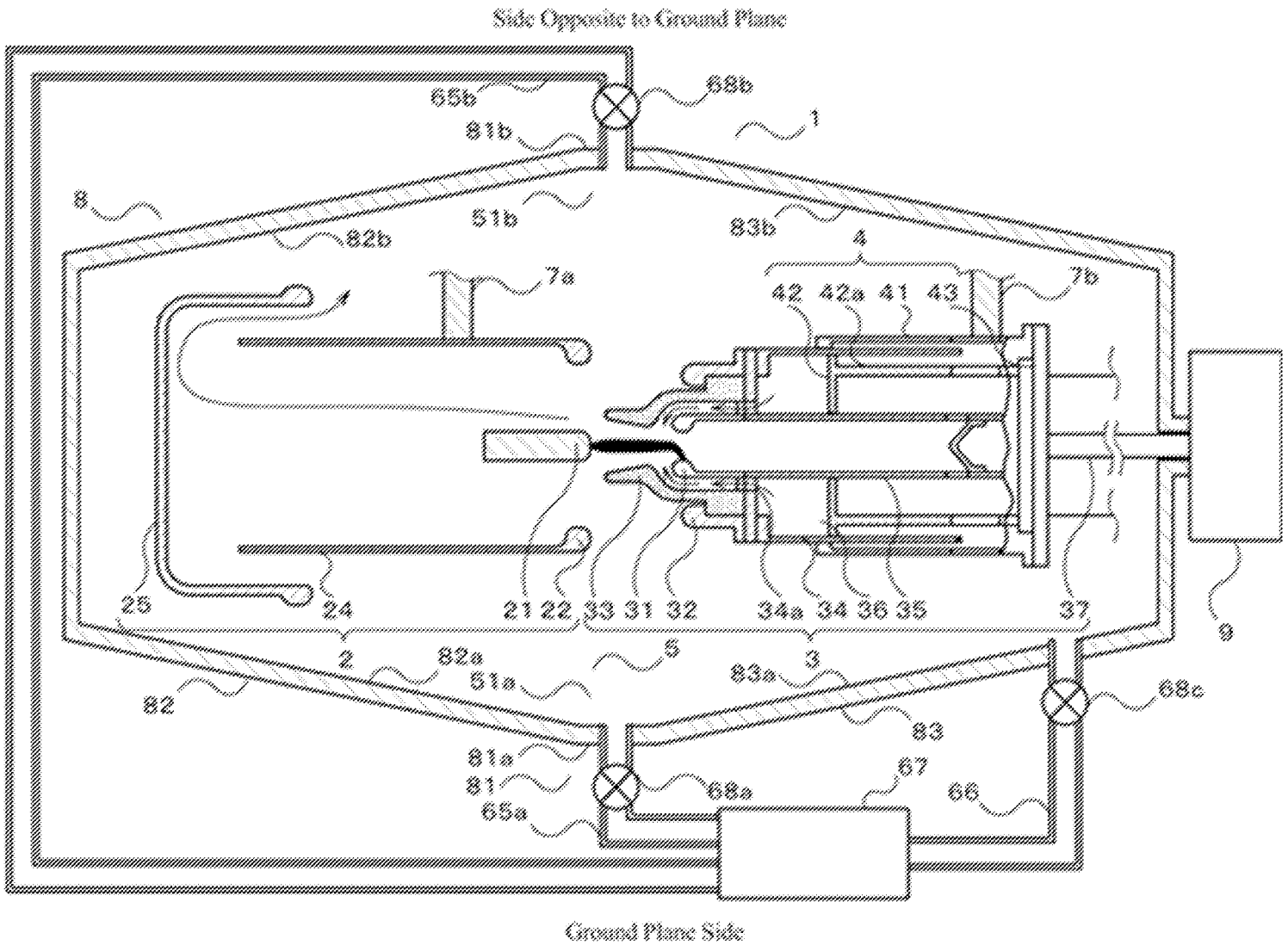
FIG. 19 is a diagram illustrating a structure of a gas circuit breaker according to a fourth embodiment.

As illustrated in FIG. 19, the processing portion 67 is arranged outside the sealed container 8. The discharge pipes 65*a* and 65*b* configured to send the arc-extinguishing gas to the processing portion 67 and the air supply pipe 66 configured to send, to the sealed container 8, the arc-extinguishing gas in which the unnecessary gas is decomposed in the processing portion 67 are connected to the sealed container 8.

The sealed container 8 has a cylindrical portion 81 at a joined portion of two hollow truncated cone portions 82 and 83, and the cylindrical portion 81 has a flat portion 81*a* at the ground plane side and a flat portion 81*b* at the side opposite to the ground plane. As in the first embodiment, the gas chamber 51*a* configured to accumulate unnecessary gas such as ozone with a specific gravity heavier than the arc-extinguishing gas is arranged inside the flat portion 81*a* at the ground plane side in the cylindrical portion 81. Furthermore, the gas chamber. 51*b* configured to accumulate unnecessary gas such as carbon monoxide with a specific gravity lighter than the arc-extinguishing gas is arranged inside the fiat portion 81*b* at the side opposite to the ground plane in the cylindrical portion 81.

The discharge pipe 65*a* is connected to the gas chamber 51*a* provided to the flat portion 81*a* at the ground plane side in the cylindrical portion 81. The discharge pipe 65*a* forms a flow path in which the unnecessary gas is sent from the gas chamber 51*a* to the processing portion 67 arranged outside the sealed container 8.

The discharge pipe 65*a* is formed by a pipe made of metal such as aluminum. The discharge pipe 65*a* is arranged to the gas chamber 51*a* at the ground plane side in the sealed container 8. Furthermore, the discharge pipe 65*a* includes a cock 68*a* for opening and closing the discharge pipe 65*a* which is outside the sealed container 8 and at the midway to the processing portion 67.

The discharge pipe 65*a* sends, to the processing portion 67, ozone with the specific gravity heavier than the arc-extinguishing gas in the unnecessary gas generated from the arc-extinguishing gas sprayed to the arc. The cock 68*a* is opened by a worker to send, to the processing portion 67, ozone with the specific gravity heavier than the arc-extinguishing gas in the unnecessary gas generated from the arc-extinguishing gas sprayed to the arc.

The discharge pipe 65*b* is connected to the gas chamber 51*b* provided to the flat portion 81*b* at the side opposite to the ground plane in the cylindrical portion 81. The discharge pipe 65*b* forms a flow path in which the unnecessary gas is sent from the gas chamber 51*b* to the processing portion 67 arranged outside the sealed container 8.

The discharge pipe 65*b* is formed by a pipe made of metal such as aluminum. The discharge pipe 65*b* is arranged to the gas chamber 51*b* at the ground plane side in the sealed container 6. Furthermore, the discharge pipe 65*b* includes a cock 68*b* for opening and closing the discharge pipe 65*b* which is outside the sealed container 8 and at the midway to the processing portion 67.

The discharge pipe 65*b* sends, to the processing portion 67, carbon monoxide with the specific; gravity lighter than the arc-extinguishing gas in the unnecessary gas generated from the arc-extinguishing gas sprayed to the arc. The cock 68*b* is opened by a worker to send, to the processing portion 67, carbon monoxide with the specific gravity lighter than the arc-extinguishing gas in the unnecessary gas generated from the arc-extinguishing gas sprayed to the arc.

The air supply pipe 66 is formed by a pipe made of metal such as aluminum. One end of the air supply pipe 66 is connected to the sealed container 8, and the other end of the air supply pipe 66 is connected to the processing portion 67. Furthermore, the air supply pipe 66 includes a cock 68*c* for opening and closing the air supply pipe 66 which is outside the sealed container 8 and at midway from the processing portion 67 to the sealed container 8. The air supply pipe 6 is preferably connected to the sealed container 8 on the driving-side direction side.

The air supply pipe 66 sends, to the sealed container 8, the arc-extinguishing gas from which the unnecessary gas is removed in the processing portion 67.

The processing portion 67 is formed by the ozone decomposition catalyst placed inside a casing made of metal such as an aluminum casing. The processing portion 67 is arranged outside the sealed container 8. An input side of the processing portion 67 is connected to the sealed container 8 via the discharge pipes 65*a* and 65*b*. An output side of the processing portion 67 is connected to the sealed container 8 via the air supply pipe 66.

The arc-extinguishing gas containing ozone, which is the unnecessary gas, is sent to the processing portion 67 via the gas chamber 51*a* and the discharge pipe 65*a* provided to the ground plane side of the sealed container 8 by a blower (not illustrated) provided in the processing portion 67. Furthermore, the arc-extinguishing gas containing carbon monoxide, which is the unnecessary gas, is sent to the processing portion 67 via the gas chamber 51*b* and the discharge pipe 65*b* provided to the side opposite to the ground plane side of the sealed container 8.

Activated carbon is used as the ozone decomposition catalyst of the processing portion 67. The processing portion 67 mixes ozone and carbon monoxide which are the unnecessary gas contained in the arc-extinguishing gas sprayed to the arc, and decomposes them by causing the above-described reactions 10, 11, and 12. The arc-extinguishing gas containing the unnecessary gas discharged from the sealed container 8 via the discharge pipes 65*a* and 65*b* is sent to the sealed container 8 via the air supply pipe 66 after ozone and carbon monoxide are decomposed.

14-2. Action

As described above, the arc-extinguishing gas sprayed to the arc generates the unnecessary gas containing ozone and carbon monoxide. Since ozone has the specific gravity heavier than the arc-extinguishing gas, ozone is accumulated in the gas chamber 51*a* at the ground plane side in the sealed container 8. Furthermore, since carbon monoxide has the specific gravity lighter than the arc-extinguishing gas, carbon monoxide is accumulated in the gas chamber 51*b* at the side opposite to the ground plane in the sealed container 8.

The discharge pipe 65*a* is arranged to the gas chamber 51*a* at the ground plane side in the sealed container 8. After the cock 68*a* and the cock 68*c* are opened by a worker, the arc-extinguishing gas containing ozone accumulated at the ground plane side in the sealed container 8 is sent to the processing portion 67 via the discharge pipe 65*a* by the blower (not illustrated) provided in the processing portion 67.

The discharge pipe 65*b* is arranged to the gas chamber 51*b* at the side opposite to the ground plane in the sealed container 8. After the cock 68*b* and the cock 68*c* are opened by a worker, the arc-extinguishing gas containing carbon monoxide accumulated at the side opposite to the ground plane in the sealed container 8 is sent to the processing portion 67 via the discharge pipe 65*b* by the blower (not illustrated) provided in the processing portion 67.

The processing portion 67 has the ozone decomposition catalyst, which is activated carbon, in the casing made of metal such as an aluminum casing. The processing portion 67 sucks the arc-extinguishing gas containing ozone, which is the unnecessary gas, via the gas chamber 51*a* and the discharge pipe 65*a* provided to the ground plane side of the sealed container 8 by the blower (not illustrated) provided in the processing portion 67 and sucks the arc-extinguishing gas containing carbon monoxide, which is the unnecessary gas, via the gas chamber 51*b* and the discharge pipe 65*b* provided to the side opposite to the ground plane of the sealed container 8 by the blower (not illustrated) provided in the processing portion 67.

The processing portion 67 mixes ozone sucked via the discharge pipe 65*a* and carbon monoxide sucked via the discharge pipe 65*b*, and decomposes them by causing the above-described reactions 10, 11, and 12. The processing portion 67 sends the arc-extinguishing gas to the sealed container 8 via the air supply pipe 66 after decomposing ozone sucked via the discharge pipe 65*a* and carbon monoxide sucked via the discharge pipe 65*b*.

4-3. Effect (1) According to the present embodiment, since the processing portion 67 provided outside the sealed container 8 and configured to decompose the unnecessary gas generated from the arc-extinguishing gas sprayed to the arc, the discharge pipes 65*a* and 65*b* configured to send the arc-extinguishing gas containing the unnecessary gas to the processing portion 67 from the sealed container 8, and the air supply pipe 66 configured to send, to the sealed container 8, the arc-extinguishing gas in which the unnecessary gas is decomposed in the processing portion 67 are provided, the gas circuit breaker can be provided which is capable of reducing the deterioration in insulation performance and current breaking performance due to the unnecessary gas generated from the arc-extinguishing gas in which the unnecessary gas is decomposed and which is sprayed to the arc.

(2) According to the present embodiment, since the discharge pipe 65*a* is arranged to the ground plane side of the sealed container 8, and discharges ozone with the specific gravity heavier than the arc-extinguishing gas in the unnecessary gas generated from the arc-extinguishing gas, the discharge pipe 65*b* is arranged to the side opposite to the ground plane of the sealed container 8, and discharges carbon monoxide with the specific gravity lighter than the arc-extinguishing gas in the unnecessary gas generated from the arc-extinguishing gas, and the processing portion 67 mixes and decomposes ozone sucked via the discharge pipe 65*a* and carbon monoxide sucked via the discharge pipe 65*b*, the gas circuit breaker can be provided which is capable of reducing the deterioration in insulation performance and current breaking performance due to the unnecessary gas.

(3) According to the present, embodiment, since the arc-extinguishing gas containing ozone and carbon monoxide, which are the unnecessary gas, is sent to the sealed container 6 via the air supply pipe 66 after ozone and carbon monoxide are decomposed, reduction in pressure of the arc-extinguishing gas in the sealed container 3 can be avoided. Furthermore, ozone and carbon monoxide, which are the unnecessary gas, can be prevented from being dispersed outside the sealed container 8.

Figure 20:
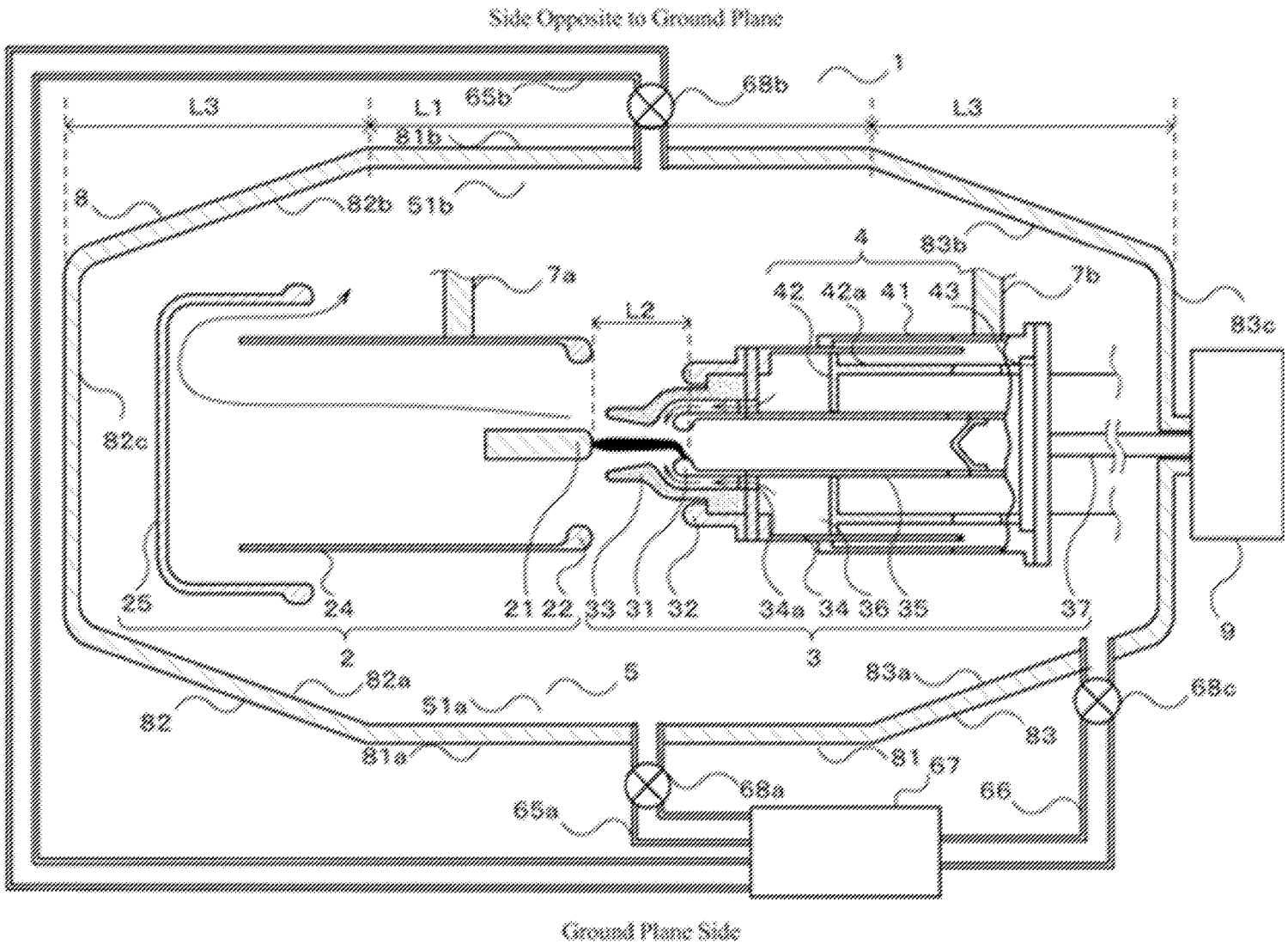
FIG. 20 is a diagram illustrating a structure of a gas circuit, breaker according to a modified example of the fourth embodiment.

4-4. Modified Example (1) As illustrated in FIG. 20, the sealed container 3 may be configured so that a height L1 of the cylindrical portion 81 of the sealed container 8 is equal to or more than a length L2 of an arc generated between the fixed arc contactor 21 and the movable arc contactor 31 at a time of current breaking action. The discharge pipe 65*a* is connected to the gas chamber 51*a*, and the discharge pipe 65*b* is connected to the gas chamber 51*b*. The arc-extinguishing gas containing the unnecessary gas is sent to the processing portion 67 via the discharge pipes 65*a* and 65*b*. The unnecessary gas is decomposed in the processing portion 67, and is sent to the sealed container 8 via the air supply pipe 66.

The height L1 of the cylindrical portion 81 is equal to or more than the length L2 of the arc generated between the fixed arc contactor 21 and the movable arc contactor 31 at the time of current breaking action, and accordingly, the volume of the gas chambers 51*a* and 51*b* can be further increased. This enables the unnecessary gas to be sent to the processing portion 67 via the discharge pipes 65*a* and 65*b* more surely even when the unnecessary gas generated from the arc is dispersed.

The sealed container 8 may be configured so that the height L1 of the cylindrical portion 81 of the sealed container 8 is equal to or more than the height L3 of the truncated cone portion 82 or the truncated cone portion 83 forming the sealed container 8. Since the height L3 of each of the truncated cone portions 82 and 83 can be shortened, the truncated cone portions 82 and 83 can be easily formed, and the gas circuit breaker 1 that can be easily manufactured can be provided.

(2) In the above-described embodiment, although both of the discharge pipe 65*a* configured to send the arc-extinguishing gas containing ozone to the processing portion 67 and the discharge pipe 65*b* configured to send the arc-extinguishing gas containing carbon monoxide to the processing portion 67 are provided, either one of the discharge pipe 65*a* configured to send the arc-extinguishing gas containing ozone to the processing portion 67 and the discharge pipe 65*b* configured to send the arc-extinguishing gas containing carbon monoxide to the processing portion 67 may be provided. The processing portion 67 may adsorb either one of ozone and carbon monoxide as the unnecessary gas.

Figure 21:
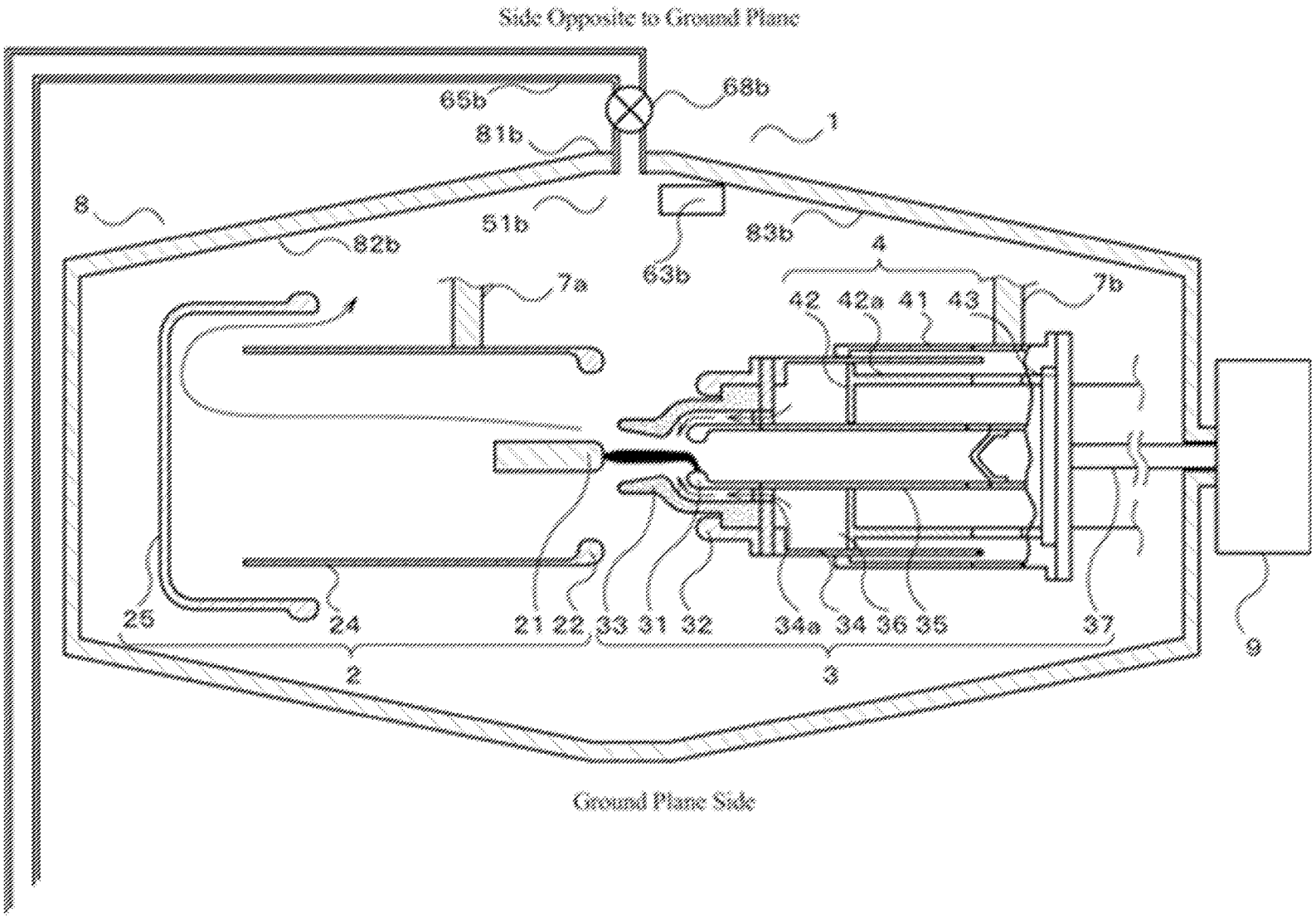
FIG. 21 is a diagram illustrating a structure of a gas circuit breaker according to a modified example of the fourth embodiment, in which the gas circuit breaker has a sensor.
Figure 22:
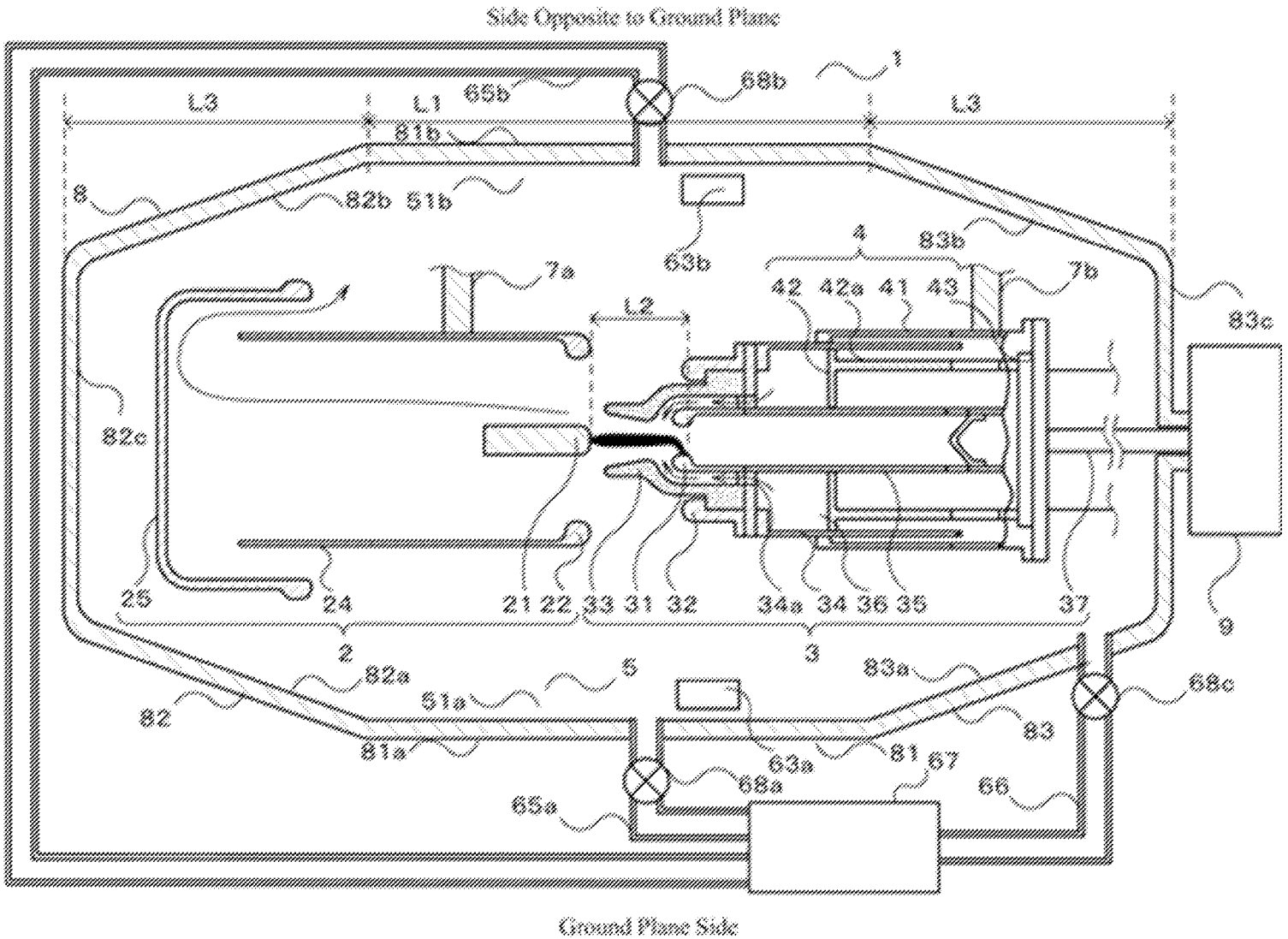
FIG. 22 is a diagram illustrating a structure of a gas circuit breaker according to another form of the modified example of the fourth embodiment, in which the gas circuit breaker has a sensor.

(2) In addition to the above-described embodiment, as illustrated in FIGS. 21 and 22, the sensor 63*a* may be provided at the ground plane side in the sealed container 8. The sensor 63*a* is formed by an ozone sensor formed of a semiconductor. The sensor 63*a* is a sensor configured to detect the unnecessary gas generated from the arc-extinguishing gas sprayed to the arc. The sensor 63*a* detects the concentration of ozone in the unnecessary gas generated from the arc-extinguishing gas sprayed to the arc. The sensor 63*a* is arranged near the gas chamber 51*a* at the ground plane side in the sealed container 8. The output signal of the sensor 63*a* is input to external data logger (not illustrated), etc.

By monitoring the concentration of ozone output from the sensor 63*a*, the worker can know the accumulated amount of ozone. When the concentration of ozone exceeds a predetermined concentration, the worker can open the cocks 68*a* and 68*c* to operate the processing portion 67 to process ozone.

(3) In addition to the above-described embodiment, as illustrated in FIGS. 21 and 22, the sensor 63*b* may be provided at the side opposite to the ground plane in the sealed container 8. The sensor 63*b* is formed by a carbon monoxide sensor formed of a semiconductor. The sensor 63*b* is a sensor configured to detect the unnecessary gas generated from the arc-extinguishing gas sprayed to the arc. The sensor 63*b* detects the concentration of carbon monoxide in the unnecessary gas generated from the arc-extinguishing gas sprayed to the arc. The sensor 63*b* is arranged near the gas chamber 51*b* at the side opposite to the ground plane in the sealed container 8. The output signal of the sensor 63*b* is input to external data logger (not illustrated), etc.

By monitoring the concentration of carbon monoxide output from the sensor 63*b*, the worker can know the accumulated amount of carbon monoxide. When the concentration of carbon monoxide exceeds a predetermined concentration, the worker can open the cocks 68*b* and 68*c* to operate the processing portion 67 to process carbon monoxide.

Figure 23:
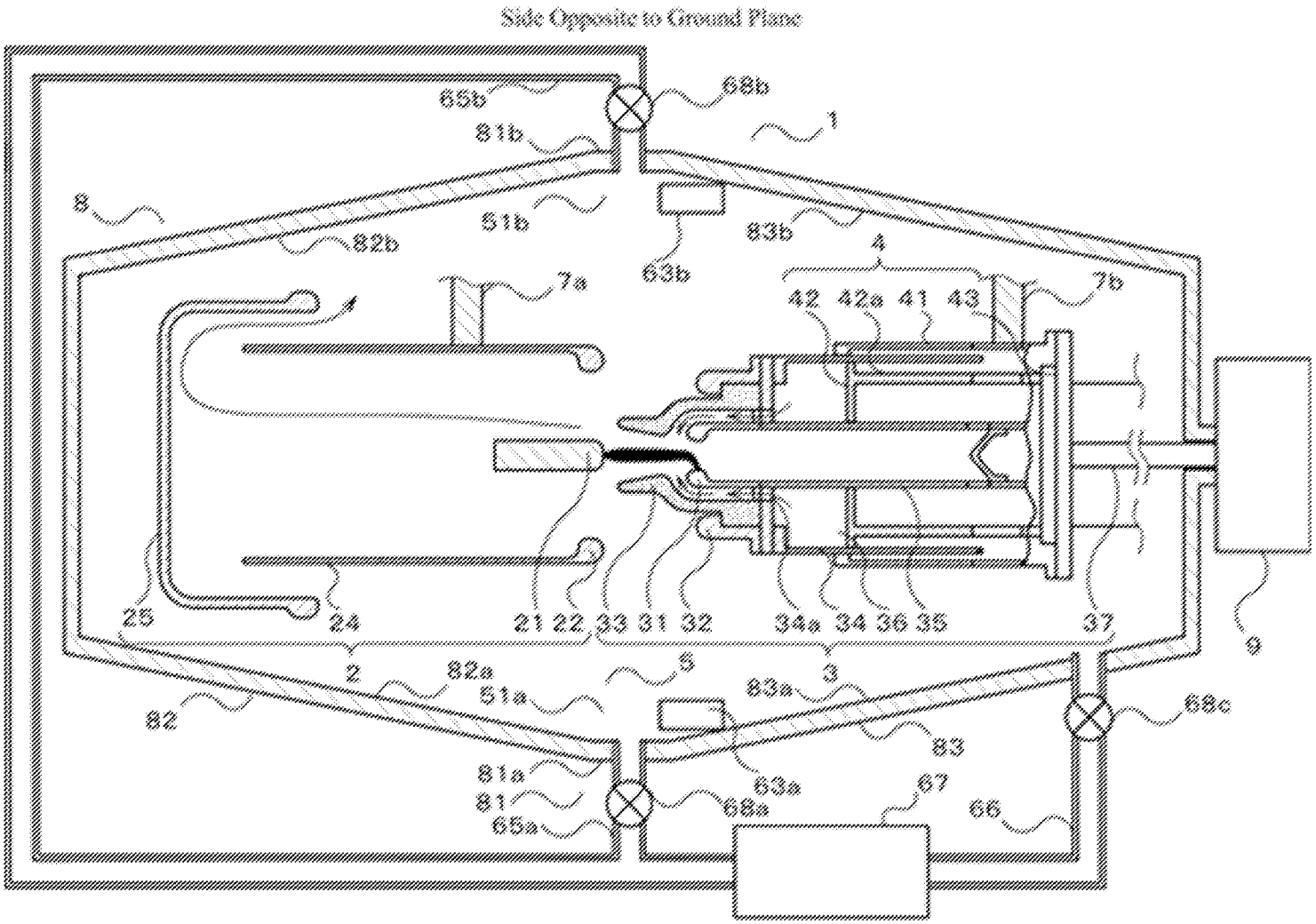
FIG. 23 is a diagram illustrating a structure of a gas circuit breaker according to a modified example of a discharge pipe in the fourth embodiment.
Figure 24:
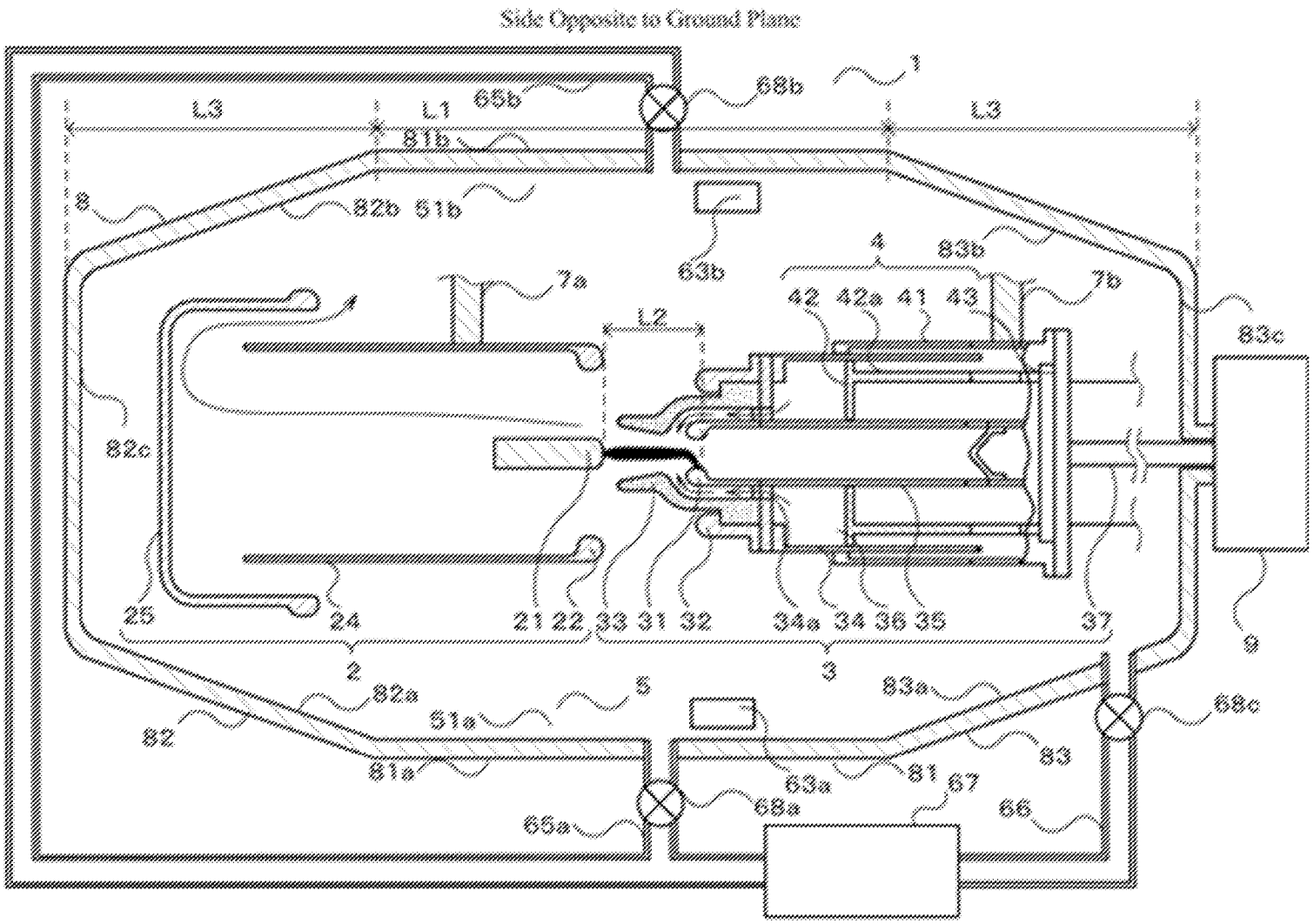
FIG. 24 is a diagram illustrating a structure of a gas circuit breaker according to another form of the modified example of the discharge pipe in the fourth embodiment.

(4) In the above-described embodiment, one end of the discharge pipe 65*a* is connected to the sealed container 8, and the other end of the discharge pipe 65*a* is connected to the processing portion 67. Similarly, one end of the discharge pipe 65*b* is connected to the sealed container 8, and the other end of the discharge pipe 65*b* is connected to the processing portion 67. However, the discharge pipes 65*a* and 65*b* may be manifolded and integrated, and connected to the processing portion 67 as illustrated in FIGS. 23 and 24. Such a configuration enables ozone and carbon monoxide to be mixed, so that the decomposition of the unnecessary gas can be efficiently performed.

(5) As an alternative to the above-described embodiment, the discharge pipe 65*a* may be connected to the gas chamber 51*a* in the second modified example illustrated in FIG. 4, the gas chambers 54*a* and 55*a* in the second modified example illustrated in FIGS. 5 and 6, the gas chamber 56*a* in the fourth modified example illustrated in FIG. 7, and the gas chambers 57*a* and 58*a* in the fifth modified example illustrated in FIGS. 9 and 11, according to the first embodiment. Such a configuration enables the volume of the sealed container 8 to be reduced. As a result, a compact gas circuit breaker that is easy to install in small installation location can be provided.

(6) As an alternative to the above-described embodiment, the discharge pipe 65*b* may be connected to the gas chamber 51*b* in the second modified example illustrated in FIG. 4, the gas chambers 54*b* and 55*b* in the third modified example illustrated in FIGS. 5 and 6, the gas chamber 56*b* in the fourth modified example illustrated in FIG. 7, and the gas chambers 57*b* and 58*b* in the fifth modified example illustrated in FIGS. 9 and 11, according to the first embodiment. Such a configuration enables the volume of the sealed container 8 to be reduced. As a result, a compact gas circuit breaker that is easy to install in small installation location can be provided.

Figure 25:
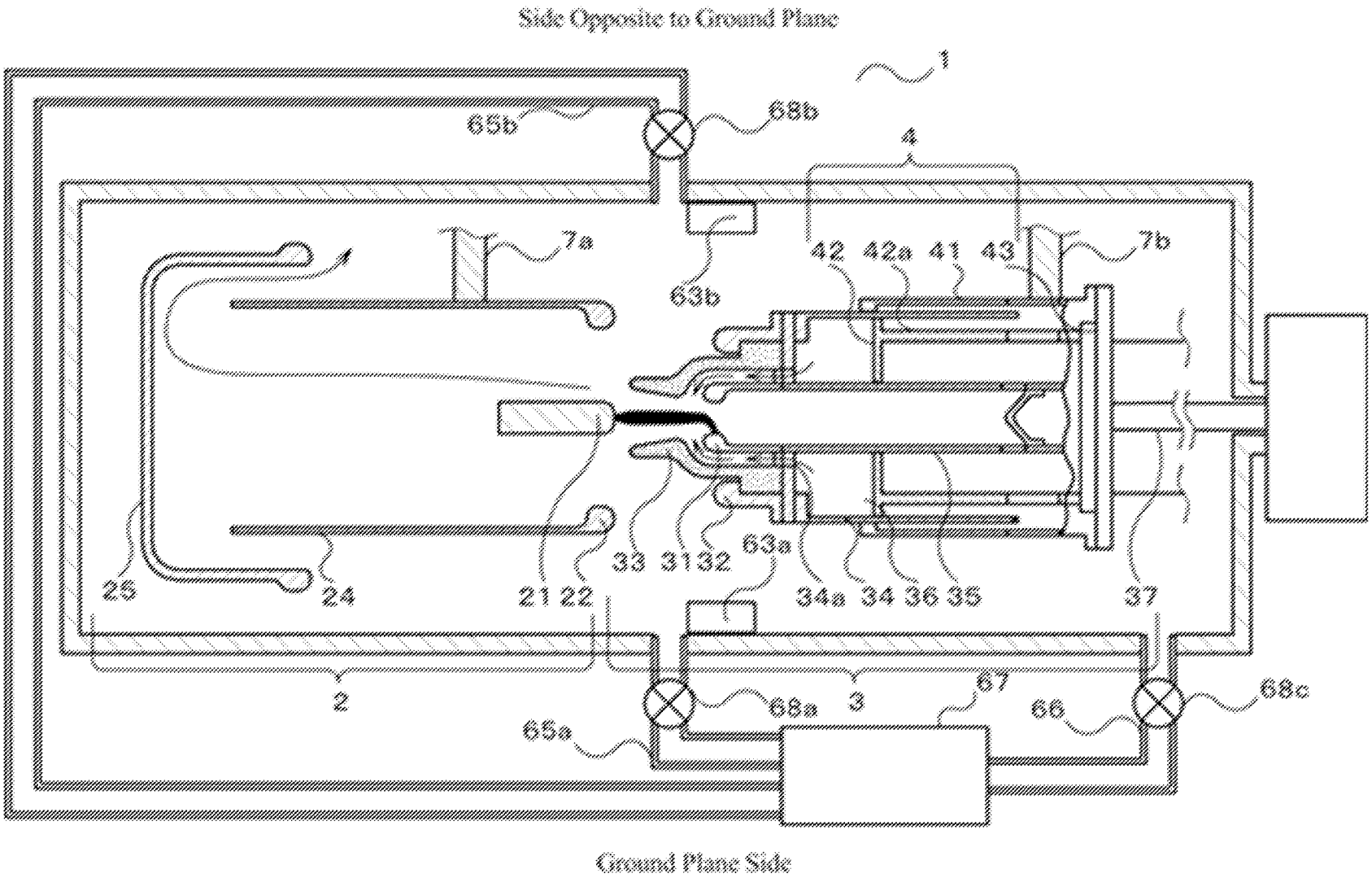
FIG. 25 is a diagram illustrating a structure of a gas circuit breaker according to another form of the modified example of the fourth embodiment.

(7) In the above-described embodiment, although the discharge pipe 65*a* is connected to the gas chamber 51*a*, the installation location of the discharge pipe 65*a* is not limited thereto. As illustrated in FIG. 25, a configuration may be adopted in which the sealed container 8 does not include the gas chamber 51*a*, and the discharge pipe 65*a* is connected to the sealed container 8 at the ground plane side.

(8) In the above-described embodiment, although the discharge pipe 65*b* is connected to the gas chamber 51*b*, the installation location of the discharge pipe 65*b* is not limited thereto. As illustrated in FIG. 25, a configuration may be adopted in which the sealed container 8 does not include the gas chamber 51*b*, the discharge pipe 65*b* is connected to the sealed container 8 at the side opposite to the ground plane.

5. Other Embodiment

Although the embodiments including the modified examples have been described, these embodiments are merely provided as examples, and are not intended to limit the scope of the claims. These embodiments can be implemented in other various forms, and various omissions, replacements, and modifications can be made thereto without departing from the scope of the invention. These embodiments and modifications are included in the claims of the invention and equivalents thereto, similarly to the scope and abstract of the invention. One example is described below.

(1) In the above-described embodiment, although the arc-extinguishing gas mainly contains carbon dioxide ($CO_2$), the arc-extinguishing gas is not limited thereto. The arc-extinguishing gas may be gas containing other composition that generates the unnecessary gas.

REFERENCE SIGNS LIST

1 Gas circuit breaker
2, 4 Fixed contactor portion
3 Movable contactor portion
5, 51*a*, 51*b*, 54*a*, 54*b*, 55*a*, 55*b*, 56*a*, 56*b*, 57*a*, 57*b*, 58*a*, 58*b* Gas chamber
7*a*, 7*b* Power supply line
8 Sealed container
9 Driving device
21 Fixed arc contactor
22 Fixed conductive contactor
24 Ventilation cylinder
25 Exhaust pipe
31 Movable arc contactor
32 Movable conductive contactor
33 Insulation nozzle
34 Cylinder

34*a* Through hole
35 Operation rod
36 Pressure accumulating chamber
37 Insulation rod
41 Conductive contactor
42 Piston
42*a* Piston support
43 Support
61*a*, 61*b* Ozona decomposition catalyst
62*a*, 62*b* Discharge pipe
63*a*, 63*b* Sensor
64*a*, 64*b* Cock
65*a*, 65*b* Discharge pipe
66 Air supply pipe
67 Processing portion
68*a*, 68*b*, 68*c* Cock
81 Cylindrical portion
81*a*, 81*b* Flat portion
82, 83 Truncated cone portion
32*a*, 82*b*, 83*a*, 83*b*, 34*a*, 84*b*, 85*a*, 85*b* portion
82*c*, 83*c* Bottom
86 Cylindrical portion

The invention claimed is:

1. A gas circuit breaker, comprising:
a sealed container in which arc-extinguishing gas is enclosed;
a first fixed contactor portion fixed to the sealed container;
a second fixed contactor portion fixed to the sealed container; and
a movable contactor portion which moves between the first fixed contactor portion and the second fixed contactor portion, and which conducts and breaks current between the first fixed contactor portion and the second fixed contactor portion,
wherein an arc generated between a fixed arc contactor provided to the first fixed contactor portion and a movable arc contactor provided to the movable contactor portion at a time of current breaking action is extinguished by spraying the arc-extinguishing gas,
the gas circuit breaker further comprising a gas chamber configured to accumulate unnecessary gas generated from the arc-extinguishing gas sprayed to the arc,
wherein:
the sealed container is formed by joining ends of two hollow truncated cone portions both having a large opening diameter via a cylindrical portion between the ends,
the gas chamber is formed inside the cylindrical portion forming the sealed container, and
a height of the cylindrical portion is equal to or more than a length of the arc generated between the fixed arc contactor and the movable arc contactor at the time of the current breaking action.

2. The gas circuit breaker according to claim 1, wherein the gas chamber is configured to accumulate unnecessary gas with a specific gravity heavier than the arc-extinguishing gas, and is arranged on a ground plane side in the sealed container.

3. The gas circuit breaker according claim 1, wherein
the gas chamber is configured to accumulate unnecessary gas with a specific gravity lighter than the arc-extinguishing gas, and is arranged on a side opposite to a ground plane in the sealed container.

4. The gas circuit breaker according to claim 1, wherein a catalyst for decomposing the unnecessary gas is placed in the gas chamber.

5. The gas circuit breaker according to claim 4, wherein the catalyst includes at least one of carbon, manganese, aluminum, cerium, barium, platinum, palladium, rhodium, and ruthenium.

6. The gas circuit breaker according to claim 1, wherein an adsorbent for adsorbing the unnecessary gas is placed in the gas chamber.

7. The gas circuit breaker according to claim 6, wherein the adsorbent is activated carbon.

8. The gas circuit breaker according to claim 1, wherein:
the gas chamber includes a first gas chamber which is configured to accumulate unnecessary gas with a specific gravity heavier than the arc-extinguishing gas and is arranged on a ground plane side in the sealed container, and a second gas chamber which is configured to accumulate unnecessary gas with a specific gravity lighter than the arc-extinguishing gas and is arranged on a side opposite to a ground plane in the sealed container,
the gas circuit breaker further comprising:
a processing portion which is provided outside the sealed container, and is configured to decompose the unnecessary gas generated from the arc-extinguishing gas sprayed to the arc;
a first discharge pipe configured to send the unnecessary gas from the first gas chamber to the processing portion;
a second discharge pipe configured to send the unnecessary gas from the second gas chamber to the processing portion; and
an air supply pipe configured to send the arc-extinguishing gas in which the unnecessary gas is decomposed in the processing portion to the sealed container.

9. The gas circuit breaker according to claim 1, further comprising:
at least one of an exhaust pipe which is configured to exhaust ozone with a specific gravity heavier than the arc-extinguishing gas in the unnecessary gas generated from the arc-extinguishing gas and is arranged to a ground plane side of the sealed container, and an exhaust pipe which is configured to exhaust carbon monoxide with a specific gravity lighter than the arc-extinguishing gas in the unnecessary gas generated from the arc-extinguishing gas and is arranged to a side opposite to a ground plane of the sealed container.

10. The gas circuit breaker according to claim 1, further comprising
a sensor configured to detect the unnecessary gas generated from the arc-extinguishing gas sprayed to the arc.

11. The gas circuit breaker according to claim 10, wherein the sensor is at least one of an ozone sensor which is configured to detect ozone with a specific gravity heavier than the arc-extinguishing gas in the unnecessary gas generated from the arc-extinguishing gas and is arranged on a ground plane side in the sealed container, and a carbon monoxide sensor which is configured to detect carbon monoxide with a specific gravity lighter than the arc-extinguishing gas in the unnecessary gas generated from the arc-extinguishing gas and is arranged on a side opposite to a ground plane in the sealed container.

12. The gas circuit breaker according to claim 1, wherein the arc-extinguishing gas is at 0.1 MPa-g or more, and contains equal to or more than 50% of carbon dioxide.

13. A gas circuit breaker, comprising:
a sealed container in which arc-extinguishing gas is enclosed;

a first fixed contactor portion fixed to the sealed container;

a second fixed contactor portion fixed to the sealed container; and a movable contactor portion which moves between the first fixed contactor portion and the second fixed contactor portion, and which conducts and breaks current between the first fixed contactor portion and the second fixed contactor portion, wherein an arc generated between a fixed arc contactor provided to the first fixed contactor portion and a movable arc contactor provided to the movable contactor portion at a time of current breaking action is extinguished by spraying the arc-extinguishing gas, the gas circuit breaker further comprising a gas chamber configured to accumulate unnecessary gas generated from the arc-extinguishing gas sprayed to the arc, wherein:

the sealed container is formed by joining ends of two hollow truncated cone portions both having a large opening diameter via a cylindrical portion between the ends, the gas chamber is formed inside the cylindrical portion forming the sealed container, and a height of the cylindrical portion is equal to or more than a height of the truncated cone portion forming the sealed container.

14. The gas circuit breaker according to claim 13, wherein the gas chamber is configured to accumulate unnecessary gas with a specific gravity heavier than the arc-extinguishing gas, and is arranged on a ground plane side in the sealed container.

15. The gas circuit breaker according claim 13, wherein the gas chamber is configured to accumulate unnecessary gas with a specific gravity lighter than the arc-extinguishing gas, and is arranged on a side opposite to a ground plane in the sealed container.

16. The gas circuit breaker according to claim 13, wherein a catalyst for decomposing the unnecessary gas is placed in the gas chamber.

17. The gas circuit breaker according to claim 13, wherein an adsorbent for adsorbing the unnecessary gas is placed in the gas chamber.

18. The gas circuit breaker according to claim 13, wherein:

the gas chamber includes a first gas chamber which is configured to accumulate unnecessary gas with a specific gravity heavier than the arc-extinguishing gas and is arranged on a ground plane side in the sealed container, and a second gas chamber which is configured to accumulate unnecessary gas with a specific gravity lighter than the arc-extinguishing gas and is arranged on a side opposite to a ground plane in the sealed container, the gas circuit breaker further comprising:

a processing portion which is provided outside the sealed container, and is configured to decompose the unnecessary gas generated from the arc-extinguishing gas sprayed to the arc;

a first discharge pipe configured to send the unnecessary gas from the first gas chamber to the processing portion;

a second discharge pipe configured to send the unnecessary gas from the second gas chamber to the processing portion; and an air supply pipe configured to send the arc-extinguishing gas in which the unnecessary gas is decomposed in the processing portion to the sealed container.

19. The gas circuit breaker according to claim 13, further comprising:

at least one of an exhaust pipe which is configured to exhaust ozone with a specific gravity heavier than the arc-extinguishing gas in the unnecessary gas generated from the arc-extinguishing gas and is arranged to a ground plane side of the sealed container, and an exhaust pipe which is configured to exhaust carbon monoxide with a specific gravity lighter than the arc-extinguishing gas in the unnecessary gas generated from the arc-extinguishing gas and is arranged to a side opposite to a ground plane of the sealed container.

20. The gas circuit breaker according to claim 13, further comprising a sensor configured to detect the unnecessary gas generated from the arc-extinguishing gas sprayed to the arc.

* * * * *